US012194349B2

(12) United States Patent
Parsons et al.

(10) Patent No.: US 12,194,349 B2
(45) Date of Patent: Jan. 14, 2025

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Michael R. Nicolette, Scottsdale, AZ (US); Bradley D. Schweigert, Cave Creek, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 185 days.

(21) Appl. No.: 17/682,476

(22) Filed: Feb. 28, 2022

(65) Prior Publication Data

US 2022/0176213 A1 Jun. 9, 2022

Related U.S. Application Data

(63) Continuation-in-part of application No. 17/155,486, filed on Jan. 22, 2021, now Pat. No. 11,745,061, and (Continued)

(51) Int. Cl.
*A63B 53/04* (2015.01)
*A63B 60/02* (2015.01)
*A63B 60/54* (2015.01)

(52) U.S. Cl.
CPC ..... *A63B 53/0466* (2013.01); *A63B 53/04* (2013.01); *A63B 60/02* (2015.10); (Continued)

(58) Field of Classification Search
CPC ..... A63B 53/0466; A63B 53/04; A63B 60/02; A63B 2053/0491; A63B 53/0408; (Continued)

(56) References Cited

U.S. PATENT DOCUMENTS 723,258 A 3/1903 Felton
1,133,129 A 3/1915 Govan
(Continued)

FOREIGN PATENT DOCUMENTS

DE 29715997 U1 2/1998
GB 2249031 A 4/1992
(Continued)

OTHER PUBLICATIONS

Kozuchowski, Zak, "Callaway Mack Daddy 2 PM Grind Wedges" (http://www.golfwrx.com/276203/callaway-mack-daddy-2-pm-grind-wedges/), www.golfwrx.com, GolfWRX Holdings, LLC, published Jan. 21, 2015.

(Continued)

*Primary Examiner* — Sebastiano Passaniti

(57) ABSTRACT

Embodiments of golf club heads, golf clubs, and methods to manufacture golf club heads and golf clubs are generally described herein. In one example, a golf club head includes a body portion and a face portion. The body portion includes an interior cavity having a lower cavity portion extending from a location proximate to a sole portion edge of the body portion toward a top portion edge of the body portion and an upper cavity portion extending from a location proximate to the top portion edge toward the sole portion edge. The face portion includes a front surface and a back surface. A filler material in the interior cavity includes a lower filler portion in the lower cavity portion and an upper filler portion in the upper cavity portion. The upper filler portion includes a first filler arm portion extending form the lower filler portion toward the top portion edge and coupled to a back wall portion of the body portion, and a second filler arm portion extending from the lower filler portion toward the top portion edge and coupled to the back surface of the face portion. A portion of the interior cavity between the first filler arm portion and the second filler arm portion defines a (Continued)

slot extending from the lower filler portion toward the top portion edge. Other examples and embodiments may be described and claimed.

13 Claims, 35 Drawing Sheets

Related U.S. Application Data a continuation of application No. 17/099,362, filed on Nov. 16, 2020, now Pat. No. 11,291,890, which is a continuation of application No. 16/820,136, filed on Mar. 16, 2020, now Pat. No. 10,874,919, said application No. 17/155,486 is a continuation of application No. 16/774,449, filed on Jan. 28, 2020, now Pat. No. 10,926,142, said application No. 16/820,136 is a continuation of application No. 16/590,105, filed on Oct. 1, 2019, now Pat. No. 10,632,349, said application No. 16/774,449 is a continuation of application No. 16/179,406, filed on Nov. 2, 2018, now Pat. No. 10,583,336.

(60) Provisional application No. 62/908,467, filed on Sep. 30, 2019, provisional application No. 62/903,467, filed on Sep. 20, 2019, provisional application No. 62/877,934, filed on Jul. 24, 2019, provisional application No. 62/877,915, filed on Jul. 24, 2019, provisional application No. 62/865,532, filed on Jun. 24, 2019, provisional application No. 62/826,310, filed on Mar. 29, 2019, provisional application No. 62/814,959, filed on Mar. 7, 2019, provisional application No. 62/581,456, filed on Nov. 3, 2017.

(52) U.S. Cl.
CPC ..... *A63B 53/0408* (2020.08); *A63B 53/0412* (2020.08); *A63B 53/0433* (2020.08); *A63B 53/0475* (2013.01); *A63B 2053/0491* (2013.01); *A63B 60/54* (2015.10)

(58) Field of Classification Search
CPC ..... A63B 53/0412; A63B 53/0433; A63B 53/0475; A63B 60/54
USPC ..... 473/324–350, 287–292
See application file for complete search history.

(56) References Cited

U.S. PATENT DOCUMENTS 1,534,600 A 4/1925 Mattern
1,538,312 A 5/1925 Neish
D138,438 S 8/1944 Link
3,020,048 A 2/1962 Carroll
3,266,805 A 8/1966 Bulla
D215,101 S 9/1969 Sabat
D229,431 S 11/1973 Baker
3,843,122 A 10/1974 Florian
D234,609 S 3/1975 Raymont
D239,550 S 4/1976 Timbrook
D240,748 S 7/1976 Bock et al.
4,085,934 A 4/1978 Churchward
D253,778 S 12/1979 Madison
4,438,931 A * 3/1984 Motomiya ..... A63B 53/0466 473/346
4,502,687 A 3/1985 Kochevar
4,523,759 A 6/1985 Igarashi
4,545,580 A 10/1985 Tomita et al.
4,591,160 A 5/1986 Piragino
D294,617 S 3/1988 Perkins
4,754,977 A 7/1988 Sahm
4,803,023 A 2/1989 Enomoto et al.
4,824,116 A 4/1989 Nagamoto et al.
4,928,972 A 5/1990 Nakanishi et al.
4,988,104 A 1/1991 Shiotani et al.
5,028,049 A 7/1991 McKeighen
5,090,702 A 2/1992 Viste
5,106,094 A 4/1992 Desbiolles et al.
5,158,296 A 10/1992 Lee
5,176,384 A 1/1993 Sata et al.
5,178,392 A * 1/1993 Santioni ..... A63B 53/0466 273/153 R
5,184,823 A 2/1993 Desboilles et al.
5,213,328 A 5/1993 Long et al.
D336,672 S 6/1993 Gorman
5,219,408 A * 6/1993 Sun ..... B22C 9/12 164/76.1
5,244,211 A 9/1993 Lukasiewicz
5,261,664 A * 11/1993 Anderson ..... A63B 53/0466 473/345
5,290,036 A 3/1994 Fenton et al.
5,306,450 A 4/1994 Okumoto et al.
5,348,302 A 9/1994 Sasamoto et al.
D351,883 S 10/1994 Solheim et al.
5,351,958 A 10/1994 Helmstetter
5,419,559 A 5/1995 Melanson et al.
5,419,560 A 5/1995 Bamber
5,421,577 A 6/1995 Kobayashi
5,425,535 A * 6/1995 Gee ..... A63B 60/00 D21/747
D361,358 S 8/1995 Simmons
5,447,311 A 9/1995 Viollaz et al.
5,451,056 A 9/1995 Manning
D362,885 S 10/1995 Blough et al.
5,485,998 A 1/1996 Kobayashi
5,518,243 A 5/1996 Redman
5,540,437 A 7/1996 Bamber
5,595,548 A 1/1997 Beck
D378,111 S 2/1997 Parente et al.
5,637,045 A 6/1997 Igarashi
5,647,808 A 7/1997 Hosokawa
5,649,873 A 7/1997 Fuller
5,669,830 A 9/1997 Bamber
5,766,091 A 6/1998 Humphrey et al.
5,766,092 A 6/1998 Mimeur et al.
5,769,735 A 6/1998 Hosokawa
5,772,527 A 6/1998 Liu
5,788,584 A 8/1998 Parente et al.
5,797,807 A 8/1998 Moore
5,827,132 A 10/1998 Bamber
5,899,821 A 5/1999 Hsu et al.
5,935,016 A 8/1999 Antonious
6,012,990 A 1/2000 Nishizawa
D421,080 S 2/2000 Chen
6,064,568 A 5/2000 Schmitt
D426,276 S 6/2000 Besnard et al.
6,077,171 A 6/2000 Yoneyama
6,162,133 A 12/2000 Peterson
6,165,081 A 12/2000 Chou
D442,659 S 5/2001 Kubica et al.
6,231,458 B1 5/2001 Cameron et al.
6,238,302 B1 5/2001 Helmstetter et al.
D445,862 S 7/2001 Ford
6,290,609 B1 9/2001 Takeda
6,386,990 B1 5/2002 Reyes et al.
D469,833 S 2/2003 Roberts et al.
D475,107 S 5/2003 Madore
D478,140 S 8/2003 Burrows
6,607,451 B2 8/2003 Kosmatka et al.
6,638,182 B2 10/2003 Kosmatka
6,695,714 B1 2/2004 Bliss et al.
6,702,693 B2 3/2004 Bamber
6,780,123 B2 8/2004 Hasebe
6,811,496 B2 11/2004 Wahl et al.
6,830,519 B2 12/2004 Reed et al.
6,855,067 B2 2/2005 Solheim et al.
D502,975 S 3/2005 Schweigert et al.
D503,204 S 3/2005 Nicolette et al.
6,899,637 B2 * 5/2005 Caldwell ..... A63B 53/0466 473/409

(56) References Cited

U.S. PATENT DOCUMENTS

D508,545 S 8/2005 Roberts et al.
D508,969 S 8/2005 Hasebe
6,923,733 B2 8/2005 Chen
D514,183 S 1/2006 Schweigert et al.
6,984,180 B2 1/2006 Hasebe
D523,501 S 6/2006 Nicolette et al.
7,121,956 B2 10/2006 Lo
7,128,663 B2 10/2006 Bamber
7,153,222 B2 12/2006 Gilbert et al.
D534,595 S 1/2007 Hasebe
7,156,751 B2 1/2007 Wahl et al.
7,169,057 B2 1/2007 Wood et al.
7,182,698 B2 2/2007 Tseng
7,207,900 B2 4/2007 Nicolette et al.
D543,601 S 5/2007 Kawami
7,281,991 B2 10/2007 Gilbert et al.
D555,219 S 11/2007 Lin
7,303,486 B2 12/2007 Imamoto
7,351,164 B2 4/2008 Schweigert et al.
7,396,299 B2 7/2008 Nicolette et al.
7,553,241 B2 6/2009 Park et al.
7,582,024 B2 9/2009 Shear
7,588,502 B2 9/2009 Nishino
7,594,862 B2 9/2009 Gilbert
7,611,424 B2 11/2009 Nagai et al.
7,658,686 B2 2/2010 Soracco
D618,293 S 6/2010 Foster et al.
7,744,484 B1 6/2010 Chao
7,744,486 B2 6/2010 Hou et al.
7,744,487 B2 6/2010 Tavares et al.
7,749,100 B2 7/2010 Tavares et al.
7,785,212 B2 8/2010 Lukasiewicz et al.
7,794,333 B2 9/2010 Wallans et al.
7,798,917 B2 9/2010 Nguyen et al.
7,803,068 B2 9/2010 Clausen et al.
7,815,521 B2 10/2010 Ban et al.
7,846,040 B2 12/2010 Ban
7,938,738 B2 5/2011 Roach
8,012,040 B2 9/2011 Takechi
8,062,150 B2 11/2011 Gilbert et al.
8,088,025 B2 1/2012 Wahl et al.
8,092,319 B1 1/2012 Cackett et al.
8,105,180 B1 1/2012 Cackett et al.
8,221,262 B1 7/2012 Cackett et al.
8,246,487 B1 8/2012 Cackett et al.
8,257,196 B1 9/2012 Abbott et al.
8,262,506 B2 9/2012 Watson et al.
8,277,337 B2 10/2012 Shimazaki
8,328,662 B2 12/2012 Nakamura et al.
8,376,878 B2 2/2013 Bennett et al.
8,393,976 B2 3/2013 Soracco et al.
D681,142 S 4/2013 Fossum et al.
8,414,422 B2 4/2013 Peralta et al.
8,449,406 B1 5/2013 Frame et al.
8,475,293 B2 7/2013 Morin et al.
8,506,420 B2 8/2013 Hocknell et al.
8,535,176 B2 * 9/2013 Bazzel ..... A63B 53/047 473/290
8,545,343 B2 10/2013 Boyd et al.
8,574,094 B2 11/2013 Nicolette et al.
8,657,700 B2 2/2014 Nicolette et al.
8,663,026 B2 3/2014 Blowers et al.
8,690,710 B2 4/2014 Nicolette et al.
8,753,230 B2 6/2014 Stokke et al.
8,790,196 B2 7/2014 Solheim et al.
8,827,832 B2 9/2014 Breier et al.
8,827,833 B2 9/2014 Amano et al.
8,845,455 B2 9/2014 Ban et al.
8,858,362 B1 10/2014 Leposky et al.
D722,351 S 2/2015 Parsons et al.
D722,352 S 2/2015 Nicolette et al.
D723,120 S 2/2015 Nicolette
8,961,336 B1 2/2015 Parsons et al.
D724,164 S 3/2015 Schweigert et al.
D725,208 S 3/2015 Schweigert
D726,265 S 4/2015 Nicolette
D726,846 S 4/2015 Schweigert
9,005,056 B2 4/2015 Pegnatori
D729,892 S 5/2015 Nicolette et al.
D733,234 S 6/2015 Nicolette
9,044,653 B2 6/2015 Wahl et al.
D738,449 S 9/2015 Schweigert
D739,487 S 9/2015 Schweigert
9,192,830 B2 * 11/2015 Parsons ..... A63B 53/0475
9,192,832 B2 11/2015 Parsons et al.
9,199,143 B1 12/2015 Parsons et al.
D746,927 S 1/2016 Parsons et al.
D748,214 S 1/2016 Nicolette et al.
D748,215 S 1/2016 Parsons et al.
D748,749 S 2/2016 Nicolette et al.
D753,251 S 4/2016 Schweigert et al.
D753,252 S 4/2016 Schweigert
D755,319 S 5/2016 Nicolette et al.
D756,471 S 5/2016 Nicolette et al.
9,345,938 B2 5/2016 Parsons et al.
9,346,203 B2 5/2016 Parsons et al.
9,352,197 B2 5/2016 Parsons et al.
D759,178 S 6/2016 Nicolette
D760,334 S 6/2016 Schweigert et al.
9,364,727 B2 6/2016 Parsons et al.
9,399,158 B2 7/2016 Parsons et al.
9,421,437 B2 8/2016 Parsons et al.
9,427,634 B2 8/2016 Parsons et al.
9,440,124 B2 9/2016 Parsons et al.
9,468,821 B2 10/2016 Parsons et al.
9,517,393 B2 12/2016 Cardani et al.
9,533,201 B2 1/2017 Parsons et al.
9,550,096 B2 1/2017 Parsons et al.
9,610,481 B2 4/2017 Parsons et al.
9,630,070 B2 4/2017 Parsons et al.
9,636,554 B2 5/2017 Parsons et al.
9,649,540 B2 5/2017 Parsons et al.
9,649,542 B2 5/2017 Nicolette
9,662,547 B2 5/2017 Parsons et al.
9,675,853 B2 6/2017 Parsons et al.
9,750,993 B2 9/2017 Ritchie et al.
9,782,643 B2 10/2017 Parsons et al.
9,795,842 B1 10/2017 Parsons et al.
9,795,843 B2 10/2017 Parsons et al.
9,814,952 B2 11/2017 Parsons et al.
10,449,428 B2 10/2019 Parsons et al.
10,632,349 B2 4/2020 Parsons et al.
10,874,919 B2 12/2020 Parsons et al.
2001/0055996 A1 12/2001 Iwata et al.
2002/0004427 A1 1/2002 Cheng et al.
2002/0037775 A1 3/2002 Keelan
2002/0094884 A1 7/2002 Hocknell et al.
2002/0107087 A1 8/2002 Fagot
2003/0139226 A1 7/2003 Cheng et al.
2003/0176231 A1 9/2003 Hasebe
2003/0194548 A1 10/2003 McLeod et al.
2004/0082401 A1 4/2004 Takeda
2004/0092331 A1 5/2004 Best
2004/0204263 A1 10/2004 Fagot et al.
2004/0266550 A1 12/2004 Gilbert et al.
2005/0009632 A1 1/2005 Schweigert et al.
2005/0014573 A1 1/2005 Lee
2005/0043117 A1 2/2005 Gilbert et al.
2005/0054462 A1 3/2005 Breier et al.
2005/0119066 A1 6/2005 Stites et al.
2005/0192116 A1 9/2005 Imamoto
2005/0209023 A1 9/2005 Tseng
2005/0239569 A1 10/2005 Best et al.
2005/0245325 A1 * 11/2005 Gilbert ..... A63B 53/047 473/345
2005/0255936 A1 11/2005 Huang
2005/0266931 A1 12/2005 Hou et al.
2005/0277485 A1 12/2005 Hou et al.
2005/0278931 A1 12/2005 Deshmukh et al.
2006/0111200 A1 5/2006 Poynor
2006/0229141 A1 10/2006 Galloway
2006/0240909 A1 10/2006 Breier et al.
2007/0032308 A1 2/2007 Fagot et al.
2007/0129166 A1 6/2007 Shimazaki et al.

(56) References Cited

U.S. PATENT DOCUMENTS

| | | | | |
|---|---|---|---|---|
| 2007/0225084 | A1 | 9/2007 | Schweigert et al. | |
| 2008/0015050 | A1* | 1/2008 | Tavares | A63B 53/047 473/346 |
| 2008/0022502 | A1 | 1/2008 | Tseng | |
| 2008/0058113 | A1 | 3/2008 | Nicolette et al. | |
| 2008/0188322 | A1 | 8/2008 | Anderson et al. | |
| 2008/0300065 | A1 | 12/2008 | Schweigert | |
| 2008/0318705 | A1 | 12/2008 | Clausen et al. | |
| 2008/0318706 | A1 | 12/2008 | Larson | |
| 2009/0029790 | A1 | 1/2009 | Nicolette et al. | |
| 2009/0280923 | A1 | 11/2009 | Park et al. | |
| 2010/0130306 | A1 | 5/2010 | Schweigert | |
| 2010/0178999 | A1 | 7/2010 | Nicolette et al. | |
| 2010/0323812 | A1 | 12/2010 | Boyd et al. | |
| 2011/0021285 | A1 | 1/2011 | Shimazaki | |
| 2011/0028240 | A1 | 2/2011 | Wahl et al. | |
| 2011/0111883 | A1 | 5/2011 | Cackett | |
| 2011/0165963 | A1 | 7/2011 | Cackett et al. | |
| 2011/0269567 | A1 | 11/2011 | Ban et al. | |
| 2011/0294596 | A1 | 12/2011 | Ban | |
| 2012/0196702 | A1 | 8/2012 | Shimazaki | |
| 2013/0137532 | A1 | 5/2013 | Deshmukh et al. | |
| 2013/0225319 | A1 | 8/2013 | Kato | |
| 2013/0281226 | A1 | 10/2013 | Ban | |
| 2013/0288823 | A1 | 10/2013 | Hebreo | |
| 2013/0303303 | A1 | 11/2013 | Ban | |
| 2013/0310192 | A1 | 11/2013 | Wahl et al. | |
| 2013/0316842 | A1 | 11/2013 | Demkowski et al. | |
| 2014/0045605 | A1 | 2/2014 | Fujiwara et al. | |
| 2014/0080621 | A1 | 3/2014 | Nicolette et al. | |
| 2014/0128175 | A1 | 5/2014 | Jertson et al. | |
| 2014/0274441 | A1 | 9/2014 | Greer | |
| 2014/0274442 | A1 | 9/2014 | Honea et al. | |
| 2014/0274451 | A1 | 9/2014 | Knight et al. | |
| 2014/0364248 | A1 | 12/2014 | Wahl et al. | |
| 2015/0231454 | A1 | 8/2015 | Parsons et al. | |
| 2015/0231806 | A1 | 8/2015 | Parsons et al. | |
| 2016/0045793 | A1 | 2/2016 | Cardani et al. | |
| 2016/0296804 | A1 | 10/2016 | Parsons et al. | |
| 2016/0317883 | A1 | 11/2016 | Parsons et al. | |
| 2017/0239533 | A1 | 8/2017 | Cole et al. | |
| 2017/0340928 | A1 | 11/2017 | Parsons et al. | |
| 2018/0028882 | A1 | 2/2018 | Hebreo et al. | |
| 2018/0028883 | A1 | 2/2018 | Morin et al. | |
| 2018/0050243 | A1 | 2/2018 | Parsons et al. | |
| 2018/0140910 | A1 | 5/2018 | Parsons et al. | |
| 2018/0318673 | A1 | 11/2018 | Parsons et al. | |

FOREIGN PATENT DOCUMENTS

| | | | |
|---|---|---|---|
| JP | H0284972 | U | 7/1990 |
| JP | H08257181 | A | 10/1996 |
| JP | H10127832 | A | 5/1998 |
| JP | H10277187 | A | 10/1998 |
| JP | 2001346924 | A | 12/2001 |
| JP | 2002143356 | A | 5/2002 |
| JP | 2004313777 | A | 11/2004 |
| JP | 2005218510 | A | 8/2005 |
| JP | 2013043091 | A | 3/2013 |
| WO | 9215374 | A1 | 9/1992 |

OTHER PUBLICATIONS

PCT/US16/42075: International Search Report and Written Opinion dated Sep. 22, 2016 (13 Pages).

PCT/US19/17464: International Search Report and Written Opinion dated Apr. 29, 2019 (9 Pages).

PCT/US19/54104: International Search Report and Written Opinion dated Dec. 30, 2019 (10 Pages).

PCT/US2015/016666: International Search Report and Written Opinion dated May 14, 2015 (8 Pages).

PCT/US2018/023617: International Search Report and Written Opinion dated May 31, 2018 (10 Pages).

RocketBladez Press Release, "GolfBalled", http://golfballed.com/index.php?option=com_content&view=article&id=724: taylor-made- . . . Oct. 13, 2017, published Jan. 3, 2013.

Taylor Made Golf Company, Inc., https://taylormadegolf.com/on/demandware.static/-/Sites-TMaG-Library/default/v1459859109590/docs/productspecs/TM-S2013-Catalog18.pdf., published Jan. 2013.

U.S. Appl. No. 29/512,313, Nicolette, "Golf Club Head," filed Dec. 18, 2014.

Wall, Jonathan, "Details: Phil's Prototype Mack Daddy PM-GRIND Wedge," (http://www.pgatour.com/equipmentreport/2015/01/21/callaway-wedge.html), www.pgatour.com, PGA Tour, Inc., Published Jan. 21, 2015.

* cited by examiner

GOLF CLUB HEADS AND METHODS TO MANUFACTURE GOLF CLUB HEADS

CROSS REFERENCE

This application is a continuation-in-part of application Ser. No. 17/155,486, filed Jan. 22, 2021, which is a continuation of application Ser. No. 16/774,449, filed Jan. 28, 2020, now U.S. Pat. No. 10,926,142, which is a continuation of application Ser. No. 16/179,406, filed Nov. 2, 2018, now U.S. Pat. No. 10,583,336, which claims the benefit of U.S. Provisional Application No. 62/581,456, filed Nov. 3, 2017.

This application is a continuation of application Ser. No. 17/099,362, filed Nov. 16, 2020, which is a continuation of application Ser. No. 16/820,136, filed Mar. 16, 2020, now U.S. Pat. No. 10,874,919, which is a continuation of application Ser. No. 16/590,105, filed Oct. 1, 2019, now U.S. Pat. No. 10,632,349, which claims the benefit of U.S. Provisional Application No. 62/908,467, filed Sep. 30, 2019, U.S. Provisional Application No. 62/903,467, filed Sep. 20, 2019, U.S. Provisional Application No. 62/877,934, filed Jul. 24, 2019, U.S. Provisional Application No. 62/877,915, filed Jul. 24, 2019, U.S. Provisional Application No. 62/865,532, filed Jun. 24, 2019, U.S. Provisional Application No. 62/826,310, filed Mar. 29, 2019, and U.S. Provisional Application No. 62/814,959, filed Mar. 7, 2019.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOI) of the golf club heads may be optimized to produce certain trajectory and spin rate of a golf ball.

DESCRIPTION OF THE DRAWINGS

FIG. 65 depicts a back view of a face portion of a golf club head according to any embodiment of the apparatus, methods, and articles of manufacture described herein.

Figure 1:
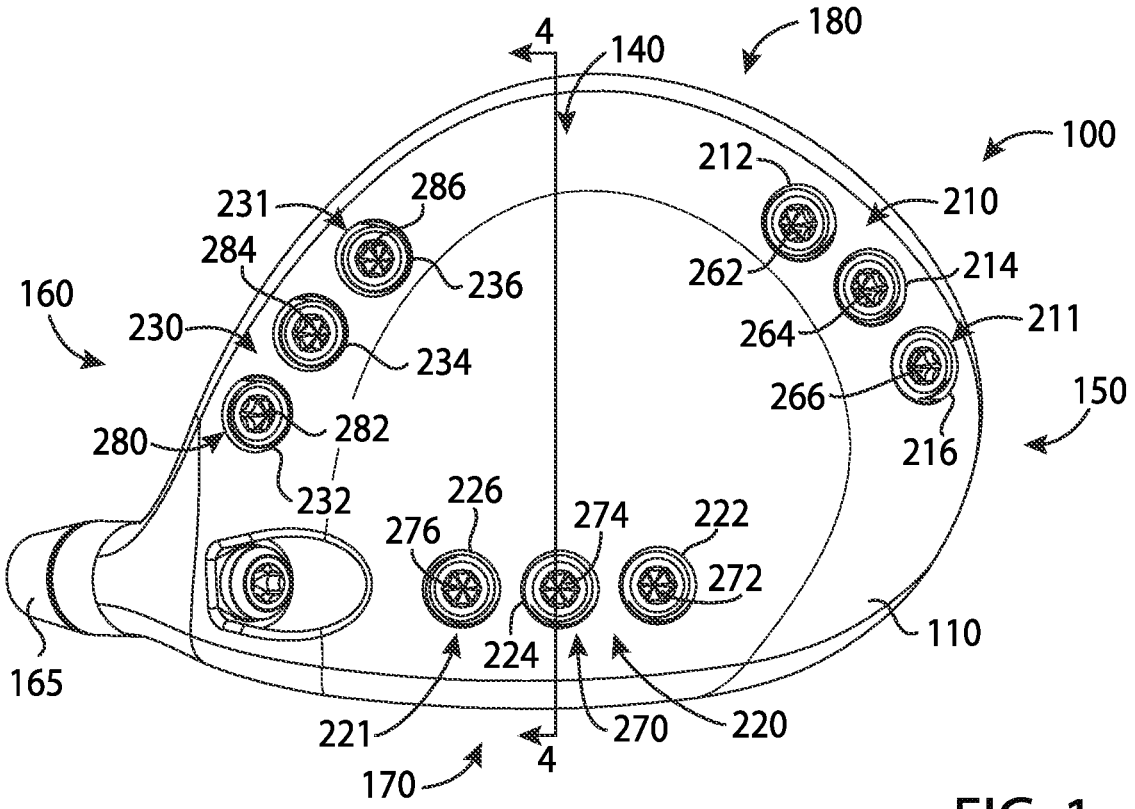
FIGS. 1, 2, 3, and 4 depict a bottom perspective view, a toe-side perspective view, a heel-side perspective view, and a cross-sectional perspective view (along line 4-4 of FIG. 1), respectively, of a golf club head according to an embodiment of the apparatus, methods, and articles of manufacture described herein.
Figure 2:
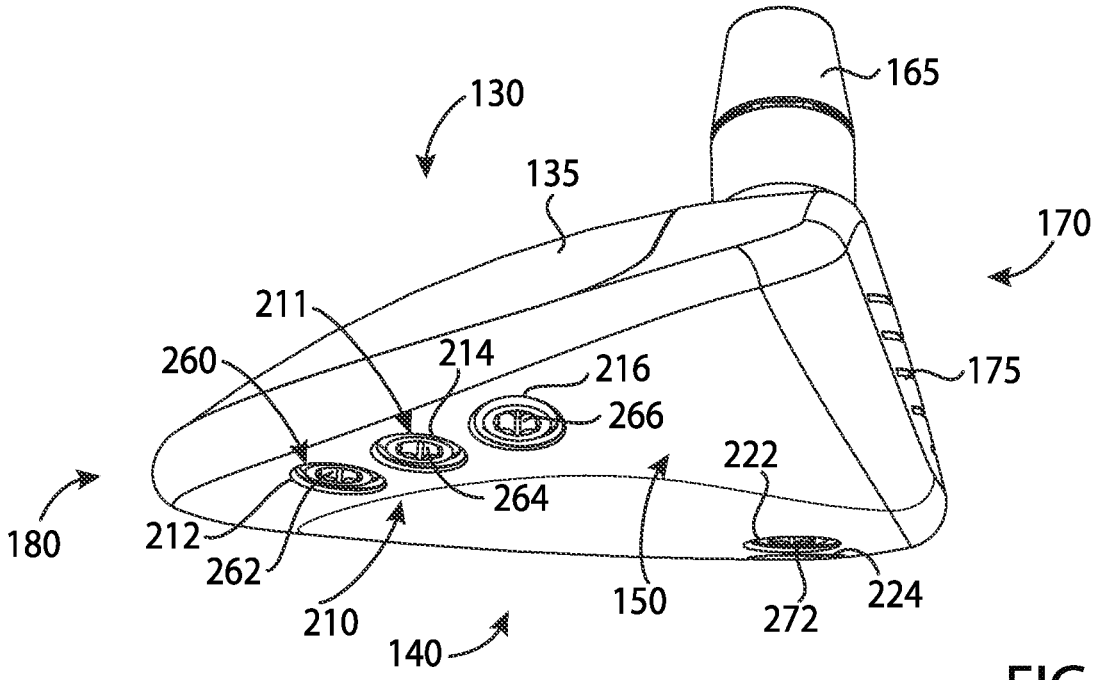
Figure 3:
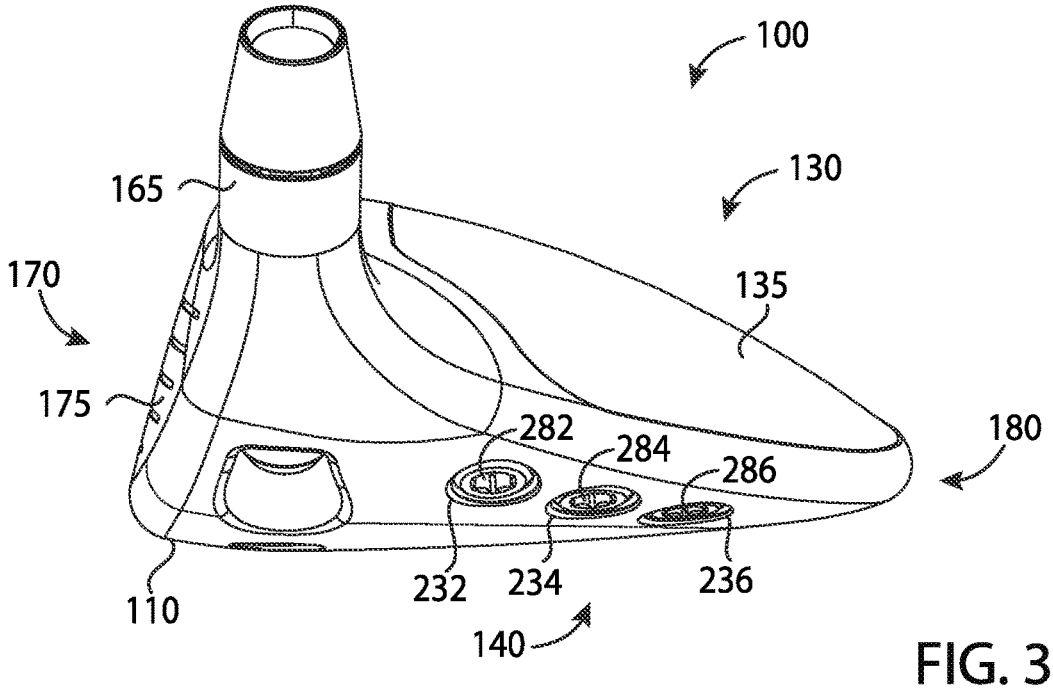

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads, golf clubs, and methods to manufacture golf club heads and golf clubs are described herein. The following U.S. patents and patent applications, which are collectively referred to herein as "the incorporated by reference applications," are incorporated by reference herein in their entirety: U.S. Pat. Nos. 8,961,336; 9,199,140; 9,199,143; 9,352,197; 9,399,158; 9,468,821; 9,533,201; 9,550,096; 9,610,481; 9,630,070; 9,669,270; 9,675,853; 9,782,643; 9,795,842; 9,814,952; 9,821,201; 9,833,667; 9,861,867; 9,981,160; 10,213,659; 10,413,787; and U.S. patent application Ser. No. 15/209,364, filed Jul. 13, 2016; U.S. patent application Ser. No. 15/462,281, filed Mar. 17, 2017; U.S. patent application Ser. No. 15/785,001, filed Oct. 16, 2017; U.S. patent application Ser. No. 15/876,877, filed Jan. 22, 2018; U.S. patent application Ser. No. 15/934,579, filed Mar. 23, 2018; U.S. patent application Ser. No. 16/039,496, filed Jul. 19, 2018; U.S. patent application Ser. No. 16/179,406, filed Nov. 2, 2018; U.S. patent application Ser. No. 16/205,583, filed Nov. 30, 2018; and U.S. patent application Ser. No. 16/422,661, filed May 24, 2019. The apparatus, methods, and articles of manufacture described herein are not limited in this regard.

In the example of FIGS. 1-4, a golf club head 100 may include a body portion 110 with a top portion 130 having a crown portion 135, a bottom portion 140, a toe portion 150, a heel portion 160, a front portion 170, and a rear portion 180. The crown portion 135 may be a separate piece that may be attached to the top portion 130 and constructed from a composite material. The bottom portion 140 may include a skirt portion (not shown) defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The front portion 170 may include a face portion 175 to engage a golf ball (not shown). The golf club head 100 may have a neutral axis 401. The neutral axis 401 may be perpendicular to the face portion 175 and may intersect a center of the face portion 175. The body portion 110 may also include a hosel portion 165 for receiving a shaft (not shown). Alternatively, the body portion 110 may include a bore instead of the hosel portion 165. The body portion 110 may be made from any one or a combination of materials described herein or described in any of the incorporated by reference applications. A maximum front-to-rear distance of the golf club head 100 may be greater than a maximum heel-to-toe distance of the golf club head 100. Although FIGS. 1-4 may depict a particular type of golf club head (e.g., driver-type club head), the apparatus methods, and articles of manufacture described herein may be applicable to other types of club heads (e.g., a fairway wood-type club head, a hybrid-type club head, an iron-type club head, a putter-type club head). The apparatus, methods, and articles of manufacture described herein are not limited in this regard.

The bottom portion 140 may include a plurality of port regions, which are shown for example as a first port region 210 with a first set of ports 211 (generally shown as ports 212, 214, and 216) near the toe portion 150, a second port region 220 with a second set of ports 220 (generally shown as ports 222, 224, and 226) near the front portion 170, and a third port region 230 with a third set of ports 231 (generally shown as ports 232, 234, and 236) near the heel portion 160. Although FIGS. 1-4 show a certain configuration of port regions and ports, the number of port regions, the number and configuration of ports in each region, and the location of the ports may be similar to any of the golf club heads described herein on in any of the incorporated by reference applications. The body portion 110 may also include a plurality of mass portions, shown as a first set of mass portions 260 (generally shown as mass portions 262, 264, and 266), a second set of mass portions 270 (generally shown as mass portions 272, 274, and 276), and a third set of mass portions 280 (generally shown as mass portions 282, 284 and 286). Each port may interchangeably receive any of the mass portions. The masses of the first set of mass portion 260, the second set of mass portions 270 and/or the third set of mass portions 280 may be similar or different. Accordingly, by using mass portions having similar or different masses in each of the ports of the port regions 210, 220 and/or 230, the overall mass in each port region and/or the mass distribution in each port region may be adjusted as described herein and in any of the incorporated by reference applications to generally optimize and/or adjust the swing weight, center of gravity, moment of inertia, and/or an overall feel of the golf club head for an individual using the golf club head 100. The apparatus, methods, and articles of manufacture described herein are not limited in this regard.

Figure 4:
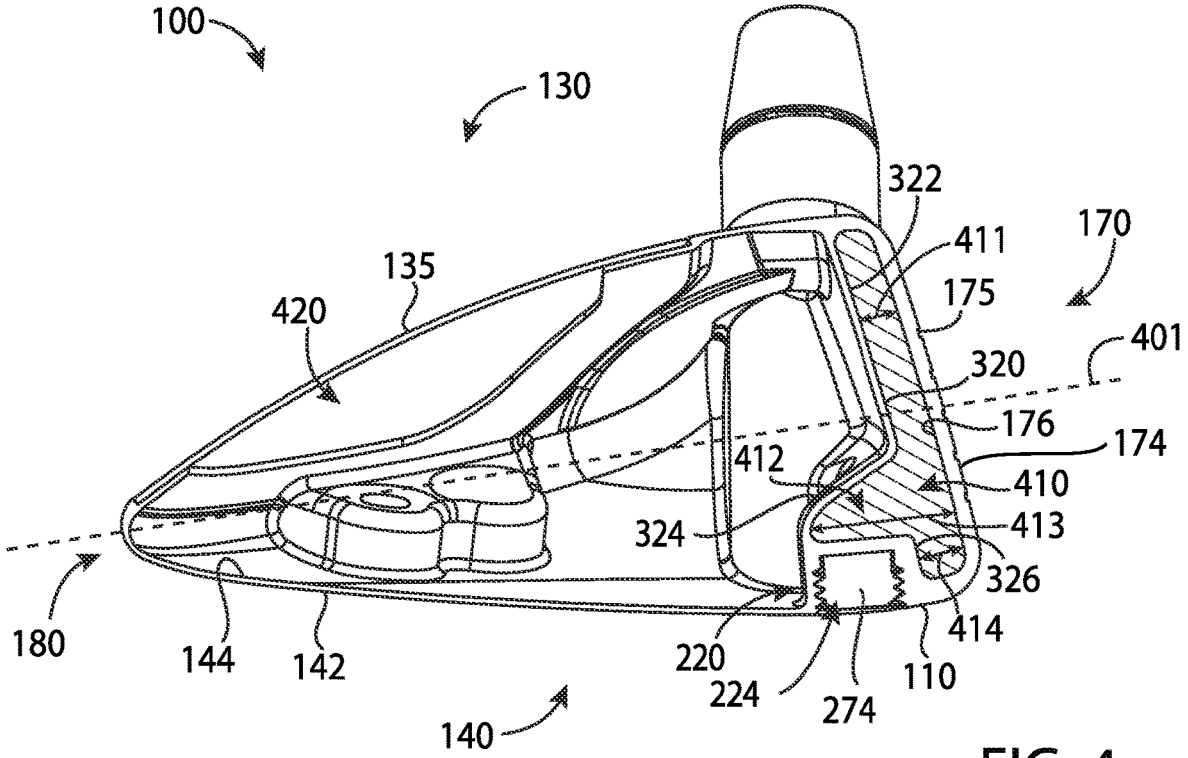

Certain regions of the interior of the body portion 110 may include a polymer material, which may also be referred to herein as the filler material, similar to any of the polymer materials described herein or described in any of the incorporated by reference applications. The filler material may dampen vibration, dampen noise, lower the center of gravity and/or provide a better feel and sound for the golf club head 100 when striking a golf ball (not shown). The golf club head 100, may have one or more interior regions and/or cavities that may include a filler material similar to any of the golf club heads described herein or described in any of the incorporated by reference applications. In one example, as shown in FIG. 4, the body portion 110 may include a cavity wall portion 320. The cavity wall portion 320 may form a first interior cavity portion 410 and a second interior cavity portion 420 within the body portion 110. The first interior cavity portion 410 and the second interior cavity portion 420 may be separated by the cavity wall portion 320. Alternatively, the first interior cavity portion 410 and the second interior cavity portion 420 may be connected through one or more openings in the cavity wall portion 320. The apparatus, methods, and articles of manufacture described herein are not limited in this regard.

As illustrated in FIG. 4, the cavity wall portion 320 may include a first portion 322 extending from a location at or proximate to the top portion 130 toward the bottom portion 140. The first portion 322 may extend toward the bottom portion 140 at a certain angle or orientation relative to the face portion 175. In one example, the first portion 322 may extend toward the bottom portion 140 and away from the face portion 175. Accordingly, a first width 411 ($W_{C1}$) of the first interior cavity portion 410 may increase in a direction from the top portion 130 to the bottom portion 140. In another example, the first portion 322 may extend toward the bottom portion 140 and toward the face portion 175. Accordingly, the first width 411 of the first interior cavity portion 410 may decrease in a direction from the top portion 130 to the bottom portion 140. In the illustrated example of FIG. 4, the first portion 322 of the of the cavity wall portion 320 may extend from a location at or proximate to the top portion 130 generally parallel or substantially parallel with the face portion 175. Accordingly, the first width 411 of the first interior cavity portion 410 may be constant or substantially constant. The apparatus, methods, and articles of manufacture described herein are not limited in this regard.

The first interior cavity portion 410 may include an enlarged cavity portion 412 between the top portion 130 and the bottom portion 140. As shown in the illustrated example of FIG. 4, the enlarged cavity portion 412 extends partially or fully over the second port region 220. Accordingly, the enlarged cavity portion 412 may have a second width 413 ($W_{C2}$) of the first interior cavity portion 410 that may be greater than the first width 411 of the first interior cavity portion 410. The second width 413 may be about two times greater than the first width 411. The second width 413 may be at least two times greater than the first width 411. The enlarged cavity portion 412 may be located at least partially below the neutral axis 401 of the golf club head 100. The enlarged cavity portion 412 may be located wholly below a neutral axis 401 of the golf club head 100. The first width 411 may be located above the neutral axis 401. The second width 413 may be located below the neutral axis 401. The enlarged cavity portion 412 may be defined by a second wall portion 324 that may extend from the first wall portion 322 toward the rear portion 180 and the bottom portion 140 and traverse back over the second port region 220. The first interior cavity portion 410 may include a third wall portion 326 that extends from the second wall portion 324 to a location at or proximate to the bottom portion 140. The first interior cavity portion 410 may have a third width 414 ($W_{C3}$) extending from the third wall portion 326 to the back surface 176 of the face portion 175. The third width 414 may be located below the enlarged cavity portion 412. The third width 414 may be located below the second width 413. The third width 414 may be less than the second width 413. The third width 414 may be substantially equal to the first width 411. As shown in the illustrated example of FIG. 4, the third width 414 may be located between the second port region 220 and the face portion 175. The third width 414 may be located proximate to the bottom portion. In another example, the first width 411 may be similar to the second width 413 of the first interior cavity portion 410 (not shown). Accordingly, the first wall portion 322 of the cavity wall portion 320 may located farther back toward the rear portion 180 than the location of the first wall portion 322 shown in FIG. 4 such that the portion of the first interior cavity portion 410 above the second port region 220 extends over the one or more ports of the second port region 220. In other examples, the first interior cavity portion 410 may be configured similar any of the interior cavities described herein and shown in FIGS. 5-13. The apparatus, methods, and articles of manufacture described herein are not limited in this regard.

In one example, the first interior cavity portion 410 may be unfilled (i.e., empty space). Alternatively, the first interior cavity portion 410 may be partially (i.e., less than 100% filled) or entirely filled with a filler material (i.e., a cavity filling portion) to absorb shock, isolate vibration, dampen noised, and/or provide structural support for the face portion. For example, at least 50% of the first interior cavity portion 410 may be filled with a TPE material to absorb shock, isolate vibration, and/or dampen noise when the golf club head 100 strikes a golf ball via the face portion 175. In one example, the first interior cavity portion 410 may be partially or entirely filled with a filler material through a port (e.g., port 224) located in the bottom portion 140. In one example, as shown in FIG. 4, the port 224 may include an opening that accesses the first interior cavity portion 410. The opening may provide a fluid pathway for filler material to be introduced to the first interior cavity portion 410. The apparatus, methods, and articles of manufacture described herein are not limited in this regard.

When the face portion 175 of the golf club head 100 strikes a golf ball, the face portion 175 and the filler material may deform and/or compress. The kinetic energy of the impact may be transferred to the face portion 175 and/or the filler material. For example, some of the kinetic energy may be transformed into heat by the filler material or work done in deforming and/or compressing the filler material. Further, some of the kinetic energy may be transferred back to the golf ball to launch the golf ball at a certain velocity. A filler material with a relatively higher COR may transfer relatively more kinetic energy to the golf ball and dissipate relatively less kinetic energy. Accordingly, a filler material with a relatively high COR may generate relatively higher golf ball speeds because a relatively greater part of the kinetic energy of the impact may be transferred back to the golf ball to launch the golf ball from the golf club head 100. The apparatus, methods, and articles of manufacture described herein are not limited in this regard.

With the support of the cavity wall portion 320 to form the first interior cavity portion 410 and filling at least a portion of the first interior cavity portion 410 with a filler material, the face portion 175 may be relatively thin without degrading the structural integrity, sound, and/or feel of the golf club head 100. In one example, the face portion 175 may have a thickness of less than or equal to 0.075 inch (e.g., a distance between a front surface 174 and the back surface 176). In another example, the face portion 175 may have a thickness of less than or equal to 0.2 inch. In another example, the face portion 175 may have a thickness of less than or equal to 0.06 inch. In yet another example, the face portion 175 may have a thickness of less than or equal to 0.05 inch. Further, the face portion 175 may have a thickness of less than or equal to 0.03 inch. In yet another example, a thickness of the face portion 175 may be greater than or equal to 0.03 inch and less than or equal to 0.2 inch. The apparatus, methods, and articles of manufacture described herein are not limited in this regard.

In the illustrated example of FIGS. 1-4, the second interior cavity portion 420 may be unfilled (i.e., empty space). Alternatively (not shown), the second interior cavity portion 420 may be partially or entirely filled with a filler material (i.e., a cavity filling portion), which may include one or more similar or different types of materials described herein and may be different or similar to the filler material used to fill the first interior cavity portion 410. The apparatus, methods, and articles of manufacture described herein are not limited in this regard.

Figure 5:
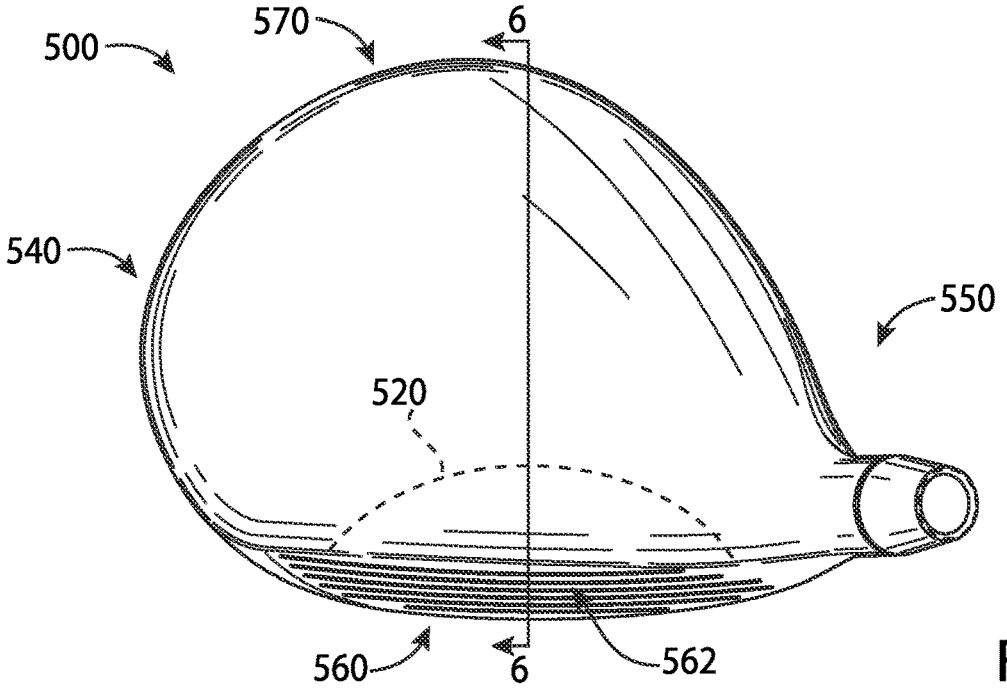
FIGS. 5, 6, and 7 depict a top view, a schematic cross-sectional view (along line 6-6 of FIG. 5), and a front view, respectively, of a golf club head according to another embodiment of the apparatus, methods, and articles of manufacture described herein.
Figure 6:
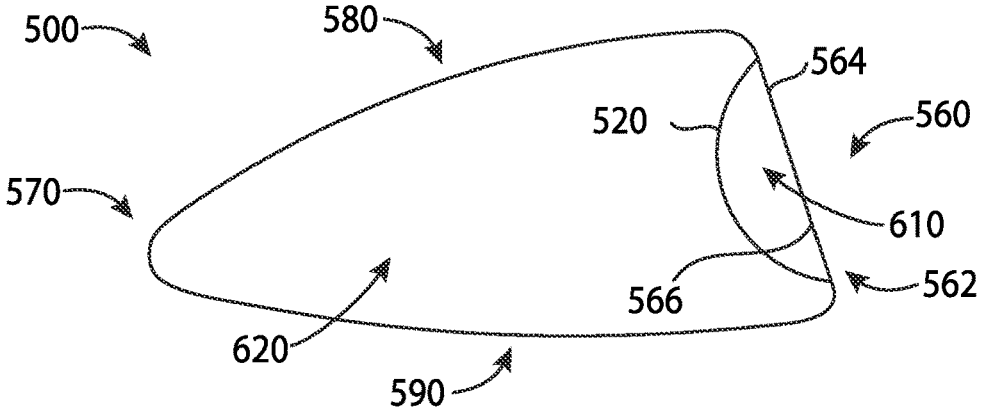
Figure 7:
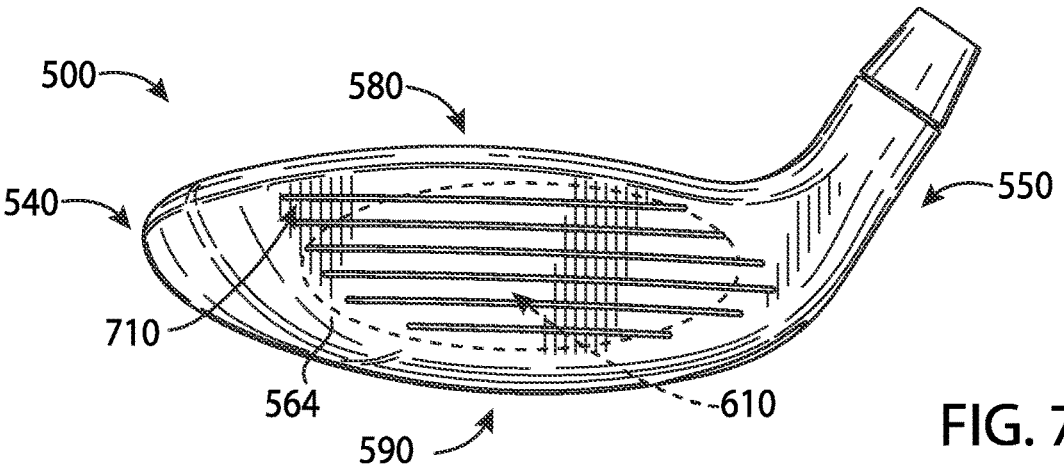

While each of the examples herein may describe a certain type of golf club head, the apparatus, methods, and articles of manufacture described herein may be applicable to other types of golf club heads. Referring to FIGS. 5-7, for example, a golf club head 500 may include a body portion 510 and a cavity wall portion 520. Although FIGS. 5-7 may depict a particular type of club head (e.g., a fairway wood-type club head), the apparatus, methods, and articles of manufacture described herein may be applicable to other types of club head (e.g., a driver-type club head, a hybrid-type club head, an iron-type club head, a putter-type club head, etc.). The apparatus, methods, and articles of manufacture described herein are not limited in this regard.

The body portion 510 may include a toe portion 540, a heel portion 550, a front portion 560, a rear portion 570, a top portion 580 (e.g., a crown portion), and a bottom portion 590 (e.g., a sole portion). The front portion 560 may include a face portion 562 (e.g., a strike face). The face portion 562 may include a front surface 564 and a back surface 566. The front surface 564 may include a plurality of grooves, generally shown as 710 in FIG. 7. The cavity wall portion 520 may form a first interior cavity portion 610 and a second interior cavity portion 620 within the body portion 510. As illustrated in FIG. 6, for example, the cavity wall portion 520 may extend from the back surface 566 of the face portion 562. The cavity wall portion 520 may be a single curved wall section. In particular, the cavity wall portion 520 may have a convex arc profile relative to the back surface 566 (e.g., C shape) to form a dome-like structure with an elliptical base (e.g., FIG. 7) or a circular base on the back surface 566. In another example, the cavity wall portion 520 may form a cone-like structure or a cylinder-like structure with the body portion 510. Alternatively, the cavity wall portion 520 may be a concave arc profile relative to the back surface 566. The apparatus, methods, and articles of manufacture described herein are not limited in this regard.

The first interior cavity portion 610 may be partially or entirely filled with a suitable filler material such as any of the filler materials described herein or described in any of the incorporated by reference applications to absorb shock, isolate vibration, dampen noise, and/or provide structural support. The elastic polymer material may be injected into the first interior cavity portion 610 via an injection molding process via a port on the face portion 562. With the support of the cavity wall portion 520 to form the first interior cavity portion 610 and filling at least a portion of the first interior cavity portion 610 with an elastic polymer material, the face portion 562 may be relatively thin without degrading the structural integrity, sound, and/or feel of the golf club head 500. The apparatus, methods, and articles of manufacture described herein are not limited in this regard.

Figure 8:
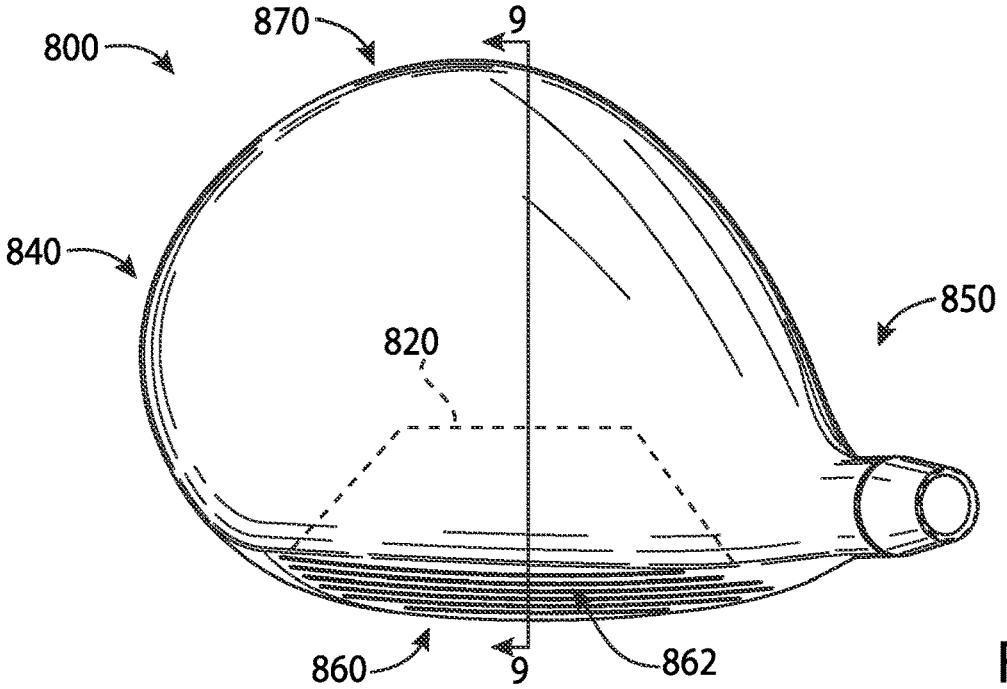
FIGS. 8, 9, and 10 depict a top view, a schematic cross-sectional view (along line 9-9 of FIG. 8), and a front view, respectively, of a golf club head according to another embodiment of the apparatus, methods, and articles of manufacture described herein.
Figure 9:
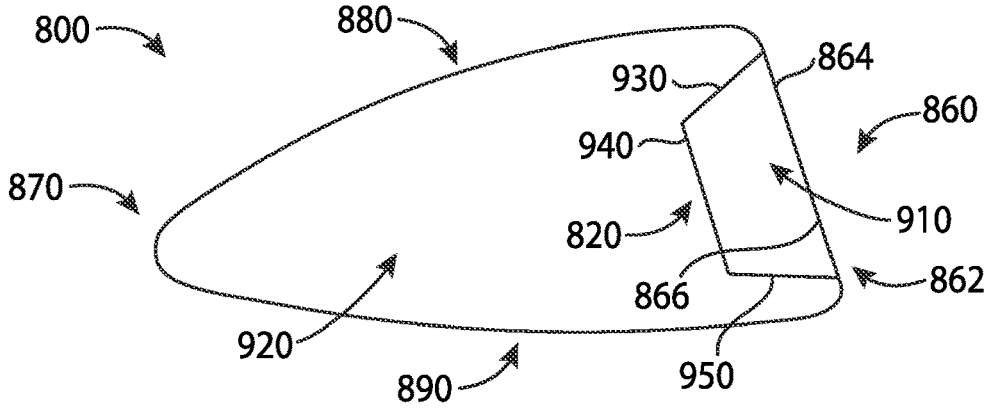
Figure 10:
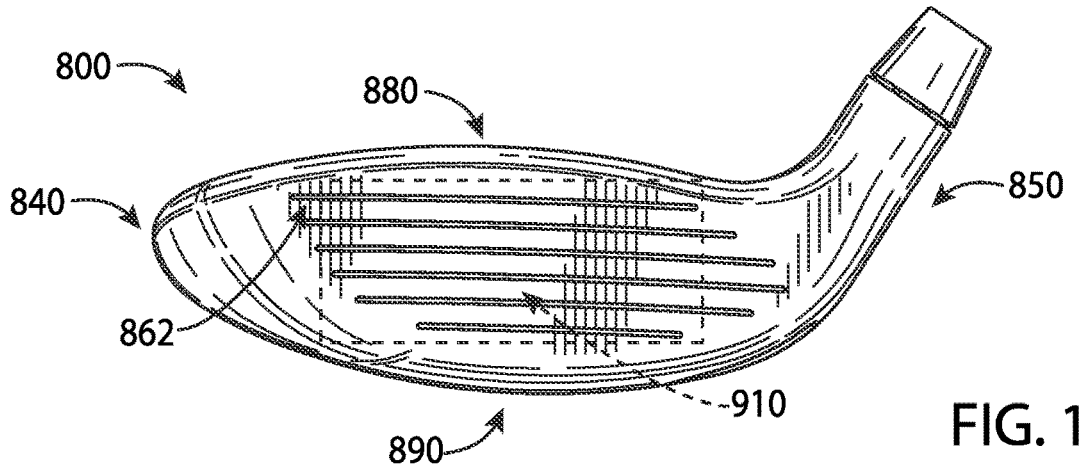

The cavity wall portion 520 may include multiple sections. Turning to FIGS. 8-10, for example, a golf club head 800 may include a body portion 810 and a cavity wall portion 820. The body portion 810 may include a toe portion 840, a heel portion 850, a front portion 860, a rear portion 870, a top portion 880 (e.g., a crown portion), and a bottom portion 890 (e.g., a sole portion). The front portion 860 may include a face portion 862 (e.g., a strike face) with a front surface 864 and a back surface 866. The cavity wall portion 820 may extend from the back surface 866 to form a first interior cavity portion 910 and a second interior cavity portion 920 within the body portion 810. The cavity wall portion 820 may include two or more wall sections, generally shown as 930, 940, and 950 in FIG. 9. Similar to the first interior cavity portion 610 (FIGS. 5-7), the first interior cavity portion 910 may be partially or entirely filled with a filler material. The filler material may be injected into the first interior cavity portion 910 via an injection molding process via a port on the face portion 862. The apparatus, methods, and articles of manufacture described herein are not limited in this regard.

Figure 11:
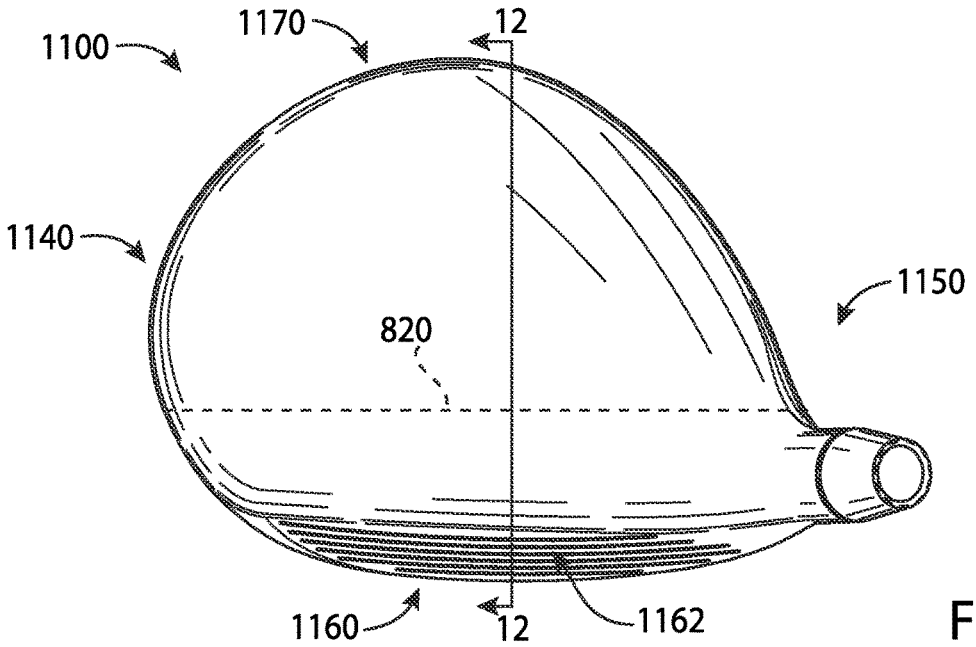
FIGS. 11, 12, and 13 depict a top view, a schematic cross-sectional view (along line 12-12 of FIG. 11), and another schematic cross-sectional view (along line 12-12 of FIG. 11), respectively, of a golf club head according to yet another embodiment of the apparatus, methods, and articles of manufacture described herein.
Figure 12:
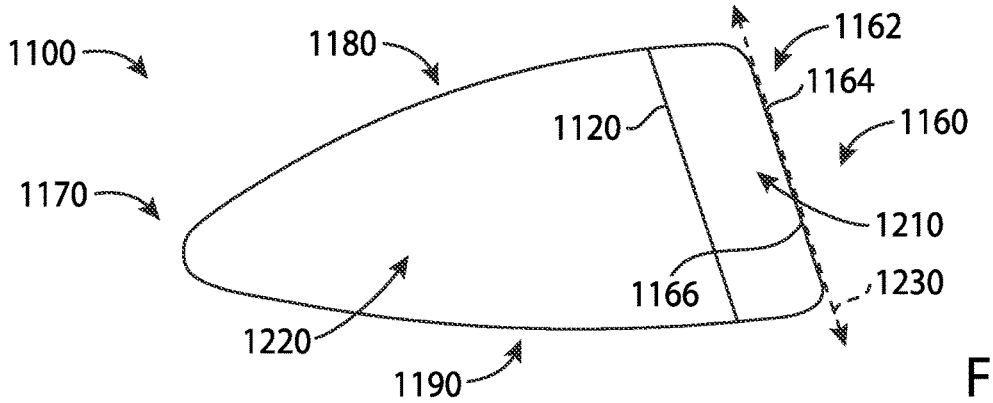
Figure 13:
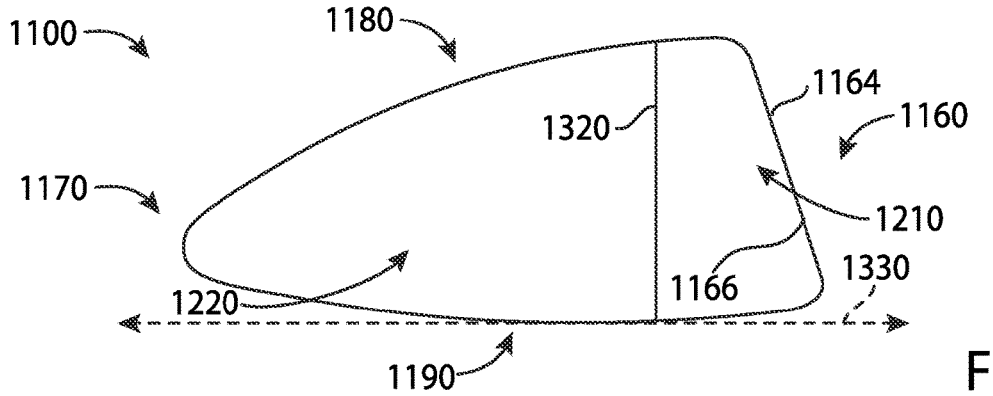

As illustrated in FIGS. 11 and 12, for example, a golf club head 1100 may include a body portion 1110 and a cavity wall portion 1120. The body portion 1110 may include a toe portion 1140, a heel portion 1150, a front portion 1160, a rear portion 1170, a top portion 1180 (e.g., a crown portion), and a bottom portion 1190 (e.g., a sole portion). The front portion 1160 may include a face portion 1162 (e.g., a strike face) with a front surface 1164 and a back surface 1166. The face portion 1162 may be associated with a loft plane 1230 that defines the loft angle of the golf club head 1100. The cavity wall portion 1120 may be a single flat wall section. In particular, the cavity wall portion 1120 may extend between the toe portion 1140 and the heel portion 1150 and between the top portion 1180 and the bottom portion 1190 to form a first interior cavity portion 1210 and a second interior cavity portion 1220 within the body portion 1110. The cavity wall portion 1120 may be parallel or substantially parallel to the loft plane 1230. Alternatively, as shown in FIG. 13, a cavity wall portion 1320 may be perpendicular or substantially perpendicular to a ground plane 1330. Similar to the interior cavity 610 portion (FIGS. 5-7) and interior cavity 910 portion (FIGS. 8-10), the first interior cavity portion 1210 may be partially or entirely filled with an elastic polymer or elastomer material. The elastic polymer material may be injected into the first interior cavity portion 1210 via an injection molding process via a port on the face portion 1162 and/or the bottom portion 1190 as described herein or described in any of the incorporated by reference applications. The apparatus, methods, and articles of manufacture described herein are not limited in this regard.

Alternatively, the cavity wall portion 1120 may extend between the bottom portion 1190 and a top-and-front transition region (i.e., a transition region between the top portion 1180 and the front portion 1160) so that the cavity wall portion 1120 and the loft plane 1230 may not be parallel to each other. In another example, the cavity wall portion 1120 may extend between the top portion 1180 and a bottom-and-front transition region (i.e., a transition region between the bottom portion 1190 and the front portion 1160) so that the cavity wall portion 1120 and the loft plane 1230 may be not parallel to each other. Although FIGS. 11-13, may depict the cavity wall portions 1120 and 1320 being flat or substantially flat, the cavity wall portions 1120 and/or 1320 may be concave or convex relative to the face portion 1162. The apparatus, methods, and articles of manufacture described herein are not limited in this regard.

In the example of FIGS. 14-24, a golf club head 1400 may include a body portion 1410 having a toe portion 1440, a heel portion 1450 that may include a hosel portion 1455 configured to receive a shaft (not shown) with a grip (not shown) on one end and the golf club head 1400 on the opposite end of the shaft to form a golf club, a front portion 1460 with a perimeter edge portion 1461, a back portion 1470, a top portion 1480, and a sole portion 1490. The toe portion 1440, the heel portion 1450, the front portion 1460, the back portion 1470, the top portion 1480, and/or the sole portion 1490 may partially overlap each other. The golf club head 1400 may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees)(°, 48°, 52°, 56°, 60°, etc.). Although FIGS. 14-24 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The material of construction of the golf club head 1400 and/or any components thereof may be similar to any materials described herein or in any of the incorporated by reference applications for constructing a golf club heads. The apparatus, methods, and articles of manufacture described herein are not limited in this regard.

The golf club head 1400 may include a face portion 1462 (i.e., the strike face), which may be integrally formed with the body portion 1410 (e.g., a single unitary piece). In one example, as shown in FIGS. 14-24, the face portion 1462 may be a separate piece coupled (e.g., adhesively, mechanically, by welding or soldering) to the body portion 1410. The face portion 1462 may include a front surface 1464 and a back surface 1466. In one example (not shown), the front portion 1460 may include one or a plurality of recessed shoulders configured to receive the face portion 1462 for attachment of the face portion 1462 to the body portion 1410. In another example, as shown in FIGS. 14-24, the back surface 1466 may include a perimeter portion 1467 that may be attached to the perimeter edge portion 1461 of the body portion 1410 to attach the face portion 1462 to the body portion 1410. The perimeter edge portion 1461 of the body portion 1410 and the perimeter portion 1467 of the face portion 1462 may be attached by one or more fasteners, one or move adhesive or bonding agents, and/or welding or soldering. In one example, as shown in FIGS. 14-24, the perimeter portion 1467 of the face portion 1462 may be welded to the perimeter edge portion 1461 of the body portion 1410 at one or more locations. Alternatively, the entire perimeter portion 1467 of the face portion 1462 may be welded to the entire perimeter edge portion 1461 of the body portion 1410 (i.e., a continuous weld). The face portion 1462 may include a ball strike region 1468 to strike a golf ball. In one example, the center of the ball strike region 1468 may be a geometric center 1463 of the face portion 1462. In another example, the geometric center 1463 of the face portion 1462 may be offset from a center of the ball strike region 1468. In one example, the geometric center 1443 and one or more regions near and/or surrounding the geometric center within the ball strike region 1468 may provide a generally optimum location (i.e., optimum ball distance, ball speed, ball spin characteristics, etc.) on the face portion 1462 for striking a golf ball. In yet another example, any location at or near the geometric center 1463 and within the ball strike region 1468 may provide a generally optimum location on the face portion 1462 for striking a golf ball. However, a ball may be struck with any portion of the face portion 1462 within the ball strike region 1468 or outside the ball strike region 1468 for any of the golf club heads described herein resulting in certain ball flight characteristics different from an on-center hit that may be preferred by an individual. The configuration of the face portion 1462 and the attachment of the face portion 1462 (e.g., welding) to the body portion 1410 may be similar in many respects to the golf club heads described in any of the incorporated by reference applications. The apparatus, methods, and articles of manufacture described herein are not limited in this regard.

The golf club head 1400 may be associated with a ground plane 2310, a horizontal midplane 2320, and a top plane 2330. In particular, the ground plane 2310 may be a plane that is parallel or substantially parallel to the ground and is tangent to the lowermost edge of the sole portion 1490 when the golf club head 1400 is at an address position (e.g., the golf club head 1400 aligned to strike a golf ball). A top plane 2330 may be a plane that is tangent to the uppermost edge of the top portion 1480 when the golf club head 1400 is at the address position. The ground and top planes 2310 and 2330, respectively, may be parallel or substantially parallel to each other. The horizontal midplane 2320 may be vertically halfway between the ground and top planes 2310 and 2330, respectively. Further, the golf club head 1400 may be associated with a loft plane 2340 defining a loft angle 2345 (*a*) of the golf club head 1400. The loft plane 2340 may be a tangential plane to the face portion 1462. The loft angle 2345 may be defined by the loft plane 2340 and a vertical plane 2350 normal to the ground plane 2310.

The body portion 1410 may be a hollow body including an interior cavity 1510 having inner walls 1512. The interior cavity 1510 may extend between the front portion 1460, the back portion 1470, the top portion 1480, and the sole portion 1490. In the example of FIGS. 14-24, the interior cavity 1510 of the body portion 1410 may be enclosed with and partially defined with the face portion 1462. The configuration of the interior cavity 1510 (e.g., height, width, volume, shape, etc.), the configuration of the interior cavity 1510 relative to the body portion 1410 (e.g., volume of the interior cavity 1510 relative to the volume of body portion 1410), the width and height variation, and access to the interior cavity 1510 from one or more ports on the body portion 1410 may be similar to the golf club heads described in any of the incorporated by reference applications. The apparatus, methods, and articles of manufacture described herein are not limited in this regard.

Figure 14:
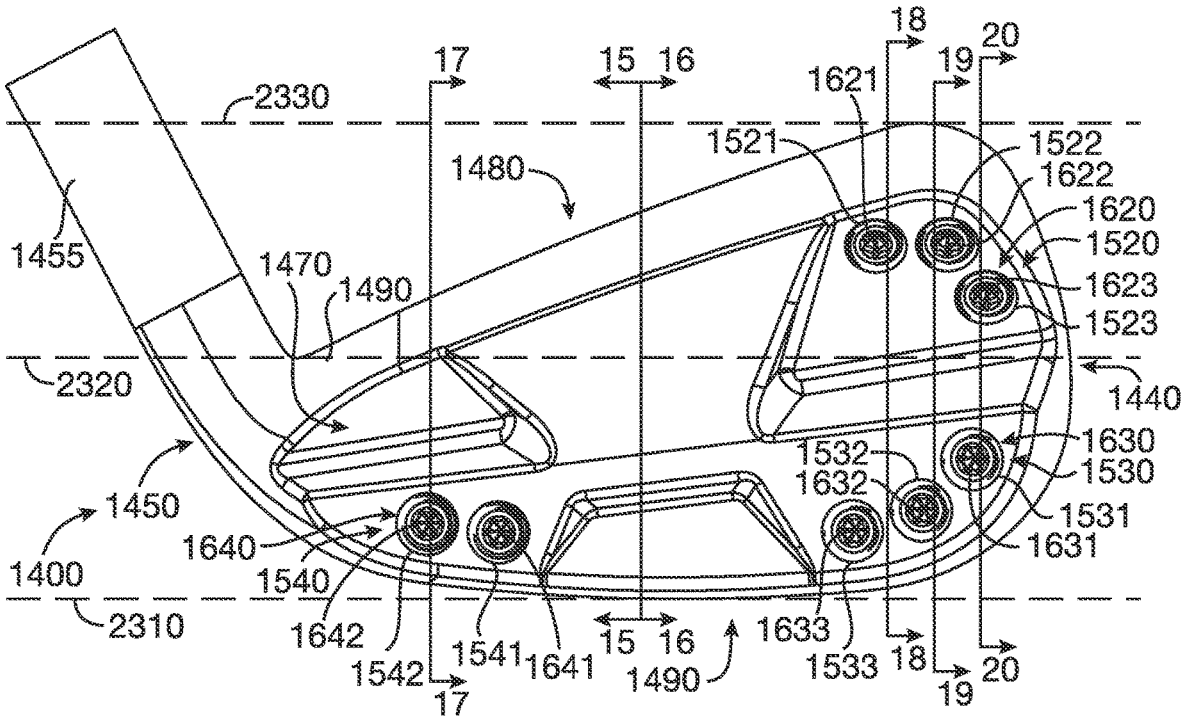
FIGS. 14, 15, 16, 17, 18, 19, 20, 21, 22, 23, and 24 depict a perspective back view, a perspective cross-sectional view (along line 15-15 of FIG. 14), a perspective cross-sectional view (taken at line 16-16 of FIG. 14), a perspective cross-sectional view (along line 17-17 of FIG. 14), a perspective cross-sectional view (along line 18-18 of FIG. 14), a perspective cross-sectional view (along line 19-19 of FIG. 14), a perspective cross-sectional view (along line 20-20 of FIG. 14), another perspective cross-sectional view (along line 15-15 of FIG. 14), another perspective cross-sectional view (along line 19-19 of FIG. 14), a front perspective view of the golf club head of FIG. 14 shown without a face portion, and a back side of a face portion for the golf club head of FIG. 14, respectively, of a golf club head according to an embodiment of the apparatus, methods, and articles of manufacture described herein.

Further, the body portion 1410 may include one or more ports, which may be exterior ports and/or interior ports (e.g., located inside the body portion 1410). The inner walls 1512 of the interior cavity 1510 may include one or more ports. In one example, as shown in FIG. 14, the back portion 1470 may include one or more ports along or proximate to a periphery of the body portion 1410. For example, the body portion 1410 may include a first set of ports 1520 (e.g., shown as ports 1521, 1522, and 1523), a second set of ports 1530 (e.g., shown as ports 1531, 1532, and 1533), and a third set of ports 1540 (e.g., shown as ports 1541 and 1542). The locations, spacing relative to other ports, and any other configuration of each port of the first set of ports 1520, the second set of ports 1530, and/or the third set of ports 1540 may be similar in many respects to any of the ports described herein or described in any of the incorporated by reference applications. Further, any one or more of the ports of the first set of ports 1520, the second set of ports 1530, and/or the third set of ports 1540 may be connected to interior cavity 1510 through which one or more filler materials may be injected into the interior cavity 1510. In the example of FIGS. 14-24, the port 1542 may be connected to the interior cavity 1510 via an opening 1543. The apparatus, methods, and articles of manufacture described herein are not limited in this regard.

Each port of the first set of ports 1520 may be separated by a distance less than the port diameter of any of the ports of the first set of ports 1520. Each port of the second set of ports 1530 may be separated by a distance less than the port diameter of any of the ports of the second set of ports 1530. Each port of the third set of ports third set of ports 1540 may be separated by a distance less than the port diameter of any of the ports of the third set of ports 1540. The first set of ports 1520 and the second set of ports 1530 may be spaced apart by a distance substantially greater than the port diameter of any of the ports of the first set of ports 1520 and the second set of ports 1530. In one example, the second set of ports 1530 and the third set of ports 1540 may be spaced apart by a distance less than the port diameter of any of the ports of the second set of ports 1530 and the third set of ports 1540. In another example, as shown in FIG. 14, the second set of ports 1530 and the third set of ports 1540 may be spaced apart by a distance substantially greater than the port diameter of any of the ports of the second set of ports 1530 and the third set of ports 1540. In one example, the portion of the body portion 1410 between the second set of ports 1530 and the third set of ports 1540 may generally correspond or be aligned with the ball strike region 1468 and may be devoid of any ports. In another example (not shown), the second set of ports 1530 and the third set of ports 1540 may extend continuously and with generally equal port spacing from the toe portion 1440 to the heel portion 1450. The apparatus, methods, and articles of manufacture described herein are not limited in this regard.

Although the figures may depict the ports as separate and individual parts, each set of the first, second, and third sets of ports 1520, 1530, and 1540, respectively, may be a single port. In one example, all of the first set of ports 1520 (e.g., shown as 1521, 1522, and 1523) may be combined into a single port (e.g., a first port). In another example, all of the second set of ports 1530 (e.g., shown as 1531, 1532, and 1533) may be combined into a single port (e.g., a second port). In yet another example, all of the third set of ports 1540 (e.g., shown as 1541 and 1542) may be combined into a single port (e.g., a third port). While the figures may depict a particular number of ports, the apparatus, methods, and articles of manufacture described herein may include more or a smaller number of ports.

The body portion 1410 may include one or more mass portions (e.g., weight portion(s)), which may be integral mass portion(s) or separate mass portion(s) that may be coupled to the body portion 1410. In the illustrated example as shown in FIG. 14, the body portion 1410 may include a first set of mass portions 1620 (e.g., shown as mass portions 1621, 1622, and 1623), a second set of mass portions 1630 (e.g., shown as mass portions 1631, 1632, and 1633), and a third set of mass portions 1640 (e.g., shown as mass portions 1641 and 1642). While the above example may describe a particular number or portions of mass portions, a set of mass portions may include a single mass portion, or a plurality of mass portions as described in any of the incorporated by reference applications. For example, the first set of mass portions 1620 may be a single mass portion (e.g., mass portions 1631, 1632, and 1633 may be a single mass portion referred to as a first mass portion). In a similar manner, the second set of mass portions 1630 and/or the third set of mass portions 1640 may be a single mass portion. Further, the first set of mass portions 1620, the second set of mass portions 1630, and/or the third set of mass portions 1640 may be a portion of the physical structure of the body portion 1410. The mass portions of the first set of mass portions 1620, the second set of mass portions 1630, and/or third set of mass portions 1640 may be similar to any of the mass portions described herein or in any of the incorporated by reference applications. The apparatus, methods, and articles of manufacture described herein are not limited in this regard.

The body portion 1410 may be made of a first material whereas the mass portions of the first set of mass portions 1620, the second set of mass portions 1630, and/or the third set of mass portions 1640 may be made of a second material. The mass portions of the first set of mass portions 1620, the second set of mass portions 1630, and/or the mass portions of the third set mass portions 1640 may be similar or different materials. The materials of the body portion 1410 and any of the mass portions of the first set of mass portions 1620, the second set of mass portions 1630, and/or the third set mass portions 1640 may be similar to the materials of the body portion and any of the mass portions, respectively, described in any of the incorporated by reference applications. The apparatus, methods, and articles of manufacture described herein are not limited in this regard.

The interior cavity 1510 may be partially or entirely filled with one or more filler materials (i.e., a cavity filling material), which may include one or more similar or different types of materials. In one example, as shown in FIGS. 14-24, the interior cavity 1510 may be filled with a first filler material 1712 and a second filler material 1714. The first filler material 1712 may be coupled or attached to the back surface 1466 of the face portion 1462. In one example, the first filler material 1712 may have inherent adhesive or bonding properties to attach to the back surface 1466 of the face portion 1462. In another example, the first filler material 1712 may be attached to the back surface 1466 of the face portion 1462 with one or more bonding agents or adhesives that may be mixed with the first filler material 1712. In another example, the first filler material 1712 may be attached to the back surface 1466 of the face portion 1462 with one or more bonding agents or adhesives that may be separate from the first filler material 1712. In another example, the first filler material 1712 may be maintained in contact with the back surface 1466 of the face portion 1462 with the second filler material 1714 as described herein. In yet another example, the first filler material 1712 may be both bonded to the back surface 1466 of the face portion 1462 as described herein and maintained in contact with the back surface 1466 of the face portion 1462 with the second filler material 1714. The first filler material 1712 and/or the second filler material 1714 may be similar to the filler materials described in any of the incorporated by reference applications. The apparatus, methods, and articles of manufacture described herein are not limited in this regard.

The first filler material 1712 may be coupled to at least a portion of the back surface 1466 of the face portion 1462 that corresponds to the ball strike region 1468 of the face portion 1462. The first filler material 1712 may be coupled to regions of the back surface 1466 of the face portion 1462 that are beyond the ball strike region 1468. The first filler material 1712 may be coupled to one or more portions the back surface 1466 of the face portion 1462 that is greater than or equal to 10% and less than or equal to 100% of the area back surface 1466 of the face portion 1462 that is exposed to the interior cavity 1510. The amount of the first filler material 1712 that may be coupled to the back surface 1466 of the face portion 1462 may depend upon the loft angle of the golf club head, the overall thickness of the face portion 1462, the thickness profile of the face portion 1462, the shape of the interior cavity 1510, the locations and configurations of any ports of mass portions, the material properties of the first filler material 1712, and/or the material properties of the second filler material 1714. In one example, a relatively large portion of the back surface 1466 of the face portion 1462 may be coupled to the first filler material 1712 for a relatively thin face portion 1462 so that the first filler material 1712 provides sufficient structural support for the face portion 1462. In another example, a golf club head with a relatively higher loft angle may limit the portions of the back surface 1466 of the face portion 1462 to which the first filler material 1712 may be coupled. In yet another example, the acoustic properties of the golf club head may be a factor in determining the amount of filler material 1712 that may be coupled to the back surface 1466 of the face portion to provide a pleasing sound and feel to an individual. The amount of the first filler material 1712 coupled to the back surface 1466 of the face portion 1462 may (i) provide vibration dampening or sound dampening (e.g., consistent and/or pleasing sound and feel when the golf club head 1400 strikes a golf ball as perceived by an individual using the golf club head 1400), (ii) provide structural support for the face portion 1462, and/or (iii) optimize ball travel distance, ball speed, ball launch angle, ball spin rate, ball peak height, ball landing angle and/or ball dispersion. The apparatus, methods, and articles of manufacture described herein are not limited in this regard.

A width 1722 ($W_{F1}$) of the first filler material 1712 may vary from the toe portion 1440 to the heel portion 1450 and/or from the top portion 1480 to the sole portion 1490. The width 1722 of the first filler material 1712 may be constant or substantially constant from the toe portion 1440 to the heel portion 1450 and/or from the top portion 1480 to the sole portion 1490. The width 1722 of the first filler material 1712 may be constant or substantially constant at one or more locations in the interior cavity 1510 and vary at certain other locations in the interior cavity 1510. In one example, as shown in FIGS. 14-24, the width 1722 of the first filler material 1712 may vary at one or more locations in the interior cavity 1510 similar or substantially similar to the contour of all or portions of the inner walls 1512 of the interior cavity 1510 (i.e., similar or substantially similar to the shape of the inner walls 1512 of the interior cavity 1510). Accordingly, the amount of the first filler material 1712 in the interior cavity 1510 and/or coupled to the face portion 1462 may be maximized while maintaining a certain gap as further described herein between the first filler material 1712 and the inner walls 1512 of the interior cavity 1510. In another example, the first filler material 1712 at and/or around the ball strike region 1468 of the face portion 1462 may have a relatively large width 1722 to (i) provide vibration dampening or sound dampening (e.g., consistent and/or pleasing sound and feel when the golf club head 1400 strikes a golf ball as perceived by an individual using the golf club head 1400), (ii) provide structural support for the face portion 1462, and/or (iii) optimize ball travel distance, ball speed, ball launch angle, ball spin rate, ball peak height, ball landing angle and/or ball dispersion. The width 1722 of the first filler material 1712 may be determined at the ball strike region 1468 and/or other regions of the interior cavity 1510 so that a relatively high or optimum coefficient of restitution (COR) is provided for the golf club head 1400. The apparatus, methods, and articles of manufacture described herein are not limited in this regard.

In one example, as shown in FIGS. 14-24, a distance between the first filler material 1712 and the inner walls 1512 of the interior cavity 1510 may define a gap 1724. The size of the gap 1724 may be constant or may vary in the interior cavity 1510 similar or substantially similar to the shape of the first filler material 1712, the shape of the inner walls 1512 of the interior cavity 1510, the locations of one or more ports that may be connected to the interior cavity 1510, the locations of one or more integral and/or removable mass portions, and/or other factors as described herein. At certain locations in the interior cavity 1510, the size of the gap 1724 may be as small as possible yet provide sufficient space to accommodate the second filler material 1714 between the first filler material 1712 and the inner walls 1512 of the interior cavity 1510. In one example, the gap may be a result of manufacturing the golf club head with the first filler material 1712 and the second filler material 1714.

In one example, the gap 1724 may be greater than or equal to 0.001 inch (0.003 cm) and less than or equal to 0.2 inch (0.508 cm). In another example, the gap 1724 may be greater than or equal to 0.007 inch (0.18 cm) and less than or equal to 0.1 inch (0.384 cm). In another example, the gap 1724 may be greater than or equal to 0.015 inch (0.038 cm) and less than or equal to 0.05 inch (0.127 cm). In yet another example, the gap 1724 may be greater than or equal to 0.003 inch (0.008 cm) and less than or equal to 0.38 inch (0.635 cm). The apparatus, methods, and articles of manufacture described herein are not limited in this regard.

As described herein, the width 1722 of the first filler material 1712 may vary similar or substantially similar to the shape of the inner walls 1512 of the interior cavity 1510. Accordingly, in one example, the variation in the width of the gap 1724 (Wg) may be expressed by the following equation:

$$1 \leq \frac{Wg_{max}}{Wg_{min}} \leq Rg \tag{1}$$

where:

$Wg_{max}$ is the maximum Wg, $Wg_{min}$ is the minimum Wg, and $1<Rg\leq 5$

In one example, $R_g$ may be 2 or less as the width 1722 of the first filler material 1712 varies similar or substantially similar to the shape of the inner walls 1512 of the interior cavity 1510. In another example, $R_g$ may be 3 or less. Accordingly, the maximum width of the gap 1724 ($Wg_{max}$) may be no more than three times the minimum width of the gap 1724 ($Wg_{min}$). In yet another example, $R_g$ may be 4 or less. Accordingly, the maximum width of the gap 1724 ($Wg_{max}$) may be no more than four times the minimum width of the gap 1724 ($Wg_{min}$). The variation in the gap 1724 may be small such that the shape of the first filler material 1712 may vary similar or substantially similar to the contour of the inner walls 1512 of the interior cavity 1510 (i.e., the shape of the inner walls of the interior cavity 1510). While the above examples may describe particular ratios of $Wg_{min}$), to $Wg_{min}$, the apparatus, methods, and articles of manufacture described herein may include greater ratios of $Wg_{max}$ to $Wg_{min}$. The apparatus, methods, and articles of manufacture described herein are not limited in this regard.

The back surface 1466 of the face portion 1462 may include a perimeter portion 1467, which may be attached to the perimeter edge portion 1461 of the body portion 1410 as described herein. Accordingly, the back surface 1466 of the face portion 1462 may include an inner surface portion 1469 exposed to the interior cavity 1510. The inner surface portion 1469 may also define a boundary of the interior cavity 1510 (i.e., the front boundary of the interior cavity 1510). In one example (not shown), the first filler material 1712 may be coupled the entire inner surface portion 1469 of the face portion 1462. In another example, as shown in FIGS. 14-24, the first filler material 1712 may be coupled to a portion of the inner surface portion 1469 of the face portion 1462. Accordingly, the first filler material 1712 may include a frontal area 1713 attached to the inner surface portion 1469 of the face portion 1462. In one example, a relationship between the frontal area 1713 of the first filler material 1712 (the area of the front surface of the first filler material 1712 attached to the face portion 1462) ($FA_m$) and the area of the inner surface portion 1469 of the face portion 1462 ($BA_f$) may be expressed by the following equation:

$$FA_m = BA_f(A_1\alpha + A_2) \tag{2}$$

where:

$FA_m$ is the frontal area 1713 of the first filler material 1712, $BA_f$ is the area of the inner surface portion 1469 of the face portion 1462, $\alpha$ is the loft angle of the face portion 1462, $-0.003\leq A_1\leq 0.001$, and $0.4\leq A_2\leq 0.85$ The loft angle $\alpha$ as used herein may be associated with the type of iron golf club head such as a 5-iron golf club, a 7-iron golf club, or a wedge-type golf club. For example, a 5-iron golf club head may have a loft angle $\alpha$ of 38°±2°. In another example, a 7-iron golf club head may have a loft angle $\alpha$ of 44°±2°. In yet another example, a wedge-type golf club head may have a loft angle $\alpha$ of 5°±2°. Accordingly, any loft angle expressed herein may vary by ±2° for the same type of iron golf club head. While the above examples may describe particular iron-type golf club heads, the apparatus, methods, and articles of manufacture described herein may include a driver-type golf club head, a fairway-wood-type golf club head, a hybrid-type golf club head, a putter-type golf club head, or other types of golf club heads. Further, although the above examples may describe particular loft angles, the apparatus, methods, and articles of manufacture described herein may include greater or less loft angles. The apparatus, methods, and articles of manufacture described herein are not limited in this regard.

The upper and lower values of the coefficients $A_1$ and $A_2$ may define the upper and lower boundaries of the ratio of the frontal area 1713 of the first filler material 1712 to the area of the inner surface portion 1469 of the face portion 1462. In one example, according to Equation (2) and assuming a value of −0.0018 for the coefficient $A_1$, upper and lower boundaries of a ratio of the frontal area 1713 of the first filler material 1712 to the area of the inner surface portion 1469 of the face portion 1462 for a set of iron-type golf club heads may be determined as shown in Table 1.

TABLE 1

| Iron-Type | $\alpha$ | $(FA_m/BA_f) \leq$ | $(FA_m/BA_f) \geq$ |
|---|---|---|---|
| 3 | 18 | 0.77 | 0.45 |
| 4 | 21 | 0.77 | 0.44 |
| 5 | 23 | 0.76 | 0.44 |
| 6 | 26 | 0.76 | 0.43 |
| 7 | 30 | 0.75 | 0.43 |
| 8 | 34 | 0.74 | 0.42 |
| 9 | 39 | 0.73 | 0.41 |
| Wedge | 44 | 0.72 | 0.40 |
| Gap Wedge | 49 | 0.71 | 0.39 |
| Sand Wedge | 54 | 0.71 | 0.38 |
| Lob Wedge | 59 | 0.70 | 0.38 |

The loft angle of a golf club head may determine the structural configuration of the golf club head. Accordingly, golf club heads with different loft angles may have different internal cavity shapes, port locations, mass portion locations, filler material volumes, different CG locations, different size face portions, or different golf club head cross sectional shapes. In one example, a golf club head with a relatively higher loft angle may have a generally smaller cavity width profile than a golf club head with a lower loft angle. Accordingly, the value of $FA_m/BA_f$ for the golf club with the relatively higher loft angle may be generally smaller than the golf club head with the lower loft angle due to the difference in the amount of filler materials that may be provided in the interior cavities of each golf club head as described herein. The apparatus, methods, and articles of manufacture described herein are not limited in this regard.

In another example, a relationship between the volume of the first filler material 1712 and the volume of the interior cavity 1510 ($V_m$) may be expressed by the following equation:

$$V_m = V_c(B_1\alpha + B_2) \tag{3}$$

where:

$V_m$ is the volume of the first filler material 1712, $V_c$ is the volume of the interior cavity 1510, $\alpha$ is the loft angle, $-0.001 \leq B_1 \leq 0.001$, and $0.3 \leq B_2 \leq 0.65$ The upper and lower boundary values of the coefficients $B_1$ and $B_2$ may define the upper and lower boundaries of a ratio of the volume of the first filler material 1712 to the volume of the interior cavity 1510. In one example, according to Equation (3) and assuming a value of −0.0015 for the coefficient $B_1$, upper and lower boundaries of a ratio of the volume of the first filler material 1712 to the volume of the interior cavity 1510 for a set of iron-type golf club heads may be determined as shown in Table 2.

TABLE 2

| Iron-Type | $\alpha$ | $(V_m/V_c) \leq$ | $(V_m/V_c) \geq$ |
|---|---|---|---|
| 3 | 18 | 0.61 | 0.35 |
| 4 | 21 | 0.61 | 0.35 |
| 5 | 23 | 0.60 | 0.35 |
| 6 | 26 | 0.60 | 0.34 |
| 7 | 30 | 0.59 | 0.34 |
| 8 | 34 | 0.58 | 0.33 |
| 9 | 39 | 0.58 | 0.32 |
| Wedge | 44 | 0.57 | 0.32 |
| Gap Wedge | 49 | 0.56 | 0.31 |
| Sand Wedge | 54 | 0.55 | 0.30 |
| Lob Wedge | 59 | 0.55 | 0.29 |

As discussed herein, golf club heads with different loft angles may have different internal cavity shapes, port locations, mass portion locations, filler material volumes, different CG locations, different size face portions, or different golf club head cross sectional shapes. In one example, a golf club head with a relatively higher loft angle may have a generally smaller cavity width profile than a golf club head with a lower loft angle. Accordingly, the value of $V_m/V_c$ for the golf club with the relatively higher loft angle may be generally smaller than the golf club head with the lower loft angle due to the difference in the amount of filler materials that may be provided in the interior cavities of each golf club head as described herein. The apparatus, methods, and articles of manufacture described herein are not limited in this regard.

Figure 15:
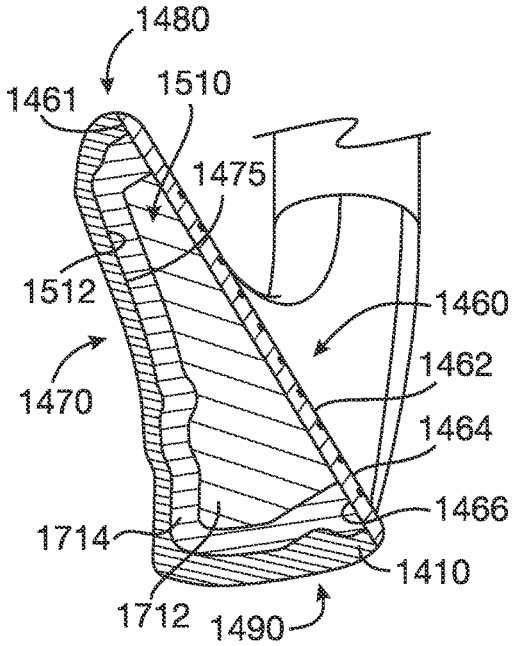
Figure 16:
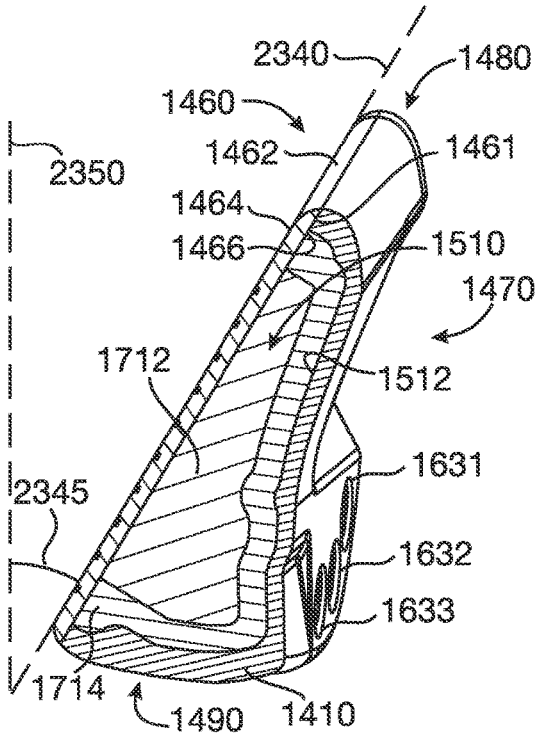
Figure 17:
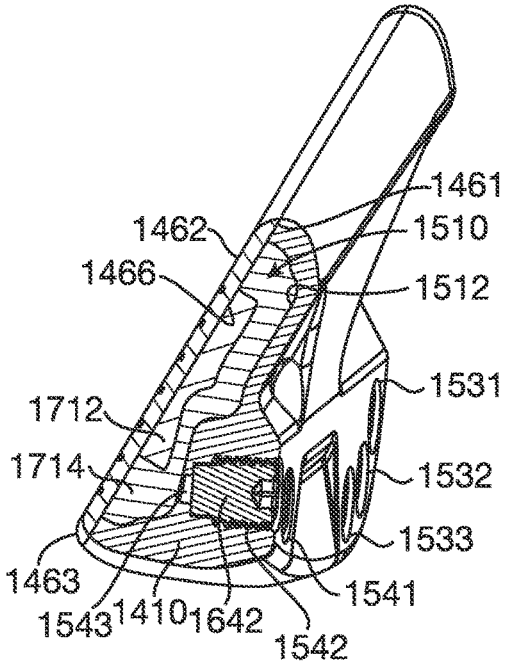
Figure 18:
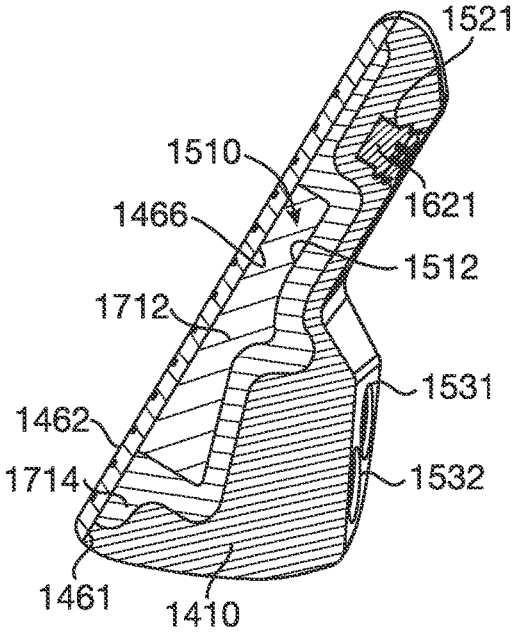
Figure 19:
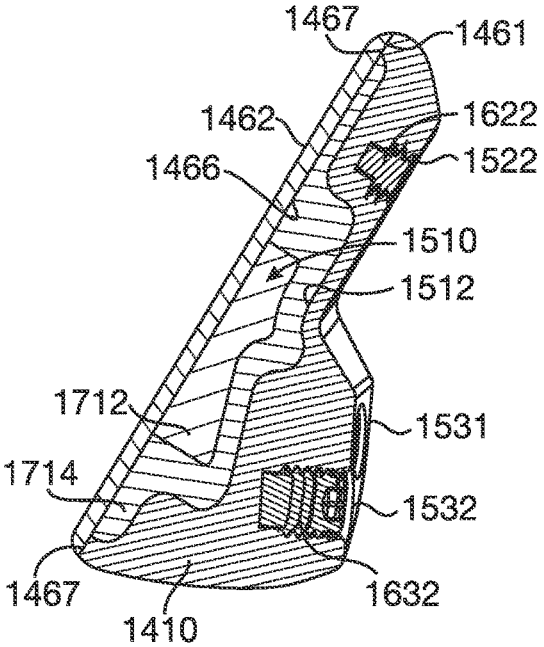
Figure 20:
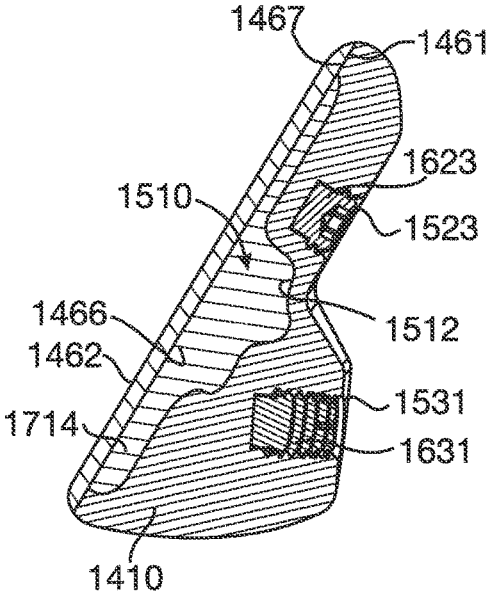
Figure 22:
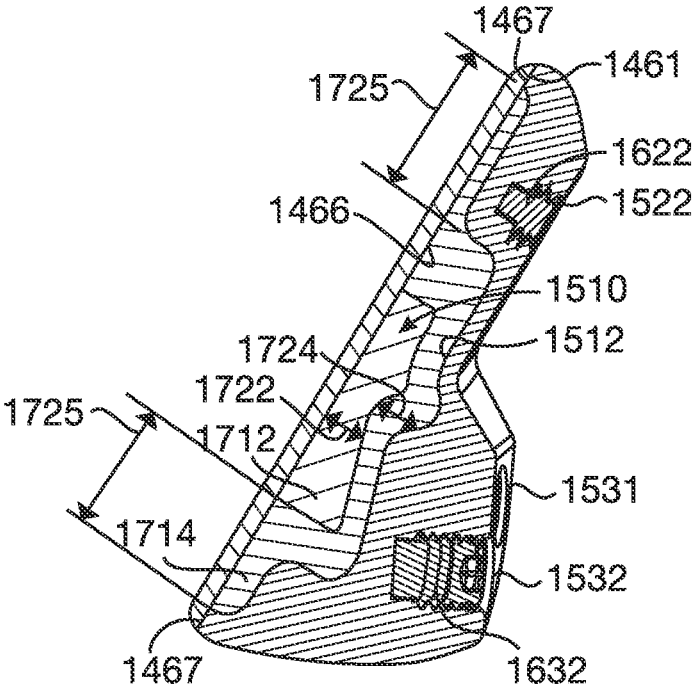
Figure 23:
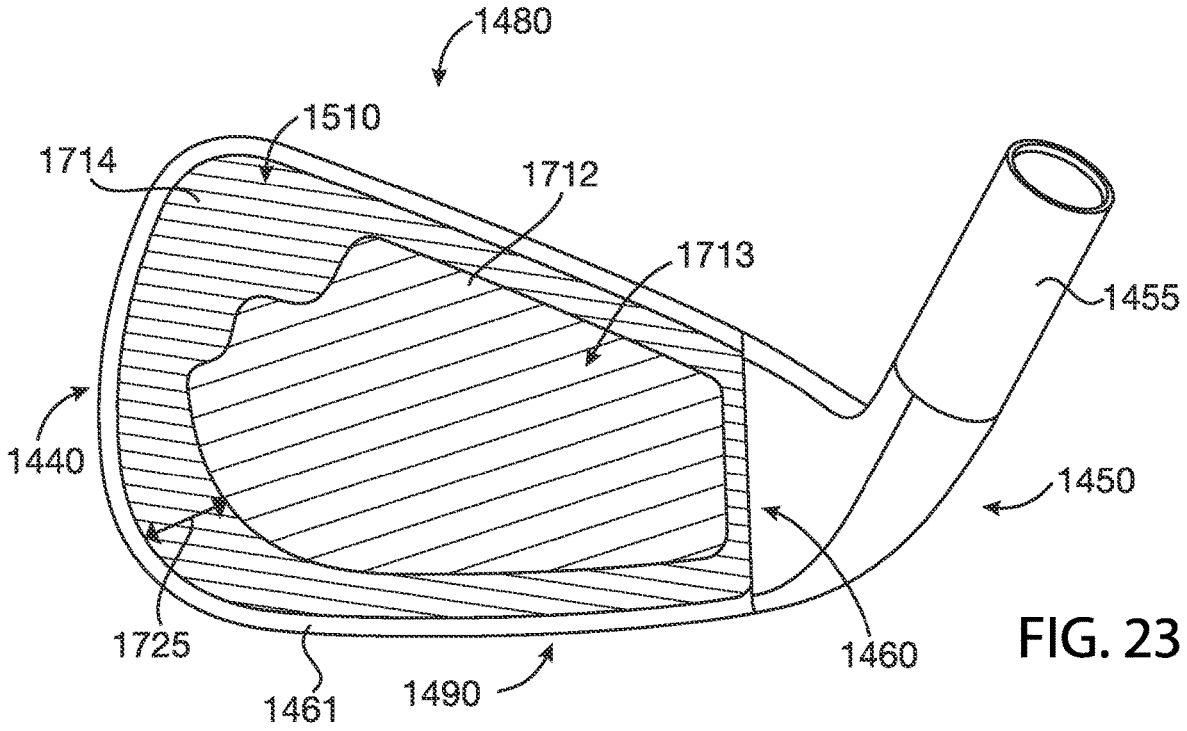
Figure 24:
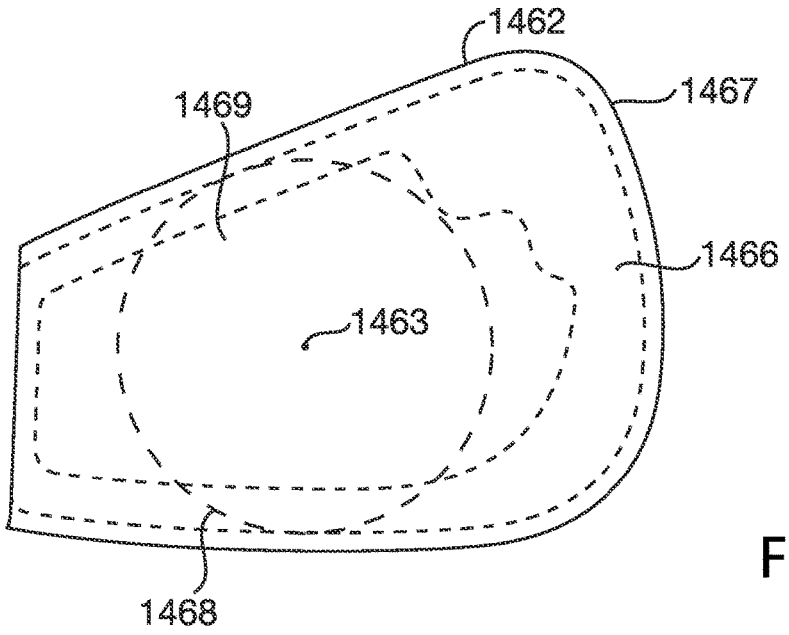

The values of the coefficients $A_1$, $A_2$, $B_1$, and $B_2$ within the boundaries of these coefficients as defined herein may maintain a certain gap or a certain perimeter gap between the first filler material 1712 and the inner walls of the interior cavity 1510 as described herein, and/or optimize or maximize the width 1722 of the first filler material 1712 at or proximate to the ball strike region 1468. Additionally, the values of the coefficients $A_1$, $A_2$, $B_1$, and $B_2$ may vary within the boundaries of these coefficients as defined herein based on the specific internal configuration or structure of a golf club head. For example, as shown in FIG. 22, the widths of certain areas of the interior cavity 1510 may not be sufficiently large to include both the first filler material 1712 and the second filler material 1714. As shown in FIG. 19, an area of the interior cavity 1510 between the port 352 and the face portion 1462 may only include the second filler material 1714. Accordingly, the absence of first filler material 1712 in the area of the interior cavity 1510 between the port 352 and the face portion 1462 as shown in FIG. 19 may affect both the upper boundary and the lower boundary of the ratio of the frontal area of the first filler material 1712 to the area of the inner surface portion 1469 of the face portion 1462 and/or the ratio of the volume of the first filler material 1712 to the volume of the interior cavity 1510. In another example, as shown in FIGS. 15 and 16, the ratio of the frontal area 1713 of the first filler material 1712 to the area of the inner surface portion 1469 of the face portion 1462 and/or the ratio of the volume of the first filler material 1712 to the volume of the interior cavity 1510 may be determined so that the width of the first filler material 1712 at the ball strike region 1468 is maximized while still maintaining a gap 1724 of sufficient width to accommodate the second filler material 1714. The apparatus, methods, and articles of manufacture described herein are not limited in this regard.

Figure 21:
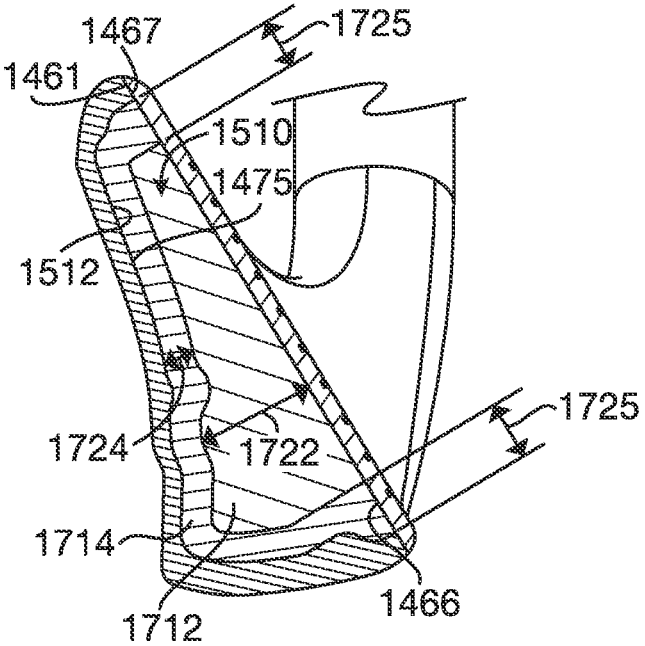

As described herein, in one example, the first filler material 1712 may not be attached to the entire inner surface portion 1469 of the face portion 1462. Accordingly, the first filler material 1712 and the perimeter edge portion 1461 (or the perimeter portion 1467 of the face portion) may be spaced apart by a perimeter gap 1725. The perimeter gap 1725 may be greater than the gap 1724 due to one or more golf club head design and manufacturing considerations. For example, the perimeter gap 1725 may have to be sufficiently large so that the heat from any welding or soldering process as described herein to attach the perimeter portion 1467 of the face portion 1462 to the perimeter edge portion 1461 of the body portion 1410 does not damage, shift, move, detach from the face portion 1462, and/or alter the material properties (e.g., melt) of the first filler material 1712 at or proximate to perimeter portion 1467 of the face portion 1462. Accordingly, for example, as shown in FIGS. 21 and 22, the perimeter gap 1725 may be larger than the gap 1724. In another example, as shown in FIG. 22, portions of the interior cavity 1510 at or proximate to the perimeter edge portion 1461 may not be sufficiently wide to include both the first filler material 1712 and the second filler material 1714. Accordingly, the perimeter gap 1725 may be substantially greater than the gap 1724. Thus, the gap 1724 may be configured such that the first filler material 1712 follows the contour of the inner walls 1512 of the interior cavity 1510, whereas the perimeter gap 1725 may be similar, greater, or substantially greater than the gap 1725 depending on the location or region of the interior cavity 1510. In one example, the relationship between the perimeter gap 1725 and the gap 1724 may be expressed by the following equation:

$$\frac{Wg_{PR}}{Wg_{min}} \geq 1.38 \tag{4}$$

where:

$Wg_{PR}$ is the width of the perimeter gap 1725, and $Wg_{min}$ is the minimum width of the gap 1724.

In one example, the first filler material 1712 may include a polymer material having a relatively high coefficient of restitution (COR). The COR of the first filler material 1712 may be determined by shooting a golf ball sized sample of the first filler material 1712 from an air cannon toward a steel plate. Two light screens at known positions between the cannon and the plate may be used to measure the approach velocity and rebound velocities of the sample. The COR of the sample may then be calculated as the rebound velocity divided by the approach velocity. In one example, the first filler material 1712 may have a COR of greater than or equal to 0.7 at an approach velocity of 125 ft/s (51.1 m/s). In another example, the first filler material 1712 may have a COR of greater than or equal to 0.75 at an approach velocity of 125 ft/s (51.1 m/s). In yet another example, the first filler material 1712 may have a COR of greater than or equal to 0.7 and less than or equal to 0.9 at an approach velocity of 125 ft/s (51.1 m/s). The COR of any of the materials described herein, including any of the filler materials described herein, may be determined by the above-described method. The apparatus, methods, and articles of manufacture described herein are not limited in this regard.

The compression of the golf ball sized sample may be related to the COR of the golf ball sized sample. Compression is a measurement of how much the golf ball sized sample deforms (compresses) under load. A relatively lower compression rating indicates a softer filler material, whereas a relatively higher compression rating indicates a firmer filler material. Compression may be measured by using an ATTI compression gauge, manufactured by ATTI Engineering, Union City, New Jersey. In one example, the COR of the first filler material 1712 may be greater than or equal to 0.75 at a compression of greater than or equal to 35. In another example, the COR of the first filler material 1712 may be greater than or equal to 0.78 at a compression of greater than or equal to 2 and less than or equal to 0.8 at a compression of less than or equal to 80. In yet another example, the COR of the first filler material 1712 may be greater than or equal to 0.78 at a compression of greater than or equal to 45 and less than or equal to 0.9 at a compression of less than or equal to 90. The apparatus, methods, and articles of manufacture described herein are not limited in this regard.

In one example, the first filler material 1712 may be a polymer material having a density of greater than or equal to 1.1 g/cm$^3$ and less than or equal to 1.3 g/cm$^3$. In another example, the first filler material 1712 may be a polymer material having a density of greater than or equal to 1.15 g/cm$^3$ and less than or equal to 1.38 g/cm$^3$. In yet another example, the first filler material 1712 may be a polymer material having a density of greater than or equal to 1.1 g/cm$^3$ and less than or equal to 1.2 g/cm$^3$. The apparatus, methods, and articles of manufacture described herein are not limited in this regard.

In one example, the first filler material 1712 may be a polymer material including rubber or a rubber compound similar to any of the rubber or rubber compounds described herein that may provide the COR and compression ranges described herein. In one example, the first filler material 1712 may include rubber and at least another compound that may provide increased softness or firmness to the first filler material 1712 to maximize the COR of the first filler material 1712 while maintaining compression values within a certain range as described herein. In one example, the first filler material 1712 may include rubber and Zinc Diacrylate (ZDA), which may increase the compression value of the first filler material 1712 and hence the COR of the first filler material 1712. The amount of Zinc Diacrylate (ZDA) in the first filler material 1712 may be varied to achieve certain COR and/or compression values as described herein. The apparatus, methods, and articles of manufacture described herein are not limited in this regard.

The adhesive for bonding the first filler material 1712 to the back surface 1466 of the face portion 1462 may be any type of adhesive that can bond the first filler material 1712 to the material of the face portion 1462. In one example, the first filler material 1712 may be a rubber or a rubber compound and the face portion 1462 may be constructed from a steel-based material such as stainless steel. Accordingly, the adhesive for bonding the first filler material 1712 to the back surface 1466 of the face portion 1462 may be a type of adhesive used to bond steel-based materials to rubber or rubber compounds. In another example, the first filler material 1712 may be a rubber or a rubber compound and the face portion 1462 may be constructed from titanium or a titanium alloy. Accordingly, the adhesive for bonding the first filler material 1712 to the back surface 1466 of the face portion 1462 may be a type of adhesive used to bond titanium-based materials to rubber or rubber compounds. In yet another example, the first filler material 1712 may be bonded to the back surface 1466 of the face portion 1462 with the second filler material 1714. The bonding of the first filler material 1712 to any portion of the body portion 1410, the face portion 1462, and/or the second filler material 1714, and the bonding of the second filler material 1714 to the body portion 1410, the face portion 1462, and/or the first filler material 1712 may be similar to any of the bonding properties and procedures described in any of the incorporated by reference applications. The apparatus, methods, and articles of manufacture described herein are not limited in this regard.

In one example (not shown), the interior cavity 1510 may be entirely filled with the first filler material 1712. In another example, as shown in FIGS. 14-24 and described herein, the interior cavity 1510 may be partially filled with the first filler material 1712 to define the gap 1724 between the first filler material 1712 and the inner walls 1512 of the interior cavity 1510. Accordingly, the remaining portions of the first interior cavity 1510 may be filled with a second filler material 1714. As described herein, the second filler material 1714 may provide or assist (e.g., alone or in conjunction with one or more adhesives) in the coupling of the first filler material 1712 with the face portion 1462. In other words, the first filler material 1712 may be maintained against the back surface 1466 of the face portion 1462 by the second filler material 1714. The apparatus, methods, and articles of manufacture described herein are not limited in this regard.

In one example, the second filler material 1714 may have one or more different properties than the first filler material 1712 such as density, compression, hardness (i.e., durometer), tensile strength, shear strength, viscosity, elasticity, etc., to optimize energy transfer from the face portion 1462 to a golf ball. The second filler material may be a polymer material such as an epoxy. In one example, the second filler material 1714 may have a lower COR than the first filler material 1712. The apparatus, methods, and articles of manufacture described herein are not limited in this regard.

As described herein, the first filler material 1712 and/or the second filler material 1714 may provide vibration dampening or sound dampening (e.g., consistent and/or pleasing sound and feel when the golf club head 1400 strikes a golf ball as perceived by an individual using the golf club head 1400, provide structural support for the face portion 1462, and/or improve ball travel distance, ball speed, ball launch angle, ball spin rate, ball peak height, ball landing angle and/or ball dispersion. The first filler material 1712, the second filler material 1714, or both may provide the properties and characteristics described herein whereas the mass of the first filler material 1712, the mass of the second filler material 1714, or the masses of both relative to the mass of the body portion 1410 may optimally affect the mass, mass distribution, CG, MOI characteristics, structural integrity and/or or other static and/or dynamic characteristics of the golf club head 1400. In one example, a relationship between the mass of the first filler material 1712 ($m_{m1}$), the mass of the second filler material 1714 ($m_{m2}$), and the mass of the body portion 1410 ($m_b$) may be expressed by the following equation:

$$m_{m1}=m_b(C_1\alpha+C_2)-m_{m2} \quad (5)$$

where:

$mm_1$ is the mass of the first filler material 1712,
$mm_2$ is the mass of the second filler material 1714,
$m_b$ is the mass of the body portion 1410,
$\alpha$ is the loft angle,
$-0.001 \leq C_1 \leq 0.001$, and
$0.1 \leq C_2 \leq 0.2$.

The upper and lower values of the coefficients $C_1$ and $C_2$ as defined herein may provide the upper and lower boundaries of a ratio of the sum of the masses of the first filler material 1712 and the second filler material 1714 to the mass of the body portion 1410 (i.e., $(m_{m1}+m_{m2})/m_b$). In one example, according to Equation (5) and assuming a value of −0.0016 for the coefficient $C_1$, upper and lower boundaries of a ratio of the sum of the masses of the first filler material 1712 and the second filler material 1714 to the mass of the body portion 1410 for a set of iron-type golf club heads may be determined as shown in Table 3.

TABLE 3

| Iron-Type | $\alpha$ | $(m_{m1} + m_{m2})/m_b) \leq$ | $(m_{m1} + m_{m2})/m_b) \geq$ |
|---|---|---|---|
| 3 | 18 | 0.16 | 0.08 |
| 4 | 21 | 0.16 | 0.08 |
| 5 | 23 | 0.15 | 0.08 |
| 6 | 26 | 0.15 | 0.07 |
| 7 | 30 | 0.14 | 0.06 |
| 8 | 34 | 0.13 | 0.06 |
| 9 | 39 | 0.13 | 0.05 |
| Wedge | 44 | 0.12 | 0.04 |
| Gap Wedge | 49 | 0.11 | 0.03 |
| Sand Wedge | 54 | 0.10 | 0.03 |
| Lob Wedge | 59 | 0.09 | 0.02 |

The values of the coefficients $C_1$ and $C_2$ within the boundaries of these coefficients as defined herein may (i) provide vibration dampening or sound dampening (e.g., consistent and/or pleasing sound and feel when the golf club head 1400 strikes a golf ball as perceived by an individual using the golf club head 1400), (ii) provide structural support for the face portion 1462, and/or (iii) improve ball travel distance, ball speed, ball launch angle, ball spin rate, ball peak height, ball landing angle and/or ball dispersion. The first filler material 1712 and the second filler material 1714 may provide the properties and characteristics described herein whereas the mass of the first filler material 1712 and the second filler material 1714 relative to the mass of the body portion 1410 optimally affect the mass, mass distribution, CG, MOI characteristics, structural integrity and/or or other static and/or dynamic characteristics of the golf club head 1400. The apparatus, methods, and articles of manufacture described herein are not limited in this regard.

Figure 25:
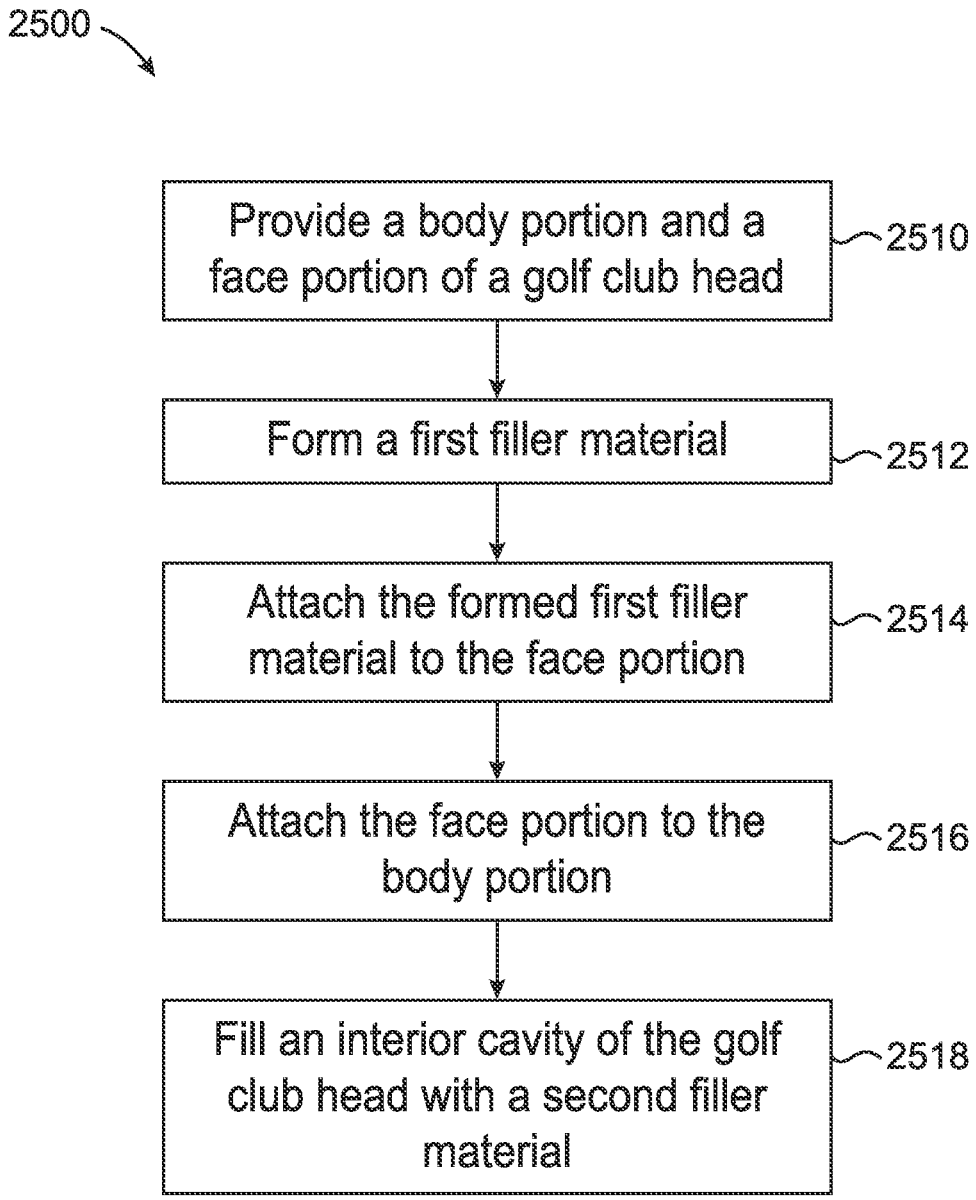
FIG. 25 depicts one manner in which the example golf club head of FIG. 14 may be manufactured.

FIG. 25 depicts one manner by which the example golf club head 1400 as described herein may be manufactured. In the example of FIG. 25, the process 2500 may begin with providing a body portion 1410 and a face portion 1462 of a golf club head 1400 (block 2510). The first filler material 1712 may be formed or molded into a certain shape (block 2512) as described in detail herein, for example, to resemble, closely resemble, or generally resemble the contour of the interior cavity 1510 (i.e., the shape of the inner walls 1512 of the interior cavity 1510) of the golf club head 1400. The first filler material 1712 in the molded form may then be attached or bonded to the back surface 1466 of the face portion 1462 (block 2514) as described herein. The face portion 1462 may then be attached to the body portion 1410 as described herein to form or enclose the interior cavity 1510 (block 2516). The second filler material 1714 may then be injected into the interior cavity 1510 through one or more of the ports of the first set of ports 350, the second set of ports 360, and/or the third set of ports 370 that may be connected to the interior cavity 1510 as described herein to fill the gap 1724, to fill the remaining portions of the interior cavity 1510 (block 2518), and/or to surround the first filler material 1712. The second filler material 1714 may be injected into the interior cavity 1510 at a relatively high pressure if necessary and/or from more than one port, if necessary, to allow the second filler material 1714 to fill relatively narrow gaps 1724 at certain locations in the interior cavity 1510 as described herein between the first filler material 1712 and the inner walls of the interior cavity 1510. The second filler material 1714 may then cure at ambient temperature or by one or more heating/cooling cycles depending on the material used for the second filler material 1714. The apparatus, methods, and articles of manufacture described herein are not limited in this regard.

Figure 26:
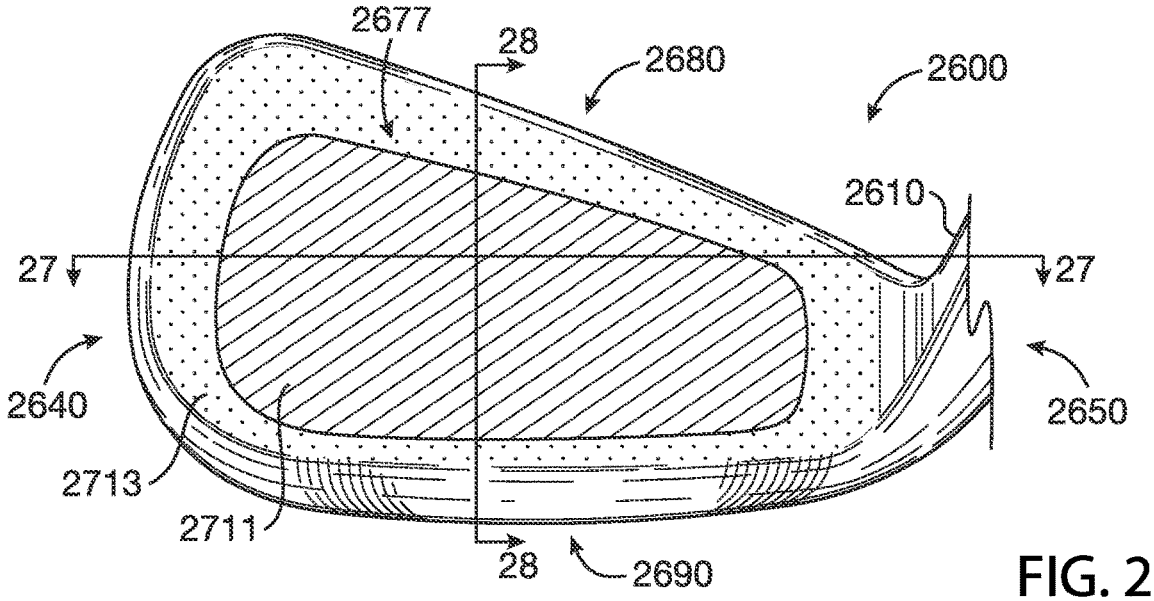
FIGS. 26, 27, and 28 depict a perspective cross-sectional view (along line 26-26 of FIG. 27), a perspective cross-sectional view (along line 27-27 of FIG. 26), and a perspective cross-sectional view (along line 28-28 of FIG. 26), respectively, of a golf club head according to an embodiment of the apparatus, methods, and articles of manufacture described herein.
Figure 27:
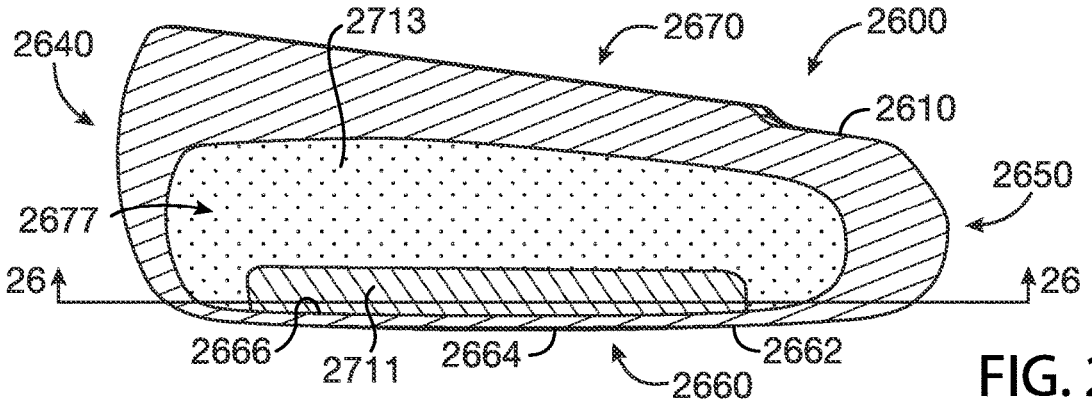
Figure 28:
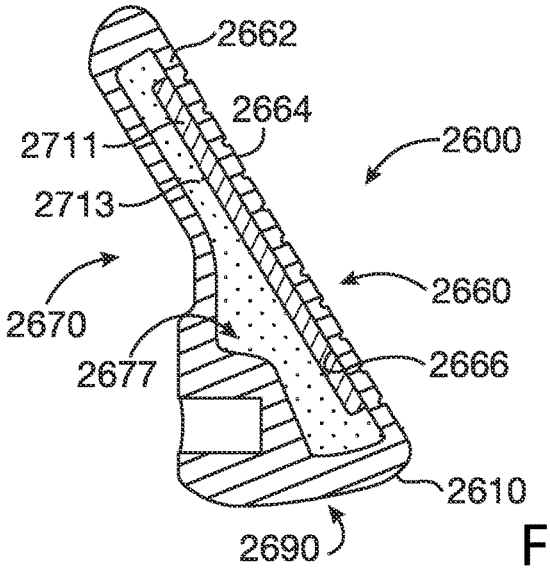

In the example of FIGS. 26-28, a golf club head 2600 may include a body portion 2610 having a toe portion 2640, a heel portion 2650, a front portion 2660 with a face portion 2662 (e.g., a strike face) having a front surface 2664 and a back surface 2666, a back portion 2670, a top portion 2680, and a sole portion 2690. In one example, the body portion 2610 may be a hollow body including the interior cavity 2677 extending between the front portion 2660 and the back portion 2670 and extending between the top portion 2680 and the sole portion 2690. The golf club head 2600 may be similar in many respects to any of the golf club heads described herein. For example, the golf club head 2600 may include any number of ports and/or mass portions similar to any of the golf club head described herein. In another example, the golf club head 2600 may include any of the materials described herein. The apparatus, methods, and articles of manufacture described herein are not limited in this regard.

The golf club head 2600 may include one or more filler materials in the interior cavity 2677. In one example, as shown in FIGS. 26-28, the golf club head 2600 may include a first filler material 2711 and a second filler material 2713 having one or more different properties than the first filler material 2711 (e.g., elasticity, density, hardness, etc.). In one example, the first filler material 2711 may be a polymer material having a different elasticity than the second filler material 2713 (e.g., the second filler material 2713 may be more elastic than the first filler material 2711 or vice versa). In another example, the first filler material 2711 may include a polymer material having a different density than the second filler material 2713 (e.g., the first filler material 2711 may have a higher density than the second filler material 2713 or vice versa). In yet another example, the first filler material 2711 may have a different hardness (e.g., Shore D hardness or Shore A hardness) than the second filler material 2713 (e.g., the first filler material 2711 may have a relatively higher hardness than the second filler material 2713 or vice versa). In yet another example, the first filler material 2711 and the second filler material 2713 may have different coefficients of restitution (COR). The first and second filler materials 2711 and 2713, respectively, may be different types of non-metal materials. In one example, the first filler material 2711 may include a thermoset material whereas the second filler material 2713 may include a thermoplastic elastomer material. In another example, the first filler material 2711 may be a rubber or a rubber compound as described herein. In another example, the second filler material 2713 may include a thermoset material whereas the first filler material 2711 may include a thermoplastic elastomer material. The first and second filler materials 2711 and 2713, respectively, may include the same type of non-metal material but different properties. In one example, the first filler material 2711 may include a thermoset material and the second filler material 2713 may include a thermoset material having a different elasticity than the first filler material 2711. In another example, the first filler material 2711 may include a thermoplastic material and the second filler material 2713 may include a thermoplastic material having a different elasticity than the first filler material 2711. Alternatively, the first and second filler materials 2711 and 2713, respectively, may include metal materials and/or non-metal materials. For example, the first filler material 2711 may include one or more metal-based materials whereas the second filler material 2713 may include one or more polymer materials. Further, the first filler material 2711 and/or the second filler material 2713 may include any of the filler materials described herein. In one example, the first filler material 2711 may be an epoxy material such as any of the epoxy materials described herein and the second filler material 2713 may be an elastomer material such as any of the elastomer materials described herein. In one example, the first filler material 2711 may be an epoxy material such as any of the epoxy materials described herein and the second filler material 2713 may be an elastomer material such as any of the elastomer materials described herein. In yet another example, the first filler material 2711 may be a rubber-based compound and the second filler material 2713 may be an epoxy-based compound. The apparatus, methods, and articles of manufacture described herein are not limited in this regard.

In one example, as shown in FIGS. 26-28, the first filler material 2711 may be attached or bonded to a portion of the back surface 2666 of the face portion 2662. In one example, the first filler material 2711 may be attached or bonded to a ball strike region of the back surface 2666 of the face portion 2662. In another example, the first filler material 2711 may be attached or bonded to the ball strike region of the back surface 2666 of the face portion 2662 and an area surrounding the ball strike region of the back surface 2666 of the face portion 2662. In one example, the width of the first filler material 2711 (i.e., the thickness of the first filler material 2711) may be less than the thickness of the face portion 2662. In another example, the width of the first filler material 2711 may be similar to the thickness of the face portion 2662. In yet another example, the width of the first filler material 2711 may be greater than the thickness of the face portion 2662. The apparatus, methods, and articles of manufacture described herein are not limited in this regard.

In one example, as shown in FIGS. 26-28, the remaining portions of the interior cavity 2677 may be partially or entirely filled with the second filler material 2713. The first filler material 2711 may be surrounded by the second filler material 2713 such that the second filler material 2713 is attached or bonded to the remaining portions of the back surface 2666 of the face portion 2662. As shown in FIG. 26, the second filler material 2633 may be attached or bonded to the back surface 2666 of the face portion 2662 and define a perimeter portion on the back surface 2666 of the face portion 2662 surrounding the first filler material 2711. For example, as shown in FIGS. 26-28, the second filler material 2713 may be attached or bonded to a portion of the back surface 2666 of the face portion 2662 and surround the first filler material 2711 at or proximate to the toe portion 2640, attached or bonded to a portion of the back surface 2666 of the face portion 2662 and surround the first filler material 2711 at or proximate to the heel portion 2650, attached or bonded to a portion of the back surface 2666 of the face portion 2662 and surround the first filler material 2711 at or proximate to the top portion 2680, and/or attached or bonded to a portion of the back surface 2666 of the face portion 2662 and surround the first filler material 2711 at or proximate to the sole portion 2690. The apparatus, methods, and articles of manufacture described herein are not limited in this regard.

Figure 29:
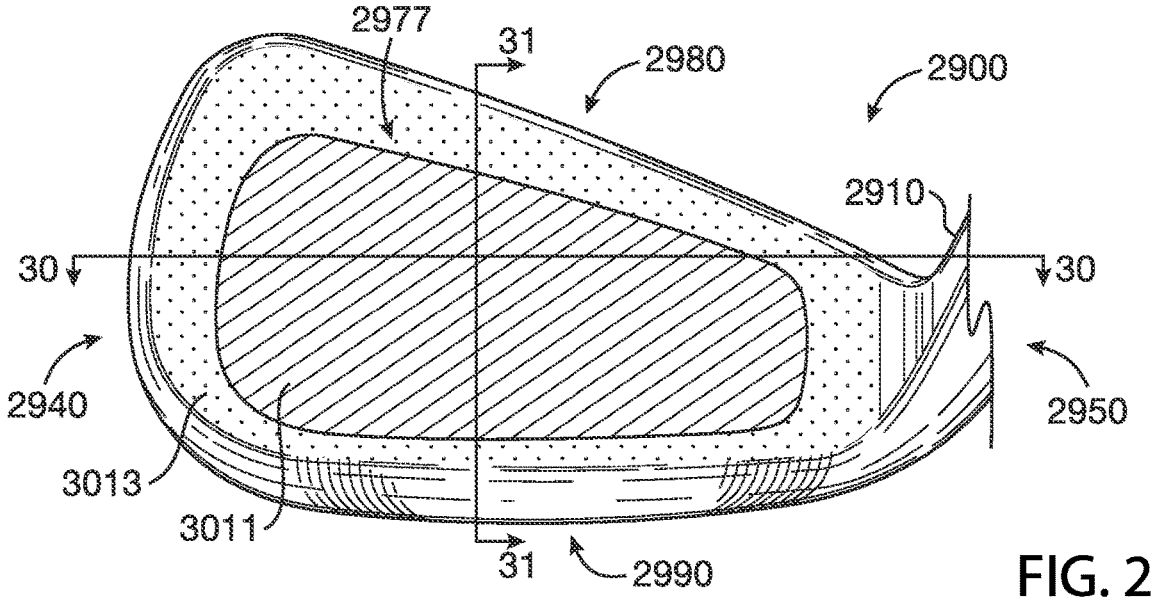
FIGS. 29, 30, and 31 depict a perspective cross-sectional view (along line 29-29 of FIG. 30), a perspective cross-sectional view (along line 30-30 of FIG. 29), and a perspective cross-sectional view (along line 31-31 of FIG. 29), respectively, of a golf club head according to an embodiment of the apparatus, methods, and articles of manufacture described herein.
Figure 30:
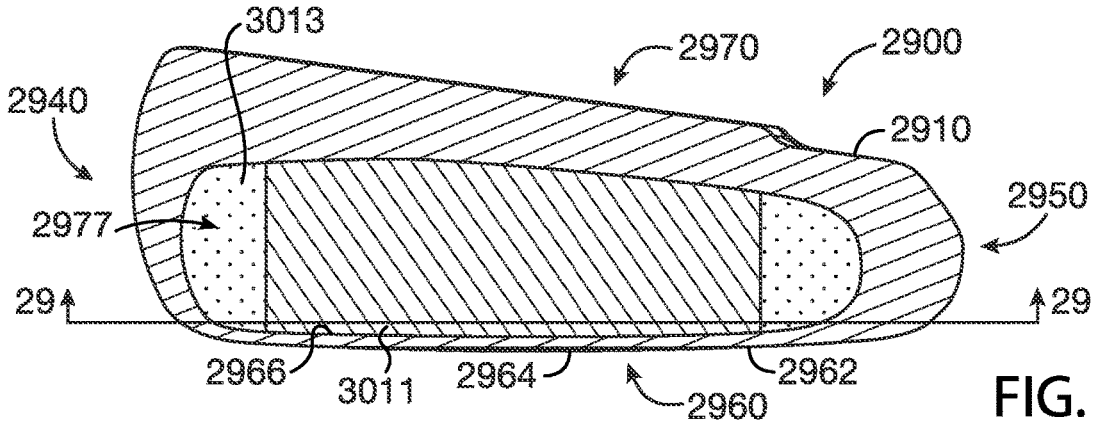
Figure 31:
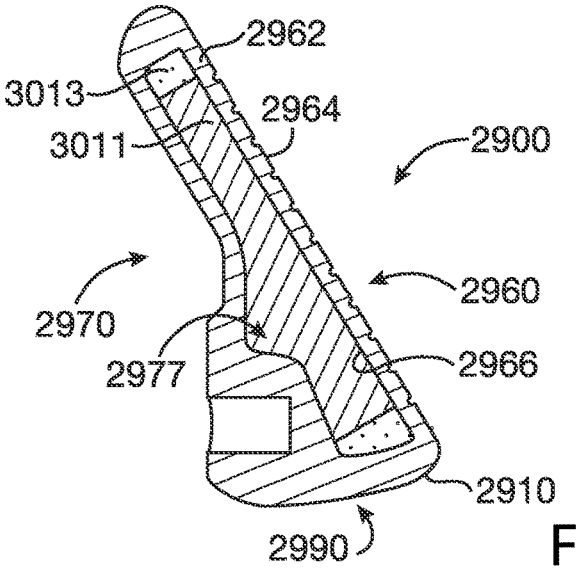

In the example of FIGS. 29-31, a golf club head 2900 may include a body portion 2910 having a toe portion 2940, a heel portion 2950, a front portion 2960 with a face portion 2962 (e.g., a strike face) having a front surface 2964 and a back surface 2966, a back portion 2970, a top portion 2980, and a sole portion 2990. In one example, the body portion 2910 may be a hollow body including the interior cavity 2977 extending between the front portion 2960 and the back portion 2970 and extending between the top portion 2980 and the sole portion 2990. The golf club head 2900 may be similar in many respects to any of the golf club heads described herein. For example, the golf club head 2900 may include any number of ports and/or mass portions similar to any of the golf club head described herein. In another example, the golf club head 2900 may include any of the materials described herein. The apparatus, methods, and articles of manufacture described herein are not limited in this regard.

The golf club head 2900 may include a first filler material 3011 and a second filler material 3013 that may be similar to the first filler material 2711 and the second filler material 2713, respectively, of the golf club head 2600. In the example of FIGS. 29-31, the first filler material 3011 may be attached or bonded to a portion of the back surface 2966 of the face portion 2962 similar to the examples of FIGS. 26-28. In the example of FIGS. 29-31, however, the first filler material 3011 may extend from the back surface 2966 of the face portion 2962 to a back surface 2976 of a back wall 2972 of the back portion 2970. The first filler material 3011 may contact or be attached or bonded to the back surface 2976 of a back wall 2972 of the back portion 2970. The remaining portions of the interior cavity 2977 may be partially or entirely filled with the second filler material 3013. The apparatus, methods, and articles of manufacture described herein are not limited in this regard.

Figure 32:
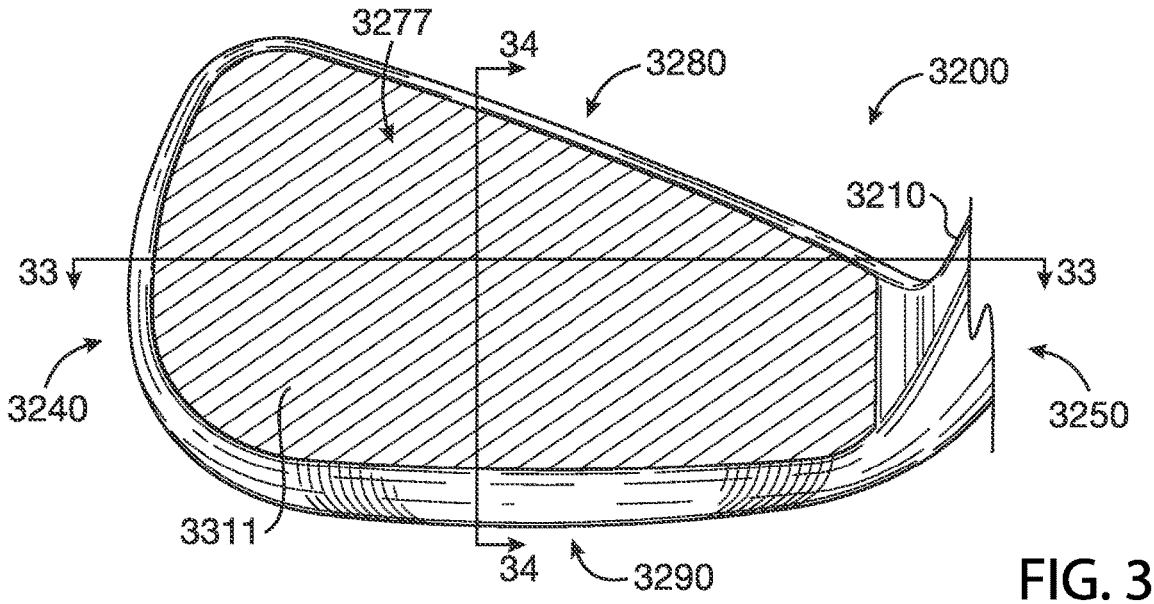
FIGS. 32, 33, and 34 depict a perspective cross-sectional view (along line 32-32 of FIG. 33), a perspective cross-sectional view (along line 33-33 of FIG. 32), and a perspective cross-sectional view (along line 34-34 of FIG. 32), respectively, of a golf club head according to an embodiment of the apparatus, methods, and articles of manufacture described herein.
Figure 33:
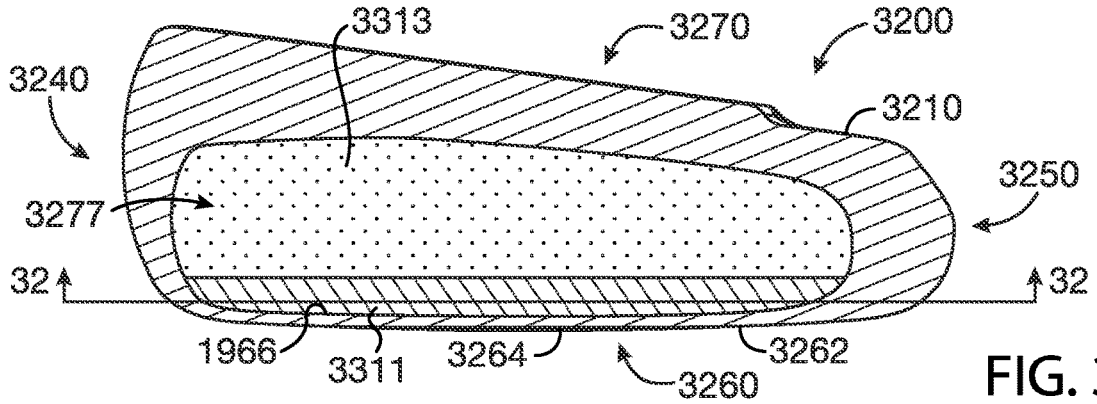
Figure 34:
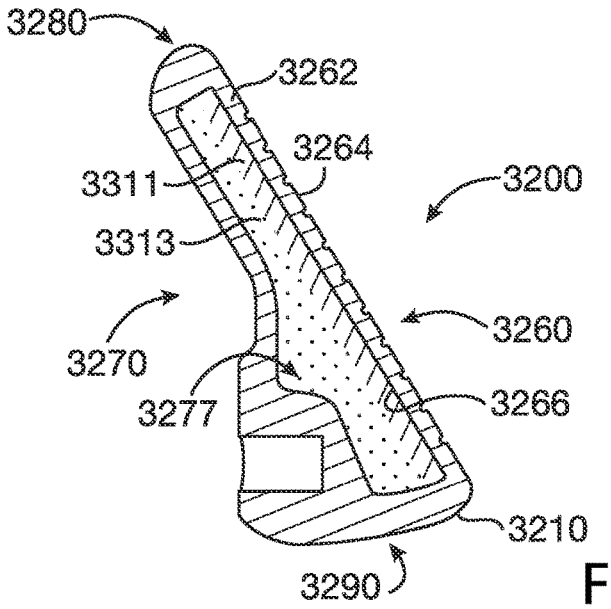

In the example of FIGS. 32-34, a golf club head 3200 may include a body portion 3210 having a toe portion 3240, a heel portion 3250, a front portion 3260 with a face portion 3262 (e.g., a strike face) having a front surface 3264 and a back surface 3266, a back portion 3270, a top portion 3280, and a sole portion 3290. In one example, the body portion 3210 may be a hollow body including the interior cavity 3277 extending between the front portion 3260 and the back portion 3270 and extending between the top portion 3280 and the sole portion 3290. The golf club head 3200 may be similar in many respects to any of the golf club heads described herein. For example, the golf club head 3200 may include any number of ports and/or mass portions similar to any of the golf club head described herein. In another example, the golf club head 3200 may include any of the materials described herein. The apparatus, methods, and articles of manufacture described herein are not limited in this regard.

The golf club head 3200 may include a first filler material 3311 and a second filler material 3313 that may be similar to the first filler material 2711 and the second filler material 2713, respectively, of the golf club head 2600. In the example of FIGS. 32-34, the first filler material 3311 may be attached or bonded to a substantial portion of or the entire back surface 3266 of the face portion 3262. In one example, the width of the first filler material 3311 (i.e., the thickness of the first filler material 3311) may be less than the thickness of the face portion 3262. In another example, the width of the first filler material 3311 may be similar to the thickness of the face portion 3262. In yet another example, the width of the first filler material 3311 may be greater than the thickness of the face portion 3262. The remaining portions of the interior cavity 3277 may be partially or entirely filled with the second filler material 3313. The apparatus, methods, and articles of manufacture described herein are not limited in this regard.

Figure 35:
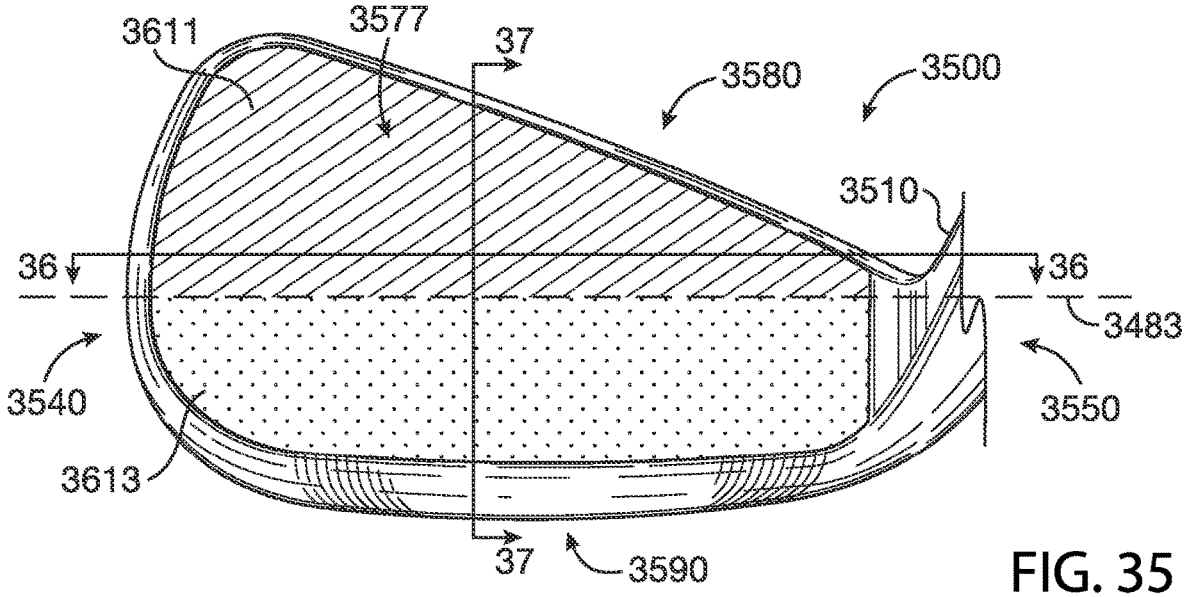
FIGS. 35, 36, and 37 depict a perspective cross-sectional view (along line 35-35 of FIG. 36), a perspective cross-sectional view (along line 36-36 of FIG. 35), and a perspective cross-sectional view (along line 37-37 of FIG. 35), respectively, of a golf club head according to an embodiment of the apparatus, methods, and articles of manufacture described herein.
Figure 36:
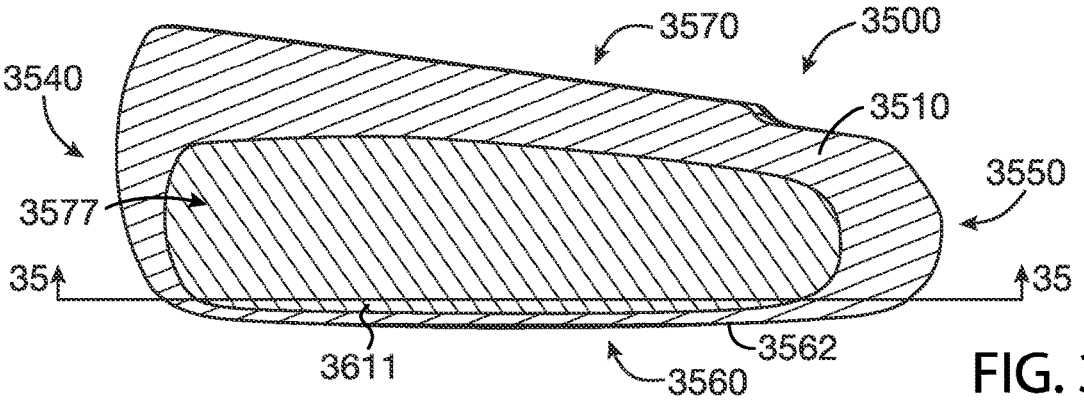
Figure 37:
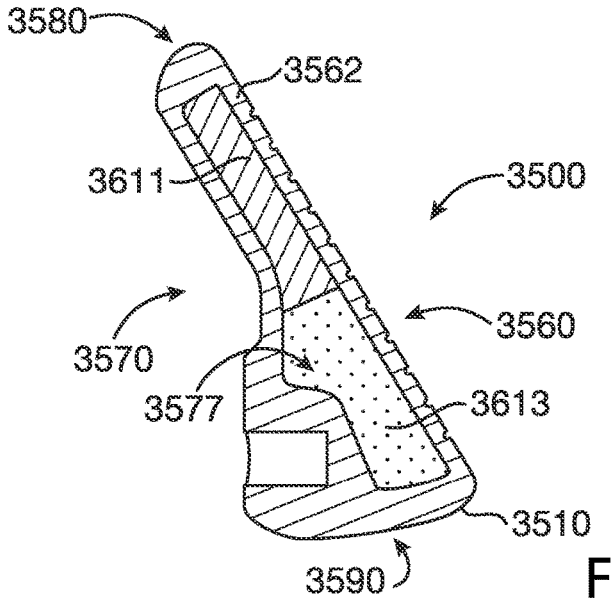

In the example of FIGS. 35-37, a golf club head 3500 may include a body portion 3510 having a toe portion 3540, a heel portion 3550, a front portion 3560 with a face portion 3562 (e.g., a strike face) having a front surface 3564 and a back surface 3566, a back portion 3570, a top portion 3580, and a sole portion 3590. In one example, the body portion 3510 may be a hollow body including the interior cavity 3577 extending between the front portion 3560 and the back portion 3570 and extending between the top portion 3580 and the sole portion 3590. The golf club head 3500 may be similar in many respects to any of the golf club heads described herein. For example, the golf club head 3500 may include any number of ports and/or mass portions similar to any of the golf club head described herein. In another example, the golf club head 3500 may include any of the materials described herein. The golf club head 3500 may include a first filler material 3611 and a second filler material 3613 that may be similar to the first filler material 2711 and the second filler material 2713, respectively, of the golf club head 2600. In the example of FIGS. 35-37, a portion of the interior cavity 3577 above a horizontal midplane 3583 of the body portion 3510 may be partially or entirely filled with the first filler material 3611, and a portion of the interior cavity 3577 below the horizontal midplane 3583 may be partially or entirely filled with the second filler material 3613. The apparatus, methods, and articles of manufacture described herein are not limited in this regard.

Figure 38:
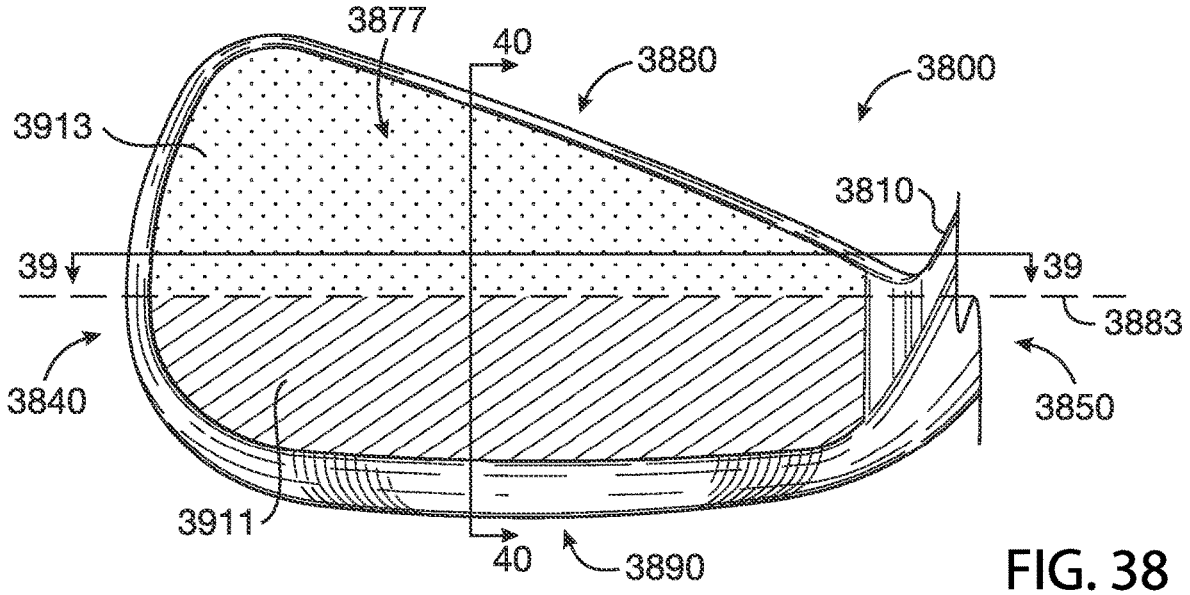
FIGS. 38, 39, and 40 depict a perspective cross-sectional view (along line 38-38 of FIG. 39), a perspective cross-sectional view (along line 39-39 of FIG. 38), and a perspective cross-sectional view (along line 40-40 of FIG. 38), respectively, of a golf club head according to an embodiment of the apparatus, methods, and articles of manufacture described herein.
Figure 39:
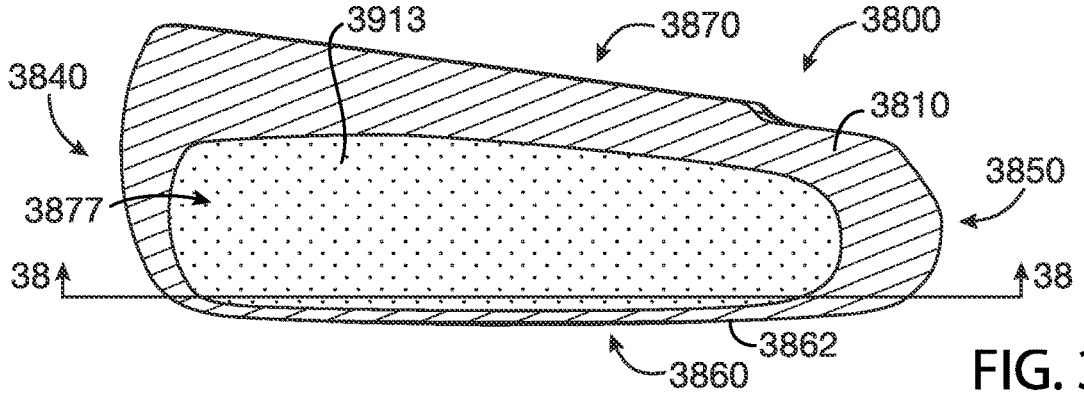
Figure 40:
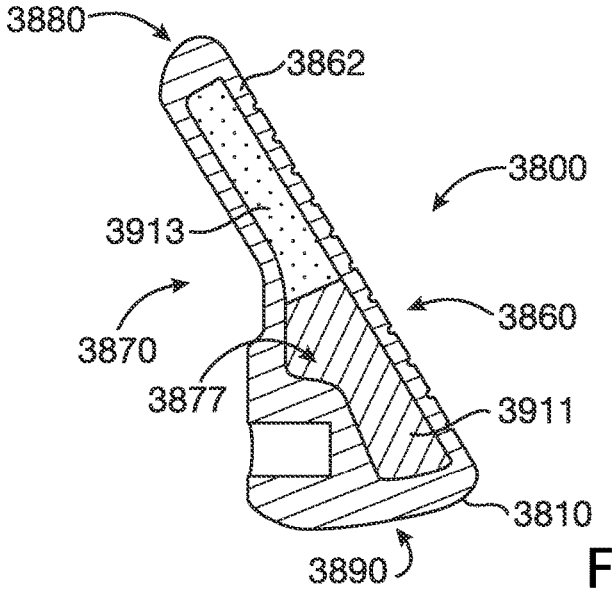

In the example of FIGS. 38-40, a golf club head 3800 may include a body portion 3810 having a toe portion 3840, a heel portion 3850, a front portion 3860 with a face portion 3862 (e.g., a strike face) having a front surface 3864 and a back surface 3866, a back portion 3870, a top portion 3880, and a sole portion 3890. In one example, the body portion 3810 may be a hollow body including the interior cavity 3877 extending between the front portion 3860 and the back portion 3870 and extending between the top portion 3880 and the sole portion 3890. The golf club head 3800 may be similar in many respects to any of the golf club heads described herein. For example, the golf club head 3800 may include any number of ports and/or mass portions similar to any of the golf club head described herein. In another example, the golf club head 3800 may include any of the materials described herein. The golf club head 3800 may include a first filler material 3911 and a second filler material 3913 that may be similar to the first filler material 2711 and the second filler material 2713, respectively, of the golf club head 2600. In the example of FIGS. 38-40, a portion of the interior cavity 3877 below a horizontal midplane 3883 of the body portion 3810 may be partially or entirely filled with the first filler material 3911, and a portion of the interior cavity 3877 above the horizontal midplane 3883 may be partially or entirely filled with the second filler material 3913. The apparatus, methods, and articles of manufacture described herein are not limited in this regard.

Figure 41:
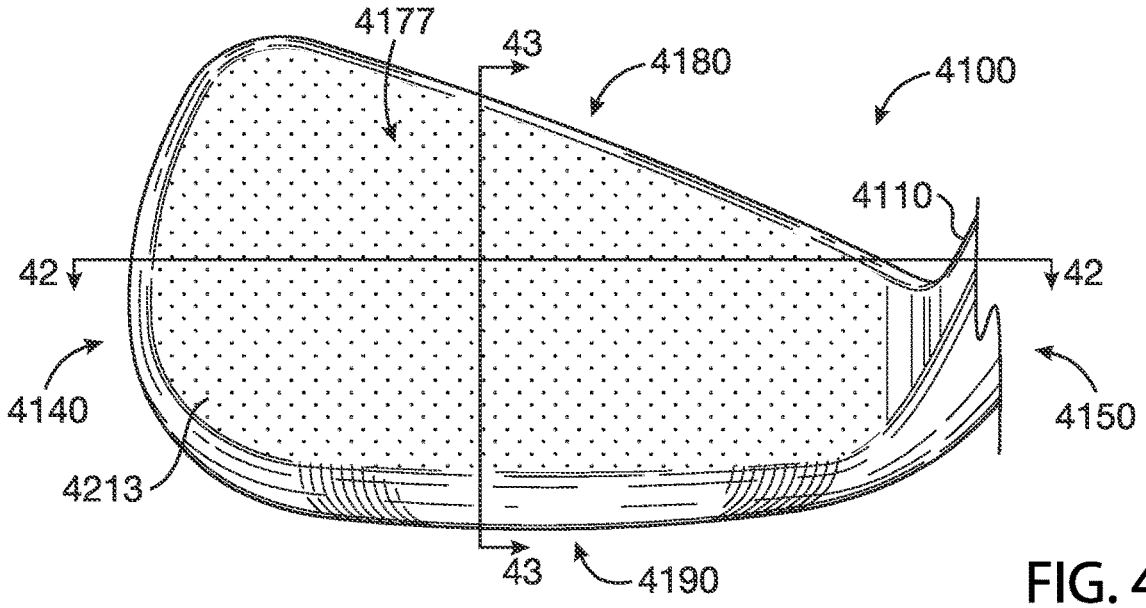
FIGS. 41, 42, and 43 depict a perspective cross-sectional view (along line 41-41 of FIG. 42), a perspective cross-sectional view (along line 42-42 of FIG. 41), and a perspective cross-sectional view (along line 43-43 of FIG. 41), respectively, of a golf club head according to an embodiment of the apparatus, methods, and articles of manufacture described herein.
Figure 42:
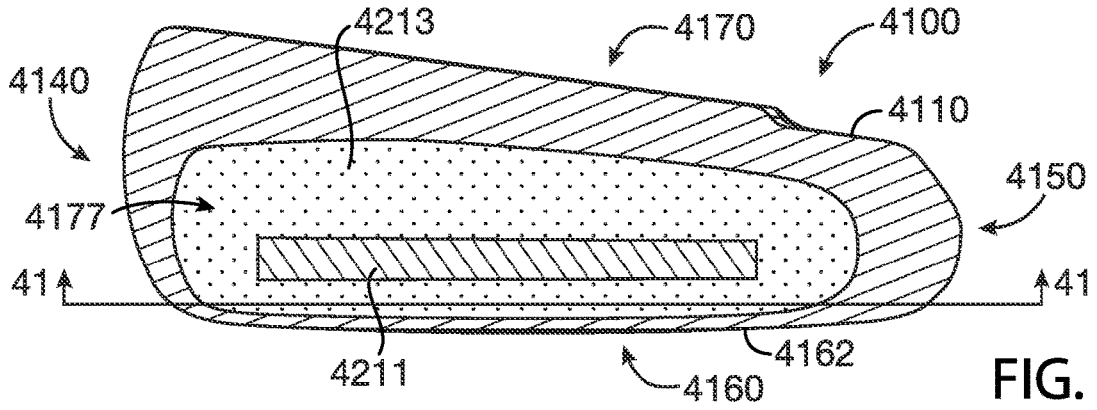
Figure 43:
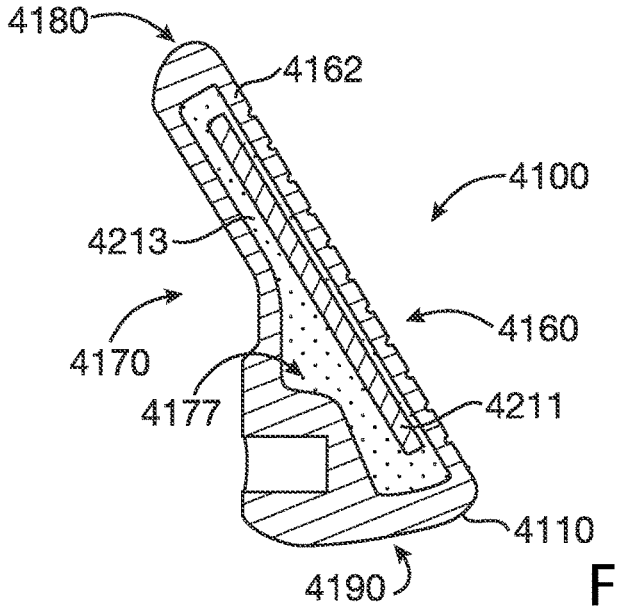

In the example of FIGS. 41-43, a golf club head 4100 may include a body portion 4110 having a toe portion 4140, a heel portion 4150, a front portion 4160 with a face portion 4162 (e.g., a strike face) having a front surface 4164 and a back surface 4166, a back portion 4170, a top portion 4180, and a sole portion 4190. In one example, the body portion 4110 may be a hollow body including the interior cavity 4177 extending between the front portion 4160 and the back portion 4170 and extending between the top portion 4180 and the sole portion 4190. The golf club head 4100 may be similar in many respects to any of the golf club heads described herein. For example, the golf club head 4100 may include any number of ports and/or mass portions similar to any of the golf club head described herein. In another example, the golf club head 4100 may include any of the materials described herein. The apparatus, methods, and articles of manufacture described herein are not limited in this regard.

The golf club head 4100 may include a first filler material 4211 and a second filler material 4213 that may be similar to the first filler material 2711 and the second filler material 2713, respectively, of the golf club head 2600. In the example of FIGS. 41-43, a portion of the interior cavity 4177 spaced apart from any boundary of the interior cavity 4177 defined by the body portion 4110 and the face portion 4162 may be filled with the first filler material 4211, and the remaining portions of the interior cavity 4177 may be partially or entirely filled with the second filler material 4213. In other words, the first filler material 4211 may be suspended in the interior cavity 4177 and entirely surrounded by the second filler material 4213. The apparatus, methods, and articles of manufacture described herein are not limited in this regard.

In one example, as described herein, one or more polymer materials may be injection molded in the body portion of any of the golf club heads described herein. The one or more polymer materials may be made or formed by any useful forming means for forming polymers. This include, molding including compression molding, injection molding, blow molding, and transfer molding; film blowing or casting; extrusion, and thermoforming; as well as by lamination, pultrusion, protrusion, draw reduction, rotational molding, spin bonding, melt spinning, melt blowing; or combinations thereof. In another example, any one or more of the polymer materials described herein may be in pellet or solid pieces that may be placed in the interior cavity and expanded and/or cured with heat. The apparatus, methods, and articles of manufacture described herein are not limited in this regard.

The interior cavity of any of the golf club heads described herein may be partially (i.e., greater than 0% and less than 100%) or entirely filled with one or more thermoset materials (e.g., one or more epoxy materials), such as any one or more of the epoxy materials described herein or any other suitable epoxy material(s). In one example, the mass of the thermoset material (e.g., epoxy) partially, substantially (e.g., filling at least 50% of the interior cavity), or entirely filling the interior cavity of any of the golf club heads described herein may be greater than or equal to 6.0 grams and less than or equal to 32.0 grams. A thermoset material partially, substantially, or entirely filling the interior cavity may affect vibration and noise dampening, structural support for a relatively thin face portion, ball travel distance, ball speed, ball launch angle, ball spin rate, ball peak height, ball landing angle and/or ball dispersion. The apparatus, methods, and articles of manufacture described herein are not limited in this regard. The apparatus, methods, and articles of manufacture described herein are not limited in this regard.

Figure 44:
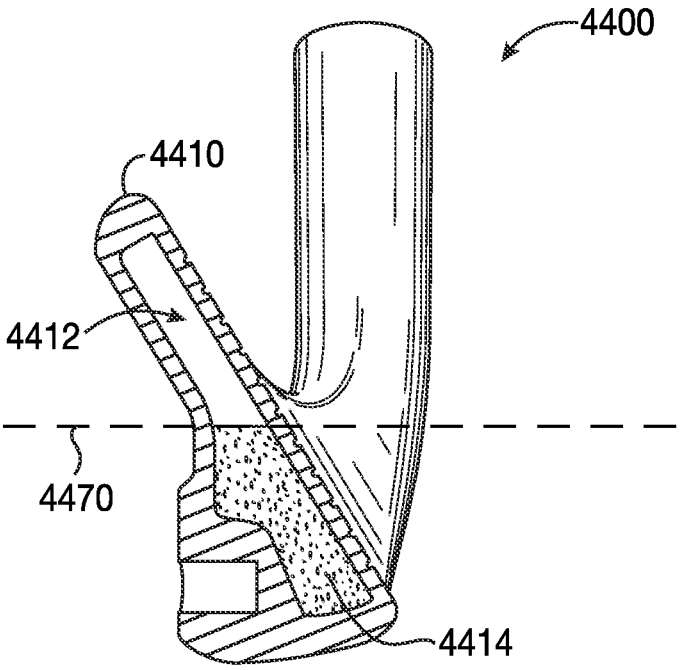
FIG. 44 is a perspective cross-sectional view of a golf club head according to an embodiment of the apparatus, methods, and articles of manufacture described herein.

As illustrated in FIG. 44, for example, the interior cavity 4412 of a body portion 4410 of the golf club head 4400, which may be similar to any of the golf club heads described herein, may be filled with a thermoset material 4414 (e.g., epoxy material) below the horizontal midplane 4470 of the golf club head 4400. In another example, the interior cavity 4412 of the golf club head 4400 or any of the golf club heads described herein may be filled with a thermoset material (e.g., epoxy material) above the horizontal midplane 4470 (not shown). In yet another example, the interior cavity 4412 of the golf club head 4400 or any of the golf club heads described herein may be filled with a thermoset material (e.g., epoxy material) above and below the horizontal midplane 4470 and yet have regions in the interior cavity 4412 that may not include any thermoset materials or include other materials (not shown). The apparatus, methods, and articles of manufacture described herein are not limited in this regard.

Figure 45:
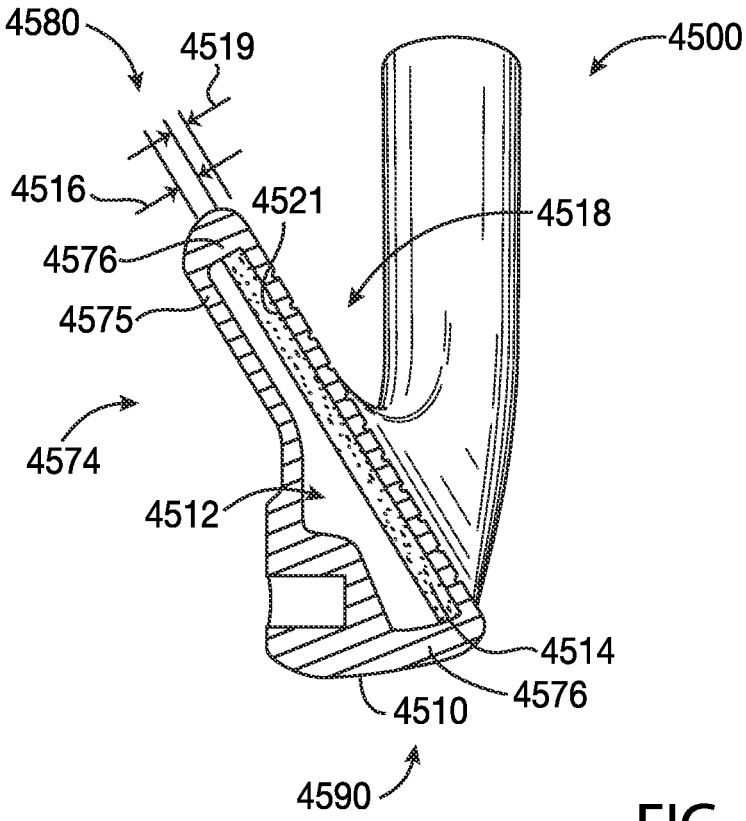
FIG. 45 is a perspective cross-sectional view of a golf club head according to an embodiment of the apparatus, methods, and articles of manufacture described herein.

As shown in FIG. 45, for example, a golf club head 4500, which may be similar to any of the golf club heads described herein, may include a body portion 4510 with an interior cavity 4512 having a width 4516 of a thermoset material 4514. The width 4516 may be related to face portion thickness 4519 of the face portion 4518 by the following expression:

$$W_{th}=aT_f \tag{6}$$

Where:

$0.5 \le a \le 5.0$ $W_{th}$ is the width of the thermoset material in inches, and $T_f$ is the thickness of the face portion in inches.

In one example, the width 4516 of the thermoset material 4514 may be greater than or equal to half the face portion thickness 4519. In another example, the width 4516 of the thermoset material 4514 may be greater than or equal to the face portion thickness 4519 (e.g., $W_{th} \ge T_f$). In yet another example, the width 4516 of the thermoset material 4514 may be greater than or equal to twice the face portion thickness 4519 (e.g., $W_{th} \ge T_f$). In another example, the width 4516 of the thermoset material 4514 may be greater than or equal to three times the face portion thickness 4519 (e.g., $W_{th} \ge T_f$). In yet another example, the width 4516 of the thermoset material 4514 may be greater than five times the face portion thickness 4519 (e.g., $W_{th} \ge T_f$). In yet another example, the width 4516 of the thermoset material 4514 may be greater than or equal to the face portion thickness 4519 and less than or equal to three times the face portion thickness 4519 (e.g., $T_f \le W_{th} \le T_f$). The apparatus, methods, and articles of manufacture described herein are not limited in this regard.

In one example, for any of the golf club heads described herein, the mass of a thermoset material partially, substantially, or entirely filling the interior cavity may be related to the mass of the golf club head by the following expression:

$$0.03 \le \frac{m_T}{m_H} \le 0.2 \tag{7}$$

Where:

$m_T$ is the mass of the thermoset material in grams, and $m_H$ is the mass of the golf club head in grams.

According to the above equation, a ratio of the mass of the thermoset material and the mass of the golf club head may be greater than or equal to 0.03 and less than or equal to 0.2. The apparatus, methods, and articles of manufacture described herein are not limited in this regard.

A thermoset material partially, substantially, or entirely filling the interior cavity may have a certain Shore D hardness to provide vibration and noise dampening and/or structurally support a relatively thin face portion of a golf club head. In one example, a thermoset material partially, substantially, or entirely filling the interior cavity may have a Shore D hardness of at least 45. In another example, a thermoset material partially, substantially, or entirely filling the interior cavity may have a Shore D hardness of greater than or equal to 45 and less than or equal to 80. In another example, a thermoset material partially, substantially, or entirely filling the interior cavity may have a Shore D hardness of greater than or equal to 50 and less than or equal to 70. In yet another example, a thermoset material partially, substantially, or entirely filling the interior cavity may have a Shore D hardness of greater than or equal to 55 and less than or equal to 65. In yet another example, a thermoset material partially, substantially, or entirely filling the interior cavity may have a Shore D hardness of greater than or equal to 55 and less than or equal to 75. The apparatus, methods, and articles of manufacture described herein are not limited in this regard.

A thermoset material partially, substantially, or entirely filling the interior cavity may have a certain density to provide vibration and noise dampening and/or structurally support a relatively thin face portion of a golf club head. In one example, a thermoset material partially, substantially, or entirely filling the interior cavity may have a density of greater than or equal to 1.0 grams per cubic centimeter ($g/cm^3$) and less than or equal to 2.0 $g/cm^3$. In another example, a thermoset material partially, substantially, or entirely filling the interior cavity may have a density of greater than or equal to 1.1 $g/cm^3$ and less than or equal to 1.5 $g/cm^3$. In yet another example, a thermoset material partially, substantially, or entirely filling the interior cavity may have a density of greater than or equal to 1.0 $g/cm^3$ and less than or equal to 1.4 $g/cm^3$. In yet another example, a thermoset material partially, substantially, or entirely filling the interior cavity may have a density of greater than or equal to 1.1 $g/cm^3$ and less than or equal to 1.2 $g/cm^3$. The apparatus, methods, and articles of manufacture described herein are not limited in this regard.

The polymer material (e.g., the thermoset material 4514 as shown in FIG. 45) may be located adjacent to the back surface 4521 of the face portion 4518. For example, the thermoset material 4514 may be attached and/or bonded directly to the back surface 4521 of the face portion 4518. Alternatively, the thermoset material 4514 may be located away from the face portion 4518. In one example, the thermoset material 4514 be attached and/or bonded to the back-wall portion 4575 of the back portion 4574. As a result, the thermoset material 4514 may not be in contact with the back surface 4521 of the face portion 4518. While the examples herein describe a polymer material such as the thermoset material 4514 being attached and/or bonded to various surfaces and/or wall portions of the golf club head 4500, or suspended in the interior cavity 4512, the thermoset material 4514 may be attached and/or bonded to more or less surfaces and/or wall portions. The apparatus, methods, and articles of manufacture described herein are not limited in this regard.

Figure 46:
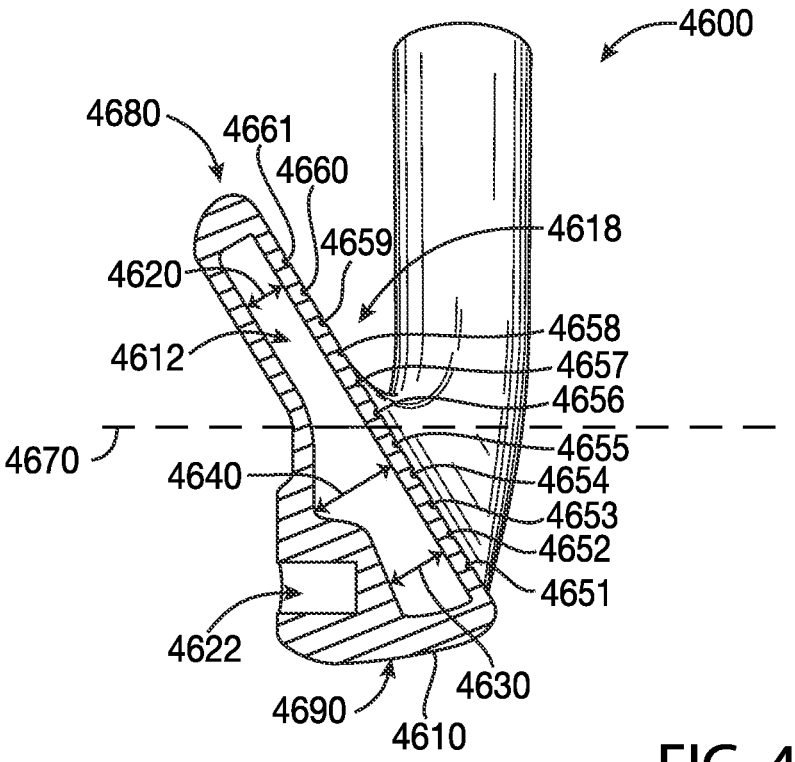
FIG. 46 is a perspective cross-sectional view of a golf club head according to an embodiment of the apparatus, methods, and articles of manufacture described herein.

As shown in FIG. 46, for example, a golf club head 4600, which may be similar to any of the golf club heads described herein, may have a body portion 4610 include an internal cavity 4612 having an internal cavity width that may vary between the top portion 4680 and the sole portion 4690. In particular, the internal cavity 4612 may include a first width 4620 ($W_1$) above a horizontal midplane 4670 of the golf club head 4600, a second width 4630 ($W_2$) below the horizontal midplane 4670, and a third width 4640 ($W_3$) between the first width 4620 and the second width 4630. The third width 4640 may be at or below the horizontal midplane 4670. In one example, the third width 4640 may be above one or more ports (e.g., one generally shown as 4622). Accordingly, the third width 4640 may be located above one or more mass portions (not shown in FIG. 46 but for example, a mass portion disposed in the port 4622) and/or be closer to the horizontal midplane 4670 than one or more mass portions. In another example, the third width 4640 may be above one or more ports of the golf club head 4500 and below the horizontal midplane 4670. The third width 4640 may be greater than the first width 4620 (e.g., $W_3>W_1$) and greater than the second width 4630 (e.g., $W_3>W_2$). In one example, the first width 4620 may be greater than or equal to the second width 4630 (e.g., $W_2\geq W_1$). In another example, the second width 4630 may be greater than or equal to the first width 4620 (e.g., $W_1\geq W_2$). In yet another example, the third width 4640 may be no more than three times the second width 4630. In yet another example, the third width 4640 may be no more than twice the second width 4630. In yet another example, the third width 4640 may be no more than 1.5 times the second width 4630. In yet another example, the third width 4640 may be no more than 1.38 times the second width 4630. The apparatus, methods, and articles of manufacture described herein are not limited in this regard.

The third width 4640 may be at a certain vertical location of the body portion 4610. The face portion 4618 of the golf club head 4600 may include a plurality of grooves. The face portion 4618 of the golf club head 4600 may include a similar number of grooves as the golf club head 100 of FIG. 1. Accordingly, the face portion 4618 may include a plurality of grooves (e.g., eleven grooves are generally shown as grooves 4651, 4652, 4653, 4654, 4655, 4656, 4657, 4657, 4659, 4660, and 4661 in FIG. 46). The third width 4640 may be located between any of the plurality of grooves. In one example, the third width 4640 may be located between the first groove 4651 and the eleventh groove 4661 from the sole portion 4690. In another example, the third width 4640 may be located between the fourth groove 4654 and the eighth groove 4658 from the sole portion 4690. In yet another example, the third width 4640 may be located between the fifth groove 4655 and the seventh groove 4657 from the sole portion 4690. Although FIG. 46 may depict the first, second, and third widths 4620, 4630, and 4640, respectively, of the internal cavity 4612 relative to the loft plane (e.g., one generally shown as 1040 in FIG. 3) associated with the face portion 4618 (e.g., normal to the loft plane), one or more widths may be measured relative to the ground plane (e.g., one generally shown as 1010 in FIG. 1). For example, one or more widths of the internal cavity 4612 may be substantially parallel to the ground plane (e.g., one generally shown as 1010 in FIG. 1). The apparatus, methods, and articles of manufacture described herein are not limited in this regard.

Figure 47:
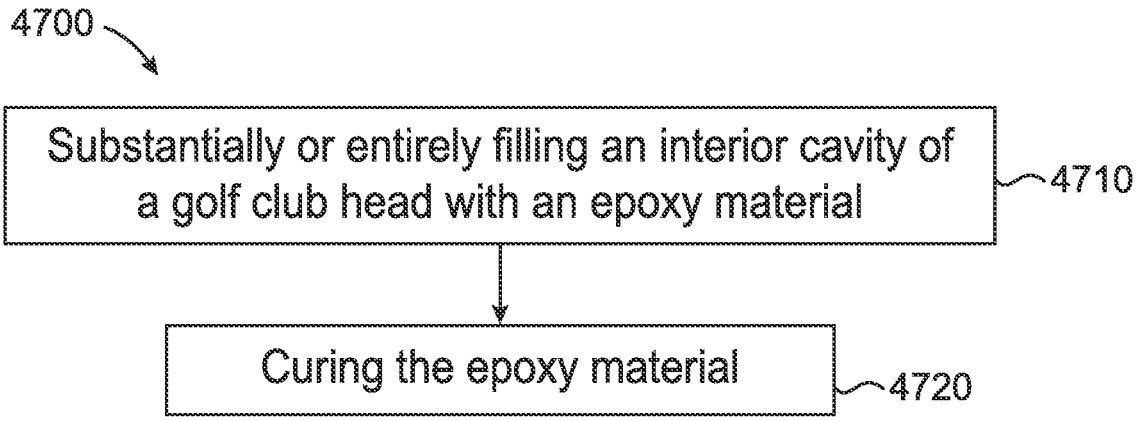
FIG. 47 depicts a manner in which an example golf club head described herein may be manufactured.
Figure 48:
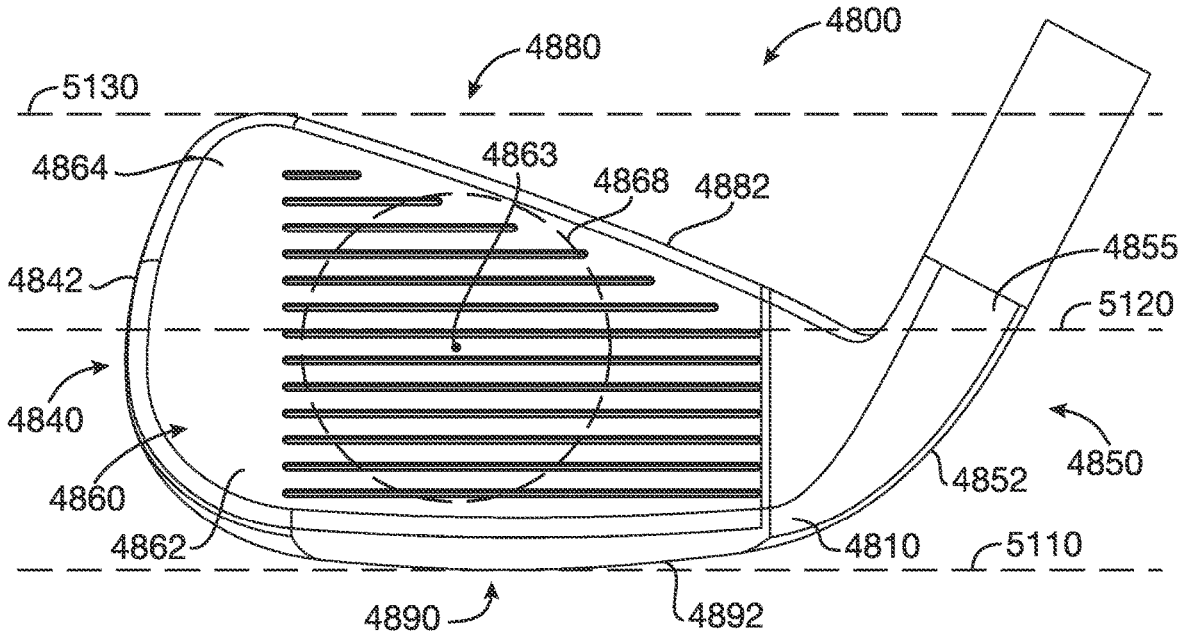
FIGS. 48, 49, 50, 51, 52, and 53 depict a perspective front view, a perspective back view, a perspective front view shown without a face portion, a perspective cross-sectional view (along line 51-51 of FIG. 49), a perspective cross-sectional view (along line 52-52 of FIG. 49), and a perspective cross-sectional view (along line 53-53 of FIG. 49), respectively, of a golf club head according to an embodiment of the apparatus, methods, and articles of manufacture described herein.
Figure 49:
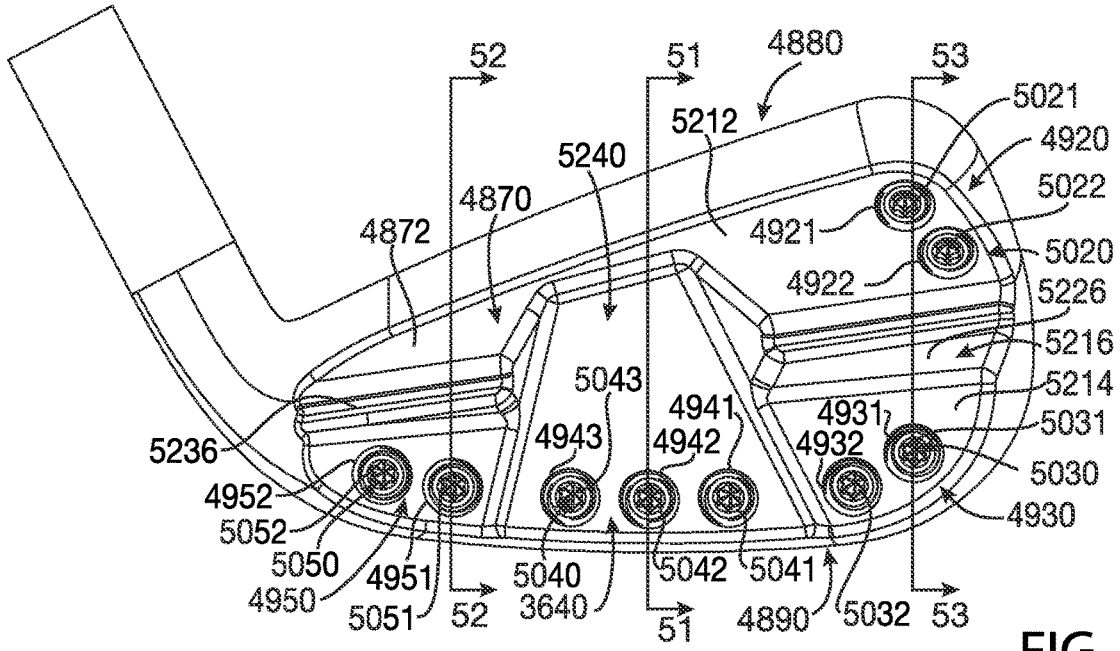

In one example, the process of filling the interior cavity of the golf club head may not include applying a bonding portion to the back surface of the face portion. For example, as shown in FIG. 47, the process 4700 of filling the interior cavity of the golf club head may include partially, substantially, or entirely filling the interior cavity with an epoxy material (block 4710), and then curing the epoxy material (block 4720). The epoxy material may be injected into the interior cavity from one or more ports on the body portion of a golf club head as described herein. In one example, the process of curing the epoxy material may include using heat, radiation, and/or pressure for a certain period of time. In another example, the process of curing the epoxy material may only include allowing the epoxy material to cure at ambient or room temperature for a certain period of time. In another example, the process of filling the interior cavity of the golf club head may include applying a first epoxy material to the back surface of the face portion, curing the first epoxy material to a first cure state as described herein, filling the interior cavity with a second epoxy material that may be the same as or different from the first epoxy material, and curing the first epoxy material to the second cure state and curing the second epoxy material as described herein. In another example, more than two epoxy materials can be used to substantially or fully fill the interior cavity with single or multiple curing processes used for each epoxy material. The apparatus, methods, and articles of manufacture described herein are not limited in this regard.

In the example of FIGS. 48-53, a golf club head 4800 may include a body portion 4810 having a toe portion 4840 with a toe portion edge 4842, a heel portion 4850 with a heel portion edge 4852 that may include a hosel portion 4855 configured to receive a shaft (not shown) with a grip (not shown) on one end and the golf club head 4800 on the opposite end of the shaft to form a golf club, a front portion 4860 with a perimeter edge portion 4861, a back portion 4870 with a back wall portion 4872, a top portion 4880 with a top portion edge 4882, and a sole portion 4890 with a sole portion edge 4892. The toe portion 4840, the heel portion 4850, the front portion 4860, the back portion 4870, the top portion 4880, and/or the sole portion 4890 may partially overlap each other. The toe portion edge 4842, the heel portion edge 4852, the top portion edge 4882, and the sole portion edge 4892 may define a periphery of the body portion 4810. The apparatus, methods, and articles of manufacture described herein are not limited in this regard.

The golf club head 4800 may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees (°), 48°, 52°, 56°, 60°, etc.). Although FIGS. 48-53 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The volume of the golf club head 4800, the materials of construction of the golf club head 4800, and/or any components thereof may be similar to any of the golf club heads described herein and/or described in any of the incorporated by reference applications. The apparatus, methods, and articles of manufacture described herein are not limited in this regard.

The golf club head 4800 may include a face portion 4862 (i.e., the strike face), which may be integrally formed with the body portion 4810 (e.g., a single unitary piece). In one example, as shown in FIGS. 48-53, the face portion 4862 may be a separate piece coupled (e.g., adhesively, mechanically, by welding, and/or by soldering) to the front portion 4860. The face portion 4862 may include a front surface 4864 and a back surface 4866. In one example (not shown), the front portion 4860 may include one or a plurality of recessed shoulders configured to receive the face portion 4862 for attachment of the face portion 4862 to the body portion 4810. In another example, as shown in FIGS. 48-53, the back surface 4866 may include a perimeter portion 4867 that may be attached to a perimeter edge portion 4861 of the body portion 4810. The perimeter portion 4867 of the face portion 4862 may be attached to the perimeter edge portion 4861 of the body portion 4810 by one or more fasteners, one or more adhesive or bonding agents, and/or welding or soldering. In one example, as shown in FIGS. 48-53, the perimeter portion 4867 of the face portion 4862 may be welded to the perimeter edge portion 4861 of the body portion 4810 at one or more locations. Alternatively, the entire perimeter portion 4867 of the face portion 4862 may be welded to the entire perimeter edge portion 4861 of the body portion 4810 (i.e., a continuous weld). The face portion 4862 may include a ball strike region 4868 to strike a golf ball. In one example, the center of the ball strike region 4868 may be a geometric center 4863 of the face portion 4862. In another example, the geometric center 4863 of the face portion 4862 may be offset from a center of the ball strike region 4868. In one example, the geometric center 4843 and one or more regions near and/or surrounding the geometric center within the ball strike region 4868 may provide a generally optimum location (i.e., optimum ball distance, ball speed, ball spin characteristics, etc.) on the face portion 4862 for striking a golf ball. In yet another example, any location at or near the geometric center 4863 and within the ball strike region 4868 may provide a generally optimum location on the face portion 4862 for striking a golf ball. However, a ball may be struck with any portion of the face portion 4862 within the ball strike region 4868 or outside the ball strike region 4868 for any of the golf club heads described herein resulting in certain ball flight characteristics different from an on-center hit that may be preferred by an individual. The configuration of the face portion 4862 and the attachment of the face portion 4862 (e.g., welding) to the body portion 4810 may be similar in many respects to any of the golf club heads described herein and/or described in any of the incorporated by reference applications. The apparatus, methods, and articles of manufacture described herein are not limited in this regard.

The golf club head 4800 may be associated with a ground plane 5110, a horizontal midplane 5120, and a top plane 5130. In particular, the ground plane 5110 may be a plane that is parallel or substantially parallel to the ground and is tangent to the lowest portion of the sole portion edge 4892 when the golf club head 4800 is at an address position (e.g., the golf club head 4800 aligned to strike a golf ball). A top plane 5130 may be a plane that is tangent to the upper most portion of top portion edge 4882 when the golf club head 4800 is at the address position. The ground and top planes 5110 and 5130, respectively, may be parallel or substantially parallel to each other. The horizontal midplane 5120 may be vertically halfway between the ground and top planes 5110 and 5130, respectively. Further, the golf club head 4800 may be associated with a loft plane 5140 defining a loft angle 5145 ($\alpha$) of the golf club head 4800. The loft plane 5140 may be a plane that is tangent to the face portion 4862. The loft angle 5145 may be defined by an angle between the loft plane 5140 and a vertical plane 5150 normal to the ground plane 5110.

The body portion 4810 may be a hollow body including an interior cavity 4910 having inner walls 4912. The interior cavity 4910 may extend between the front portion 4860, the back portion 4870, the top portion 4880, and the sole portion 4890. In the example of FIGS. 48-53, the interior cavity 4910 of the body portion 4810 may be enclosed with and partially defined with the face portion 4862. The configuration of the interior cavity 4910 (e.g., height, width, volume, shape, etc.), the configuration of the interior cavity 4910 relative to the body portion 4810 (e.g., volume of the interior cavity 4910 relative to the volume of body portion 4810), the width and height variation of the interior cavity 4910, and access to the interior cavity 4910 from one or more ports on the body portion 4810 may be similar to any of the golf club heads described herein and/or described in any of the incorporated by reference applications. The apparatus, methods, and articles of manufacture described herein are not limited in this regard.

The back wall portion 4872 of the back portion 4870 may include an upper back wall portion 5212 and a lower back wall portion 5214. The back wall portion 4872 may include a ledge portion 5216 that may extend between the toe portion edge 4842 and the heel portion edge 4852 in a continuous or discontinuous manner. The lower back wall portion 5214 may be located farther back on the body portion 4810 than the upper back wall portion 5212, with the ledge portion 5216 defining a transition portion between the upper back wall portion 5212 and the lower back wall portion 5214. Accordingly, the ledge portion 5216 may extend transverse to the upper back wall portion 5212 and the lower back wall portion 5214. In one example, as shown in FIGS. 48-53, the ledge portion 5216 may include a first ledge portion 5226 and a second ledge portion 5236. The first ledge portion 5226 may extend on the back wall portion from the toe portion edge 4842 to a back wall center portion 5240 of the back wall portion 4872. The second ledge portion 5236 may extend from the center portion 5240 of the back wall portion 4872 to the heel portion edge 4852. As shown in FIGS. 48-53, the ledge portion 5216 may provide for a relatively greater mass below the horizontal midplane 5120 and the mass of the body portion 4810 below the horizontal midplane 5120 to be moved farther back on the body portion 4810. The width of the ledge portion 5216 may be greater than, equal to, or less than the width of the interior cavity at certain locations of the body portion 4810. The configuration of the ledge portion 5216 (e.g., width, segments, tapering, shape, etc.) and the properties of the ledge portion 5216 relative to the width of the interior cavity may be similar to any ledge portion or similar structure of any of the golf club heads described herein and/or described in any of the incorporated by reference applications. The apparatus, methods, and articles of manufacture described herein are not limited in this regard.

The body portion 4810 may include one or more ports, which may be exterior ports and/or interior ports (e.g., located inside the body portion 4810). The inner walls 4912 of the interior cavity 4910 may include one or more ports (not shown). In one example, as shown in FIGS. 48-53, the back portion 4870 may include one or more ports along or proximate to a periphery of the body portion 4810. For example, the body portion 4810 may include a first set of ports 4920 (e.g., shown as ports 4921 and 4922), a second set of ports 4930 (e.g., shown as ports 4931 and 4932), a third set of ports 4940 (e.g., shown as ports 4941, 4942, and 4943), and a fourth set of ports 4950 (e.g., shown as ports 4951 and 4952). The locations, spacing relative to other ports, and any other configuration of each port of the first set of ports 4920, the second set of ports 4930, the third set of ports 4940, and/or the fourth set of ports 4950 may be similar in many respects to any of the ports described herein or described in any of the incorporated by reference applications. Further, any one or more of the ports of the first set of ports 4920, the second set of ports 4930, the third set of ports 4940, and/or the fourth set of ports 4950 may be connected to interior cavity 4910 through which one or more filler materials may be injected into the interior cavity 4910. In the example of FIGS. 48-53, the ports 4921, 4931, and 4951 may be connected to the interior cavity 4910 via openings 4961, 4971, and 4981, respectively. The apparatus, methods, and articles of manufacture described herein are not limited in this regard.

Each port of the first set of ports 4920 may be separated by a distance less than the port diameter of any of the ports of the first set of ports 4920. Each port of the second set of ports 4930 may be separated by a distance less than the port diameter of any of the ports of the second set of ports 4930. Each port of the third set of ports third set of ports 4940 may be separated by a distance less than the port diameter of any of the ports of the third set of ports 4940. Each port of the fourth set of ports 4950 may be separated by a distance less than the port diameter of any of the ports of the third set of ports 4950. In one example, the first set of ports 4920 and the second set of ports 4930 may be spaced apart by a distance greater than the port diameter of any of the ports of the first set of ports 4920 and the second set of ports 4930. In another example, the second set of ports 4930 and the third set of ports 4940 may be spaced apart by a distance greater than the port diameter of any of the ports of the second set of ports 4930 and the third set of ports 4940. In yet another example, the third set of ports 4940 and the fourth set of ports 4945 may be spaced apart by a distance greater than the port diameter of any of the ports of the third set of ports 4940 and the fourth set of ports 4950. The apparatus, methods, and articles of manufacture described herein are not limited in this regard.

Although the figures may depict the ports as separate and individual parts, each set or a combination of adjacent sets of ports of the first, second, third, and fourth sets of ports 4920, 4930, 4940, and 4950, respectively, may be a single port. In one example, all ports of the first set of ports 4920 may be combined into a single port (e.g., a first port). In another example, all ports of the second set of ports 4930 may be combined into a single port (e.g., a second port). In another example, all ports of the third set of ports 4940 may be combined into a single port (e.g., a third port). In yet another example, all ports of the fourth set of ports 4950 may be combined into a single port (e.g., a fourth port). While the figures may depict a particular number of ports, the apparatus, methods, and articles of manufacture described herein may include more or a smaller number of ports.

The body portion 4810 may include one or more mass portions (e.g., weight portion(s)), which may be integral mass portion(s) or separate mass portion(s) that may be coupled to the body portion 4810. In the illustrated example as shown in FIGS. 48-53, the body portion 4810 may include a first set of mass portions 5020 (e.g., shown as mass portions 5021 and 5022), a second set of mass portions 5030 (e.g., shown as mass portions 5031 and 5032), a third set of mass portions 5040 (e.g., shown as mass portions 5041, 5042, and 5043), and a fourth set of mass portions 5050 (e.g., shown as mass portions 5051 and 5052). While the above example may describe a particular number or portions of mass portions, a set of mass portions may include a single mass portion, or a plurality of mass portions as described in any of the incorporated by reference applications. For example, any one or a combination of adjacent sets of mass portions of the first set of mass portions 5020 may be a single mass portion, the second set of mass portions 5030 may be a single mass portion, the third set of mass portions 5040 may be a single mass portion, and/or the fourth set of mass portions 5050 may be a single mass portion. Further, the first set of mass portions 5020, the second set of mass portions 5030, the third set of mass portions 5040, and/or the fourth set of mass portions 5050 may be a portion of the physical structure of the body portion 4810. The mass portions of the first set of mass portions 5020, the second set of mass portions 5030, the third set of mass portions 5040, and/or the fourth set of mass portions 5050 may be similar to any of the mass portions described herein or described in any of the incorporated by reference applications. The apparatus, methods, and articles of manufacture described herein are not limited in this regard.

The interior cavity 4910 may be partially or entirely filled with one or more filler materials (i.e., a cavity filling material), which may include one or more similar or different types of materials. In one example, as shown in FIGS. 48-53, the interior cavity 4910 may be filled with a first filler material 5112 and a second filler material 5114. The first filler material 5112 and the second filler material 5114 may be similar to any of the filler materials described herein or described in any of the incorporated by reference applications. The apparatus, methods, and articles of manufacture described herein are not limited in this regard.

The first filler material 5112 may be coupled to all or portions of the inner walls 4912 of the interior cavity 4910. In one example, the first filler material 5112 may have inherent adhesive or bonding properties to attach to all or portions of the inner walls 4912. In another example, the first filler material 5112 may be attached to all or portions of the inner walls 4912 with one or more bonding agents or adhesives that may be mixed with the first filler material 5112. In another example, the first filler material 5112 may be attached to all or portions of the inner walls 4912 with one or more bonding agents or adhesives that may be separate from the first filler material 5112. In yet another example, the first filler material 5221 may be attached to all or portions of the inner walls 4912 with the second filler material 5114. The apparatus, methods, and articles of manufacture described herein are not limited in this regard.

In one example, as shown in FIGS. 48-53, the first filler material 5112 may be coupled to at least a portion of the inner walls 4912 that may generally correspond to the ball strike region 4868 of the face portion 4862 (i.e., the first filler material 5112 may be generally located behind the ball strike region 4868) or regions proximate to and/or surrounding the ball strike region 4868 of the face portion 4862. In another example, the first filler material 5112 may be coupled to at least 10% of the inner walls 4912. In another example, the first filler material 5112 may be coupled to at least 25% of the inner walls 4912. In yet another example, the first filler material 5112 may be coupled to between 25% and 50% of the inner walls 4912. In another example, the first filler material 5112 may be coupled to between 35% and 75% of the inner walls 4912. In yet another example, the first filler material 5112 may be coupled to between 50% and 90% of the inner walls 4912. In yet another example, the first filler material 5112 may be coupled to more than 75% of the inner walls 4912. In yet another example, the first filler material 5112 may be coupled to all inner walls 4912. The apparatus, methods, and articles of manufacture described herein are not limited in this regard.

The amount of the first filler material 5112 that may be coupled to the inner walls 4912 may depend on the loft angle of the golf club head, the overall thickness of the face portion 4862, the thickness profile of the face portion 4862, the shape of the interior cavity 4910, the locations and configurations of any ports or mass portions, the material properties of the first filler material 5112, and/or the material properties of the second filler material 5114. In one example, a golf club head with a relatively high loft angle may limit the portions of the inner walls 4912 to which the first filler material 5112 may be coupled. In another example, a golf club head with a relatively small loft angle may allow the first filler material 5112 to be coupled to all or substantial portions of the inner walls 4912. In yet another example, the acoustic properties of a golf club head may be a factor in determining the amount of filler material 5112 that may be coupled to the inner walls 4912 to provide a pleasing sound and feel to an individual. The amount (i.e., volume and/or mass) of the first filler material 5112 coupled to the inner walls 4912 may be determined for each golf club head (i.e., having a certain loft angle) to (i) provide vibration dampening or sound dampening (e.g., consistent and/or pleasing sound and feel when the golf club head 4800 strikes a golf ball as perceived by an individual using the golf club head 4800), (ii) provide structural support for the face portion 4862, and/or (iii) optimize ball travel distance, ball speed, ball launch angle, ball spin rate, ball peak height, ball landing angle and/or ball dispersion. The apparatus, methods, and articles of manufacture described herein are not limited in this regard.

In the example of FIGS. 48-53, a central portion 4911 of the interior cavity 4910, which may be a portion of the interior cavity 4910 that may generally correspond to the ball strike region 4868, may include the first filler material 5112 and the second filler material 5114. The width 4913 of the interior cavity 4910 at the central portion 4911 of the interior cavity 4910 may be generally greater than the width 4913 of the interior cavity 4910 at other portions of the interior cavity 4910. Accordingly, the region of the interior cavity 4910 behind the ball strike region 4868, i.e., the central portion 4911, may include a relatively large volume of the first filler material 5112 and/or the second filler material 5114. Further, the configuration of the central portion 4911 (i.e., size, shape, contour, volume, etc.) may depend on the loft angle 5145. For example, a golf club head 4800 with a relatively small loft angle 5145 may have a larger central portion 4911 (i.e., larger volume, depth, height, etc.) than a golf club head 4800 with a relatively large loft angle 5145. Accordingly, as described herein, the amount of first filler material 5112 and/or the second filler material 5114 inside the interior cavity 4910, and more specifically, in the central portion 4911 may be determined based on the loft angle 5145 to provide (i) provide vibration dampening or sound dampening (e.g., consistent and/or pleasing sound and feel when the golf club head 4800 strikes a golf ball as perceived by an individual using the golf club head 4800), (ii) provide structural support for the face portion 4862, and/or (iii) optimize ball travel distance, ball speed, ball launch angle, ball spin rate, ball peak height, ball landing angle and/or ball dispersion. The apparatus, methods, and articles of manufacture described herein are not limited in this regard.

The contour of the interior cavity 4910 or the shape of the inner walls 4912 may be defined by a plurality of recessed portions that are recessed relative to the perimeter edge portion 4861. In the example of FIGS. 48-53, the interior cavity 4910 may include a first recessed portion 4914, a second recessed portion 4915 that may have a generally smaller depth (i.e., interior cavity width 4913 as viewed in cross section in FIGS. 51-53) relative to the first recessed portion 4914, a third recessed portion 4916 that may have a generally smaller depth than the second recessed portion 4915, a fourth recessed portion 4917 that may have a generally smaller depth than the third recessed portion 4916, and a fifth recessed portion 4918 that may have a generally smaller depth than the fourth recessed portion 4917. The interior cavity 4910 may have more or less recessed portions. The apparatus, methods, and articles of manufacture described herein are not limited in this regard.

The first recessed portion 4914 may generally include the largest width 4913 of the interior cavity 4910 and may be located at the central portion 4911 and/or may include portions that are adjacent to or surround the central portion 4911. The second recessed portion 4915 may be adjacent to all or portions of the first recessed portion 4914 and may include portions that may be in the central portion 4911. In the example of FIGS. 48-53, the second recessed portion 4915 is located below the first recessed portion 4914. A portion of the structure of the body portion 4810 that includes the third set of ports 4940 may be between the second recessed portion 4915 and the lower back wall portion 5214. Accordingly, the depth of the second recessed portion 4915 may be less than the depth of the first recessed portion 4914 so that the body portion 4810 can accommodate the third set of ports 4940 between the second recessed portion 4915 and the lower back wall portion 5214. The apparatus, methods, and articles of manufacture described herein are not limited in this regard.

The third recessed portion 4916 may be adjacent to and/or surround all or portions of the second recessed portion 4915 and/or the first recessed portion 4914 and may include portions that may be in the central portion 4911. In the example of FIGS. 48-53, the third recessed portion 4916 surrounds the first recessed portion 4914 above the horizontal midplane 5120. The fourth recessed portion 4917 may be at or proximate to the perimeter edge portion 4861, and/or may be adjacent to and/or surround all or portions of the third recessed portion 4916, the second recessed portion 4915, and/or the first recessed portion 4914. In the example of FIGS. 48-53, the fourth recessed portion 4917 is adjacent to portions of the first recessed portion 4914 and the second recessed portion 4915 below the horizontal midplane 5120. A portion of the structure of the body portion 4810 that includes the second set of ports 4930 and the fourth set of ports 4950 may be between the fourth recessed portion 4917 and the lower back wall portion 5214. Accordingly, the depth of the fourth recessed portion 4917 may be less than the depths of the first recessed portion 4914 and the second recessed portion 4915 so that the body portion 4810 can accommodate the second set of ports 4930 and the fourth set of ports 4950 between the fourth recessed portion 4917 and the lower back wall portion 5214. The apparatus, methods, and articles of manufacture described herein are not limited in this regard.

The fifth recessed portion 4918 may be adjacent to the perimeter edge portion 4861. Accordingly, at any location in the interior cavity 4910 that includes the fifth recessed portion 4918, the fifth recessed portion 4918 may be between the perimeter edge portion 4861 and any one or more of the first recessed portion 4914, the second recessed portion 4915, the third recessed portion 4916, and the fourth recessed portion 4917. A portion of the structure of the body portion 4810 that includes the first set of ports 4920 may be between the fifth recessed portion 4918 and the upper back wall portion 5212. Accordingly, the depth of the fifth recessed portion 4918 may be less than the depth of the adjacent portions of the third recessed portion 4916 so that the body portion 4810 can accommodate the first set of ports 4920 between the fifth recessed portion 4918 and the upper back wall portion 5212. The apparatus, methods, and articles of manufacture described herein are not limited in this regard.

The interior cavity 4910 may include one or more internal channels that may extend between the toe portion 4840 and the heel portion 4850. In one example, as shown in FIGS. 48-53, the interior cavity 4910 may include a first internal channel 4925 that may extend from a location at the toe portion 4840 to the central portion 4911, and a second internal channel 4926 that may extend from a location at the heel portion 4850 to the central portion 4911. The first internal channel 4925 and the second internal channel 4926 connect to the first recessed portion 4914 and may have the same depth as the first recessed portion 4914 at or proximate to the central portion 4911. The depths of the first internal channel 4925 and the second internal channel 4926 may diminish from the first recessed portion 4914 toward the toe portion 4840 and heel portion 4850, respectively. As shown in the example of FIGS. 48-53, portions of the first internal channel 4925 and/or the second internal channel 4926 that connect to the first recessed portion 4914 and/or are proximate to the first recessed portion 4914 may maintain a constant depth that may be similar to the depth of the first recessed portion 4914. Accordingly, the first internal channel 4925 and the second internal channel 4926 provide a greater volume of the first filler material 5112 and/or the second filler material 5114 between the central portion 4911 and the toe portion 4840 and the heel portion. Alternatively, all or portions of the first internal channel 4925 and/or the second internal channel 4926 may have diminishing depths in a direction toward the toe portion 4840 and the heel portion 4850, respectively. For off-center hits of a golf ball with the face portion 4862, the increased volume of the first filler material 5112 and/or the second filler material 5114 in the internal channels 4925 and 4926 may (i) provide vibration dampening or sound dampening, (ii) provide structural support for the face portion 4862, and/or (iii) optimize ball travel distance, ball speed, ball launch angle, ball spin rate, ball peak height, ball landing angle and/or ball dispersion. Further, the mass that is removed from the body portion 4810 to provide the internal channels 4925 and 4926 may be shifted to other locations on the body portion 4810 to increase and/or optimize the moment of inertia and the location of the center of gravity of the golf club head 4800. The apparatus, methods, and articles of manufacture described herein are not limited in this regard.

Figure 50:
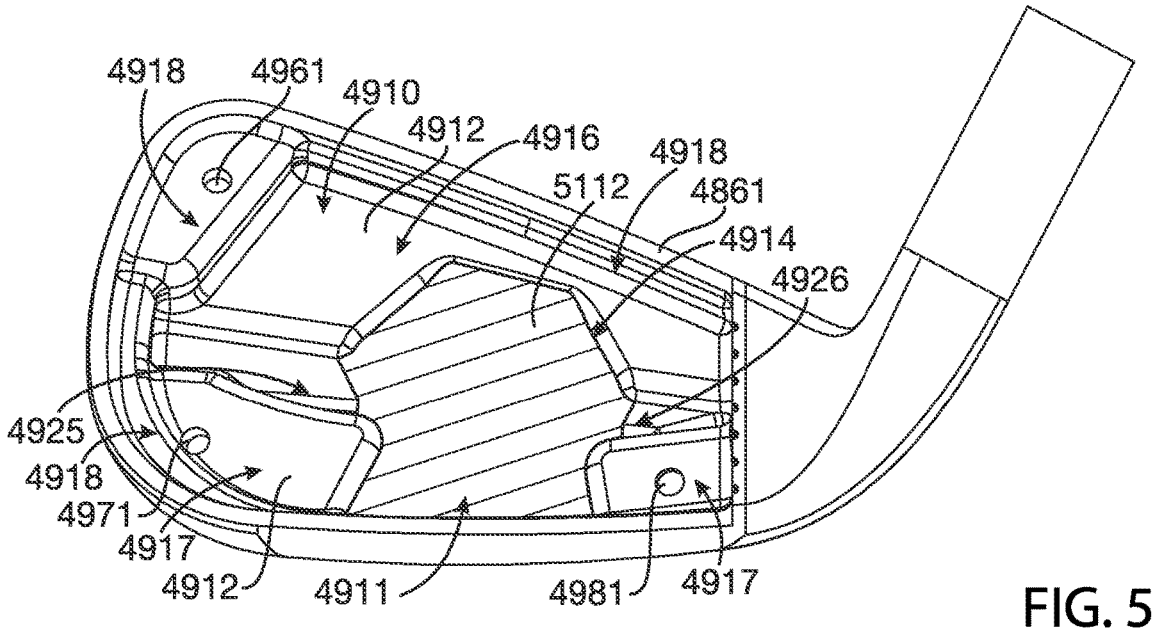
Figure 51:
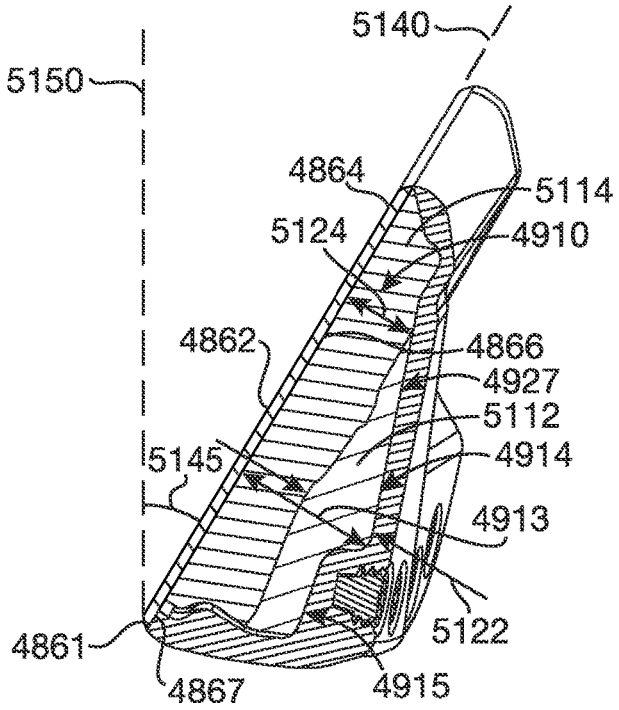
Figure 52:
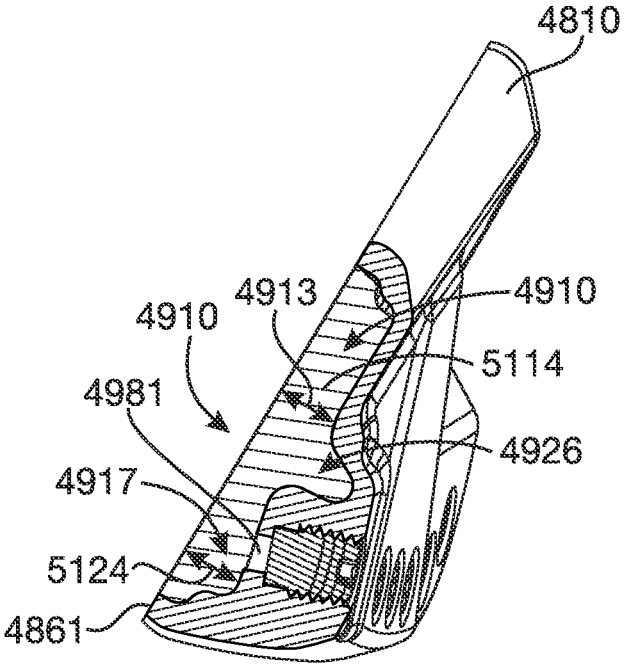
Figure 53:
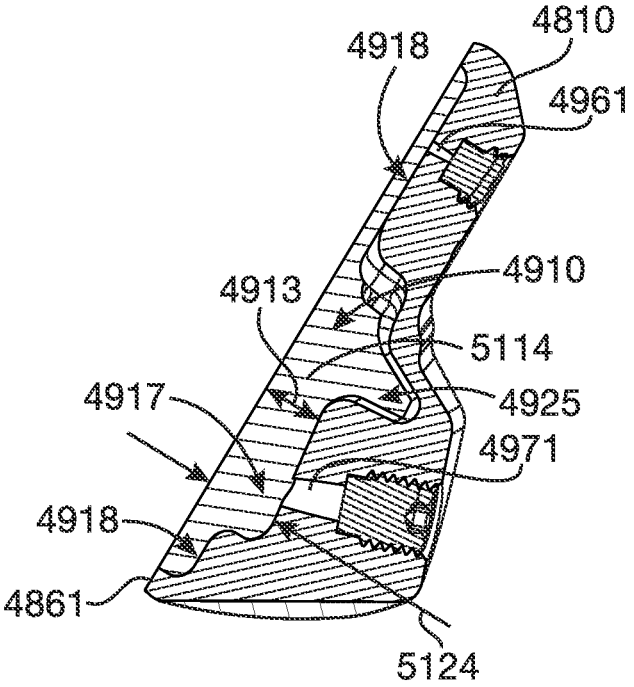
Figure 54:
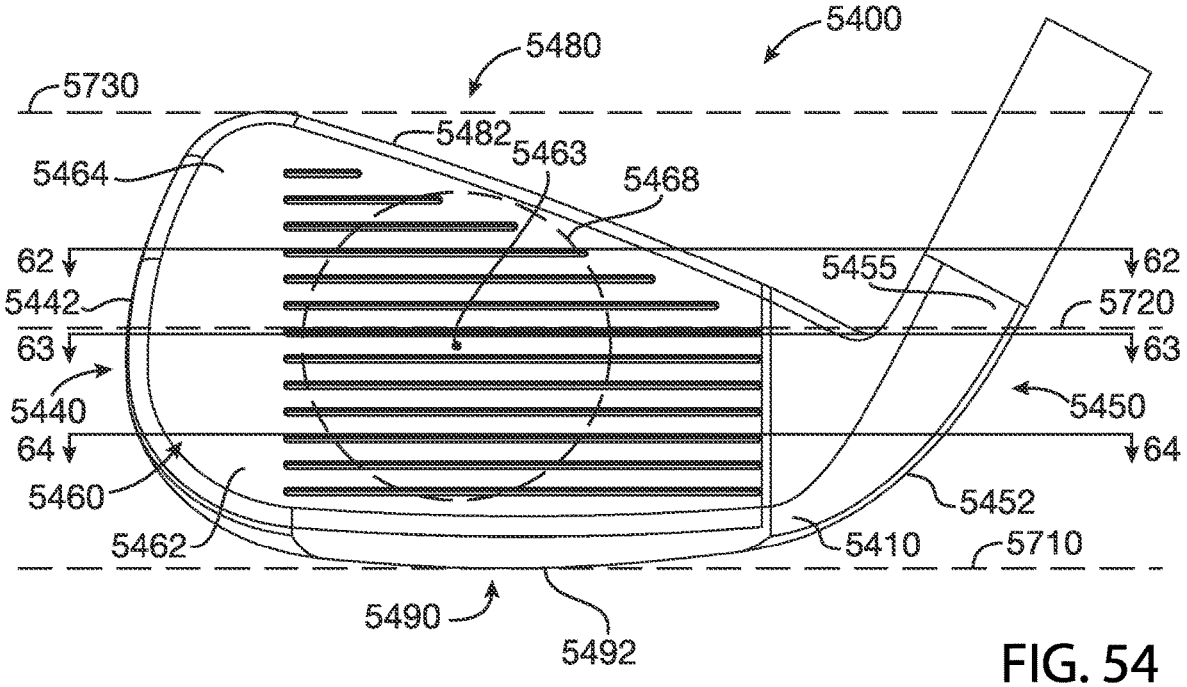
FIGS. 54, 55, 56, 57, 58, 59, 60, 61, 62, 63, 64, and 65 depict a perspective front view, a perspective back view, a perspective cross-sectional view (along line 56-56 of FIG. 55), a perspective cross-sectional view (along line 57-57 of FIG. 55), and a perspective cross-sectional view (along line 58-58 of FIG. 55), a perspective front view shown without a face portion, another perspective front view shown without a face portion, another perspective front view shown without a face portion, a perspective cross-sectional view (along line 62-62 of FIG. 54), a perspective cross-sectional view (along line 63-63 of FIG. 54), and a perspective cross-sectional view (along line 64-64 of FIG. 54), respectively, of a golf club head according to an embodiment of the apparatus, methods, and articles of manufacture described herein.
Figure 55:
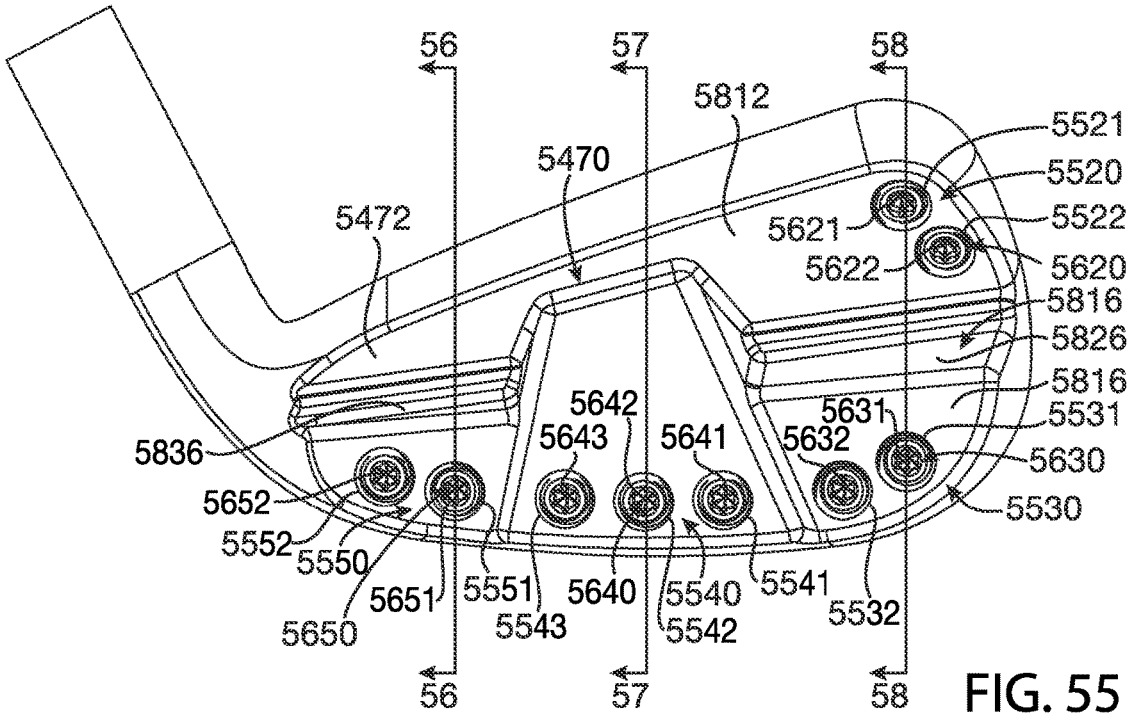

The interior cavity 4910 may include additional recessed portions that may define transition regions between the first to fifth recessed portions 4914-4918 and the internal channels 4925 and 4926. Each of the recessed portions may be adjacent to and transition into any one or several of the other recessed portions. For example, as shown in FIGS. 50-51, the first recessed portion 4914 may include an inclined surface 4927 that may transition and connect to the third recessed portion 4916 above the first recessed portion 4914. Further, any of the recessed portions may directly transition to the perimeter edge portion 4861. The recessed portions and the transition regions may collectively define the overall shape and/or contour of the interior cavity 4910. The transition regions may include walls that are perpendicular, transverse, or include relative to adjacent recessed portions. Further, the transition regions may include rounded corners when joining an adjacent recessed portion to reduce stress concentrations at the joined corner. The recessed portions may define a contoured, continuous, and/or stepped reduction of the width of the interior cavity 4910 form the central portion 4911 to the perimeter edge portion 4861. The apparatus, methods, and articles of manufacture described herein are not limited in this regard.

The shape, size, width, height, and other characteristics of the recessed portions 4914-4918 and the internal channels 4925 and 4926 may be associated with the loft angle 5145 of the golf club head 4800. In one example, as shown in FIGS. 48-53, the first recessed portion 4914 and the second recessed portion 4915 may be filled with the first filler material 5112. The first filler material 5112 may be injection molded in the first recessed portion 4914 and the second recessed portion 4915. The filler material 5112 may be bonded to the inner walls 4912 including the portions of the inner walls 4912 of the first recessed portion 4914 and the second recessed portion 4915 by having inherent adhesive or bonding properties, with a bonding agent that is mixed with the first filler material 5112, and/or a separate bonding agent. In another example, the first filler material 5112 may be separately molded in the shape of the first recessed portion 4914 and the second recessed portion 4915 and coupled to the first recessed portion 4914 and the second recessed portion 4915 with a bonding agent, and/or with the second filler material 5114. In one example, the remaining portions of the interior cavity 4910, which include the third recessed portion 4916, the fourth recessed portion 4917, and the fifth recessed portion 4918 may be filled with the second filler material 5114. Accordingly, the second filler material 5114 may be coupled to the back surface 4866 of the face portion 4862, coupled to portions of the inner walls 4912 outside the first recessed portion 4914 and the second recessed portion 4915, coupled to portions of the inner walls 4912 that are not exposed and not coupled to the first filler material 4211, and/or disposed between the face portion 4862 and the first filler material 5112. The apparatus, methods, and articles of manufacture described herein are not limited in this regard.

A width 5122 ($W_{F1}$) of the first filler material 5112 and the width 5124 ($W_{F2}$) of the second filler material 5114 may vary from the toe portion 4840 to the heel portion 4850 and/or from the top portion 4880 to the sole portion 4890 and/or according to the shapes of the first recessed portion 4914, the second recessed portion 4915, the third recessed portion 4916, the fourth recessed portion 4917, and/or the fifth recessed portion 4918 depending on the location inside the interior cavity 4910. The width 5122 of the first filler material 5112 may vary according to the shapes of the first recessed portion 4914 and the second recessed portion 4915. The width 5122 of the first filler material 5112 and/or the width 5124 of the second filler material 5114 may be constant or substantially constant at one or more locations in the interior cavity 4910 and vary at certain other locations in the interior cavity 4910. In one example, the width 5122 of the first filler material 5112 and/or the width 5124 of the second filler material 5114 may vary at one or more locations in the interior cavity 4910 similar or substantially similar to the contour of all or portions of the inner walls 4912 of the interior cavity 4910 (i.e., the contours of the recessed portions) and/or the contours of the boundaries between the first filler material 5112 and the second filler material 5114. In one example, the second filler material 5114 may (i) provide vibration dampening or sound dampening (e.g., consistent and/or pleasing sound and feel when the golf club head 4800 strikes a golf ball as perceived by an individual using the golf club head 4800), (ii) provide structural support for the face portion 4862, and/or (iii) optimize ball travel distance, ball speed, ball launch angle, ball spin rate, ball peak height, ball landing angle and/or ball dispersion. The width 5122 of the first filler material 5112 and width 5124 of the second filler material 5114 may be determined at the ball strike region 4868 and/or other regions of the interior cavity 4910 so that a relatively high or optimum coefficient of restitution (COR) is provided for the golf club head 4800. The apparatus, methods, and articles of manufacture described herein are not limited in this regard.

In one example, the first filler material 5112 may be similar to any of the first filler materials described herein such as the first filler material 4211. In another example, the first filler material 5112 may be a rubber-type of material such as a compound including a mixture of polybutadiene as a base polymer material, and a vulcanizing agent, which may be based on sulfur, peroxides, metallic oxides, acetoxysilane, or urethane crosslinkers. The added vulcanizing agent may facilitate cross linkage between polybutadiene chains to vulcanize or cure the polybutadiene polymer. The amount of vulcanizing agent may be directly related to the resilience of the resulting vulcanized polymer, which may be measured by Yerzley method, ASTM D945-59. In one example, the first filler material 5112 may be formed from a compound including between 3 parts by weight and 7.5 parts by weight of sulfur per 100 parts by weight of polybutadiene. In another example, the first filler material 5112 may be formed from a compound including between 4 parts by weight and 6.25 parts by weight of a vulcanizing agent such as sulfur per 100 parts by weight of polybutadiene. In yet another example, the first filler material 5112 may be formed from a compound including between 4.75 parts by weight and 5.75 parts by weight of sulfur per 100 parts by weight of polybutadiene. The amounts of polybutadiene and sulfur as described herein may yield a compound having a Yerzley resilience of (1) between 75% and 85%, (2) between 80% and 90%, or (3) greater than 90%. The first filler material 5112 and the mixture composition thereof may be similar to any of the compounds described in U.S. Pat. No. 3,241,834, which is incorporated by reference herein. The apparatus, methods, and articles of manufacture described herein are not limited in this regard.

Other additives may be combined with the mixture of polybutadiene and the vulcanizing agent to initiate the curing cycle. In particular, an activating agent such as zinc oxide and/or stearic acid may be used to initiate the curing cycle of the mixture of polybutadiene and the vulcanizing agent. In one example, the amount of zinc oxide used may be between 2 parts by weight and 5 parts by weight per 100 parts by weight of polybutadiene, and/or the amount of stearic acid used may be between 0.5 parts by weight and 4 parts by weight per 100 parts by weight of polybutadiene. In another example, the amount of zinc oxide used may be between 2.5 parts by weight and 4.5 parts by weight per 100 parts by weight of polybutadiene, and/or the amount of stearic acid used may be between 1 part by weight and 2 parts by weight per 100 parts by weight of polybutadiene. In yet another example, the amount of zinc oxide used may be between 3.5 parts by weight and 4.5 parts by weight per 100 parts by weight of polybutadiene, and/or the amount of stearic acid used may be between 1.5 parts by weight and 2.5 parts by weight per 100 parts by weight of polybutadiene. The apparatus, methods, and articles of manufacture described herein are not limited in this regard.

Further, other additives may be combined with the mixture of polybutadiene and the vulcanizing agent to accelerate the rate of vulcanization. Accelerating the rate of vulcanization may shorten the length of the molding cycle of the first filler material 5112 and may also equalize the heat throughout the mixture during the curing cycle. In one example, any one or a combination of N-oxydiethylene benzothiazole 2 sulfenamide (referred to under the trade name AMAX), di-ortho-tolylguanidine (referred to under the trade name DOTG) and bismuth dimethyldithio-carbonate (referred to under the trade name Bismate) may be used to accelerate the vulcanization process. The activation of these accelerators may occur as the mixture reaches a specific temperature. For Bismate and DOTG, the activation temperature is approximately 230° F., whereas the activation temperature of AMAX is approximately 260° F. By ensuring that the heat of reaction is equalized throughout the mixture a more uniform rate of vulcanization and improved consistency in the end product is obtained. In one example, the amount of each of AMAX, DOTG, and Bismate may be between 0.25 and 4 parts by weight per 100 parts by weight of polybutadiene. In another example, the amount of each of AMAX, DOTG, and Bismate may be between 1 and 3 parts by weight per 100 parts by weight of polybutadiene. In yet another example, the amount of each of AMAX, DOTG, and Bismate may be between 1.5 and 2.75 parts by weight per 100 parts by weight of polybutadiene. The apparatus, methods, and articles of manufacture described herein are not limited in this regard.

Fillers may be added to the mixture of polybutadiene and the vulcanizing agent. In one example, hydrated silica may be added to the mixture as a filler. The added filler material(s) may perform the function of providing tear and abrasion resistance. The filler material may be selected to include to improve the durability of polybutadiene without unduly increasing the specific gravity. In another example, carbon black may be used as a filler material. In yet another example, lithium oxide may be used as a filler material. In one example, the amount of filler material used may be between 4 and 16 parts by weight per 100 parts by weight of polybutadiene. In another example, the amount of filler material used may be between 5 and 10 parts by weight per 100 parts by weight of polybutadiene. In yet another example, the amount of filler material used may be between 7 and 8 parts by weight per 100 parts by weight of polybutadiene.

The amount of filler material may affect the specific gravity of the resulting polymer material, which in turn may affect the resilience of the resulting polymer material. In one example, the amount of filler material used in the polybutadiene and the vulcanizing agent mixture may provide a specific gravity of between 1.0 and 1.5 to optimize resilience of the resulting polymer material (i.e., the first filler material 5112). In another example, the amount of filler material used in the polybutadiene and the vulcanizing agent mixture may provide a specific gravity of between 1.1 and 1.4 to optimize resilience of the resulting polymer material. In yet another example, the amount of filler material used in the polybutadiene and the vulcanizing agent mixture, the amount of filler material may provide a specific gravity of between 1.0 and 1.05 to optimize resilience of the resulting polymer material.

The apparatus, methods, and articles of manufacture described herein are not limited in this regard.

One or more anti-oxidation materials may be added to the polymer mixture to prevent oxidation and staining, and/or to inhibit aging of the resulting polymer compound. In one example, 4 methyl-6 tertiary-butyl phenol (referred to under the trade name Antioxidant 2246) may be added to the mixture at an amount of between 0.25 and 3 parts by weight per 100 parts by weight of polybutadiene. Other examples anti-oxidant materials that may be used include phenyl 13 naphthylamine, alkyl diphenylamine, and/or hindered alkyl phenols. The apparatus, methods, and articles of manufacture described herein are not limited in this regard.

The various elements of the polymer mixture described herein may be sufficiently mixed to provide uniform distribution of the elements throughout the mixture. In one example, the mixture may then be placed in a mold and subjected to a pressure of between 500 and 3000 pounds per square inch (psi) for a period of approximately 10 to 30 minutes, while concurrently, the temperature of the mixture may be raised to approximately 285-340° F. In another example, the mixture may then be placed in a mold and subjected to a pressure of between 750 and 2000 psi for a period of approximately 12 to 25 minutes, while concurrently, the temperature of the mixture may be raised to approximately 300-330° F. In yet another example, the mixture may then be placed in a mold and subjected to a pressure of between 900 and 1100 psi for a period of approximately 15 to 20 minutes, while concurrently, the temperature of the mixture may be raised to approximately 315-325° F. Various aspects of the treatment of the mixture (e.g., the length of each of the molding operation, the pressure, and/or the temperature) may be adjusted to compensate for any variation in other aspects of the treatment the mixture. The apparatus, methods, and articles of manufacture described herein are not limited in this regard.

The adhesive for bonding the first filler material 5112 to the portions of the inner walls 4912 may be any type of adhesive that can bond the first filler material 5112 to the material of the face portion 4862. In one example, the first filler material 5112 may be a rubber or a rubber compound as described herein and the face portion 4862 may be constructed from a steel-based material such as stainless steel. Accordingly, the adhesive for bonding the first filler material 5112 to the portions of the inner walls 4912 may be a type of adhesive used to bond steel-based materials to rubber or rubber compounds. In another example, the first filler material 5112 may be a rubber or a rubber compound and the body portion 3510 may be constructed from titanium or a titanium alloy. Accordingly, the adhesive for bonding the first filler material 5112 to the portions of the inner walls 4912 may be a type of adhesive used to bond titanium-based materials to rubber or rubber compounds. In another example, the second filler material 5114 may be used to bond the first filler material 5112 to the portions of the inner walls 4912. The bonding of the first filler material 5112 to any portion of the body portion 4810, the face portion 4862, and/or the second filler material 5114, and the bonding of the second filler material 5114 to the body portion 4810, the face portion 4862, and/or the first filler material 5112 may be similar to any of the bonding properties and procedures described in any of the incorporated by reference applications. The apparatus, methods, and articles of manufacture described herein are not limited in this regard.

In one example (not shown), the interior cavity 4910 may be entirely filled with the first filler material 5112. In another example, as shown in FIGS. 48-53, the interior cavity 4910 may be partially filled with the first filler material 5112. Accordingly, the remaining portions of the first interior cavity 4910 may be filled with a second filler material 5114. As described herein, the second filler material 5114 may provide or assist (e.g., alone or in conjunction with one or more adhesives) in the coupling of the first filler material 5112 with portions of the inner walls 4912 and/or with the face portion 4862. In other words, the second filler material 5114 may assist in maintaining or maintain the first filler material 5112 coupled to the inner walls 4912 and/or the back surface 4866 of the face portion 4862. The apparatus, methods, and articles of manufacture described herein are not limited in this regard.

The second filler material 5114 may have one or more different properties than the first filler material 5112 such as density, compression, hardness (i.e., durometer), tensile strength, shear strength, viscosity, elasticity, etc., to optimize energy transfer from the face portion 4862 to a golf ball. The second filler material may be a polymer material. The second filler material may be similar to any of the second filler materials described herein such as the second filler material 4213. The apparatus, methods, and articles of manufacture described herein are not limited in this regard.

The second filler material 5114 may have a smaller COR than the first filler material 5112. In one example, the COR of the second filler material 5114 may be less than between 1% and 10% of the COR of the first filler material 5112. In another example, the COR of the second filler material 5114 may be less than between 2% and 5% of the COR of the first filler material 5112. In another example, the COR of the second filler material 5114 may be between 2% and 4% less than the COR of the first filler material 5112.

In one example, the first filler material 5112 may have a Shore A hardness of between 54 and 76. In another example, the first filler material 5112 may have a Shore A hardness of between 60 and 70. In another example, the first filler material 5112 may have a Shore A hardness of between 62 and 68. In yet another example, the first filler material 5112 may have a Shore A hardness of between 60 and 75. The second filler material 5114 may have a different hardness than the first filler material 5112. In one example, the second filler material 5114 may have a Shore D hardness of between 55 and 80. In another example, the second filler material 5114 may have a Shore D hardness of between 50 and 85. In another example, the second filler material 5114 may have a Shore D hardness of between 60 and 75. In yet another example, the second filler material 5114 may have a Shore D hardness of between 62 and 73. The apparatus, methods, and articles of manufacture described herein are not limited in this regard.

In one example, the mass of the first filler material 5112 may be between 0.5% and 6.0% of the total mass of the golf club head 4800. In another example, the mass of the first filler material 5112 may be between 1.0% and 5.0% of the total mass of the golf club head 4800. In another example, the mass of the first filler material 5112 may be between 2.0% and 4.0% of the total mass of the golf club head 4800. In another example, the mass of the first filler material 5112 may be greater than 5% of the total mass of the golf club head 4800. In yet another example, the body portion 4810 may be entirely filled with the first filler material 5112 as described herein. The apparatus, methods, and articles of manufacture described herein are not limited in this regard.

In one example, the mass of the second filler material 5114 may be between 2.0% and 14.0% of the total mass of the golf club head 4800. In another example, the mass of the second filler material 5114 may be between 3.0% and 12.0% of the total mass of the golf club head 4800. In another example, the mass of the second filler material 5114 may be between 5.0% and 10.0% of the total mass of the golf club head 4800. In another example, the mass of the second filler material 5114 may greater than 10% of the total mass of the golf club head 4800. The apparatus, methods, and articles of manufacture described herein are not limited in this regard.

As described herein, the face portion 4862 may be relatively thin to provide increased bending and deflection of the face portion 4862 during a golf ball strike. Further, the face portion 4862 may include one or more grooves (e.g., such as the groove 5469 shown in FIG. 65) on the back surface 4866 of the face portion 4862 as described herein to further increase the flexibility of the face portion 4862. The second filler material 5114 may be a polymer material with a relatively high strength and stiffness to provide structural support and stability for the face portion 4862 to prevent failure of the face portion 4862 during a golf ball strike or repeated golf ball strikes (i.e., face portion fatigue). The second filler material 5114 may also have a relatively high COR as described herein to provide a rebound effect for the face portion 4862 after a golf ball strike. As further described herein, the first filler material 5112 may be a rubber-type of compound with a lower strength and stiffness (i.e., softer or less rigid) than the second filler material 5114 and a higher COR than the second filler material 5114. Accordingly, the first filler material 5112 may provide additional structural support for the face portion 4862. Further, the relatively higher COR of the first filler material 5112 may allow the first filler material 5112 to store the energy from a golf ball strike and to release a substantial amount of the energy back to the golf ball (i.e., without losing much impact energy) by providing a relatively large rebound effect for the face portion 4862. Additionally, the different material properties of the first filler material 5112 and the second filler material 5114 as described herein may provide sound and vibration dampening at different frequency ranges to provide a pleasant sound and feel for an individual. The apparatus, methods, and articles of manufacture described herein are not limited in this regard.

As described herein, the first filler material 5112 may have a resilience (i.e., Yerzley resilience) of (1) between 75% and 85%, (2) between 80% and 90%, or (3) greater than 90%. The relatively high resilience of the first filler material 5112 may be directly related to the rebound velocity and/or acceleration of the face portion 4862 in response to the deflection of the face portion 4862 after the face portion 4862 strikes a golf ball. Accordingly, a golf club head having a first filler material 5112 with a relatively higher resilience may provide a relatively longer distance for a golf ball than a golf club head having a first filler material 5112 with a relatively lower resilience. The amount of compression of the first filler material 5112 may also be directly related to the rebound velocity and/or acceleration of the face portion 4862 after the face portion strikes a golf ball. A certain amount of compression of the first filler material 5112 may provide an optimum rebound effect for the face portion 4862. Increasing the compression of the first filler material 5112 beyond a certain amount may negatively affect the rebound of the face portion 4862 by dissipating an excessive amount of the compression energy through the first filler material 5112. Accordingly, the first filler material 5112 may have a relatively high resilience as described herein when the first filler material 5112 is not excessively compressed when the face portion 4862 strikes a golf ball. To control and/or prevent excessive compression of the first filler material 5112, the second filler material 5114 may be disposed between the face portion 4862 and the first filler material 5112 as described herein. The second filler material 5114 may effectively transfer and uniformly distribute the energy of a golf ball from the face portion 4862 to the first filler material 5112 and prevent excessive compression, and in particular, local compression of the first filler material 5112 to provide an optimum or substantially optimum and generally uniform transfer of the rebound energy from the first filler material 5112 to the face portion 4862. The apparatus, methods, and articles of manufacture described herein are not limited in this regard.

The second filler material 5114 may also dampen the vibration of the face portion 4862 to provide a certain sound and feel for the golf club head 4800. Accordingly, the combination of the first filler material 5112 and the second filler material 5114 may dampen the vibration of the face portion 4862 within a broad range of frequencies to provide a certain sound and feel for the golf club head 4800. The second filler material 5114 may also contribute to providing a certain rebound and/or acceleration for the face portion 4862 to optimize the transfer of energy from the golf club head 4800 to a golf ball. In other words, the second filler material 5114 may cooperatively with the first filler material 5112 optimize the rebounding of the face portion 4862 to maximize the velocity and distance of the golf ball. Further yet, as described herein, the second filler material 5114 may function as an adhesive between the first filler material 5112 and the face portion 4862 to provide continuous and/or uniform energy transfer between the face portion 4862 and the first filler material 5112. The apparatus, methods, and articles of manufacture described herein are not limited in this regard.

In the example of FIGS. 54-65, a golf club head 5400 may include a body portion 5410 having a toe portion 5440 with a toe portion edge 5442, a heel portion 5450 with a heel portion edge 5452 that may include a hosel portion 5455 configured to receive a shaft (not shown) with a grip (not shown) on one end and the golf club head 5400 on the opposite end of the shaft to form a golf club, a front portion 5460 with a perimeter edge portion 5461, a back portion 5470 with a back wall portion 5472, a top portion 5480 with a top portion edge 5482, and a sole portion 5490 with a sole portion edge 5492. The toe portion 5440, the heel portion 5450, the front portion 5460, the back portion 5470, the top portion 5480, and/or the sole portion 5490 may partially overlap each other. The toe portion edge 5442, the heel portion edge 5452, the top portion edge 5482, and the sole portion edge 5492 may define a periphery of the body portion 5410. The apparatus, methods, and articles of manufacture described herein are not limited in this regard.

The golf club head 5400 may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees)(°, 48°, 52°, 56°, 60°, etc.). Although FIGS. 54-65 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The volume of the golf club head 5400, the materials of construction of the golf club head 5400, and/or any components thereof may be similar to any of the golf club heads described herein and/or described in any of the incorporated by reference applications. The apparatus, methods, and articles of manufacture described herein are not limited in this regard.

The golf club head 5400 may include a face portion 5462 (i.e., the strike face), which may be integrally formed with the body portion 5410 (e.g., a single unitary piece). In one example, as shown in FIGS. 54-65, the face portion 5462 may be a separate piece coupled (e.g., adhesively, mechanically, by welding, and/or by soldering) to the front portion 5460. The face portion 5462 may include a front surface 5464 and a back surface 5466. In one example (not shown), the front portion 5460 may include one or a plurality of recessed shoulders configured to receive the face portion 5462 for attachment of the face portion 5462 to the body portion 5410. In another example, as shown in FIGS. 54-65, the back surface 5466 may include a perimeter portion 5467 that may be attached to a perimeter edge portion 5461 of the body portion 5410. The perimeter portion 5467 of the face portion 5462 may be attached to the perimeter edge portion 5461 of the body portion 5410 by one or more fasteners, one or more adhesive or bonding agents, and/or welding or soldering. In one example, as shown in FIGS. 54-65, the perimeter portion 5467 of the face portion 5462 may be welded to the perimeter edge portion 5461 of the body portion 5410 at one or more locations. Alternatively, the entire perimeter portion 5467 of the face portion 5462 may be welded to the entire perimeter edge portion 5461 of the body portion 5410 (i.e., a continuous weld). The face portion 5462 may include a ball strike region 5468 to strike a golf ball. In one example, the center of the ball strike region 5468 may be a geometric center 5463 of the face portion 5462. In another example, the geometric center 5463 of the face portion 5462 may be offset from a center of the ball strike region 5468. In one example, the geometric center 5443 and one or more regions near and/or surrounding the geometric center within the ball strike region 5468 may provide a generally optimum location (i.e., optimum ball distance, ball speed, ball spin characteristics, etc.) on the face portion 5462 for striking a golf ball. In yet another example, any location at or near the geometric center 5463 and within the ball strike region 5468 may provide a generally optimum location on the face portion 5462 for striking a golf ball. However, a ball may be struck with any portion of the face portion 5462 within the ball strike region 5468 or outside the ball strike region 5468 for any of the golf club heads described herein resulting in certain ball flight characteristics different from an on-center hit that may be preferred by an individual. The configuration of the face portion 5462 and the attachment of the face portion 5462 (e.g., welding) to the body portion 5410 may be similar in many respects to any of the golf club heads described herein and/or described in any of the incorporated by reference applications. The apparatus, methods, and articles of manufacture described herein are not limited in this regard.

The golf club head 5400 may be associated with a ground plane 5710, a horizontal midplane 5720, and a top plane 5730. In particular, the ground plane 5710 may be a plane that is parallel or substantially parallel to the ground and is tangent to the lowest portion of the sole portion edge 5492 when the golf club head 5400 is at an address position (e.g., the golf club head 5400 aligned to strike a golf ball). A top plane 5730 may be a plane that is tangent to the upper most portion of top portion edge 5482 when the golf club head 5400 is at the address position. The ground and top planes 5710 and 5730, respectively, may be parallel or substantially parallel to each other. The horizontal midplane 5720 may be vertically halfway between the ground and top planes 5710 and 5730, respectively. Further, the golf club head 5400 may be associated with a loft plane 5740 defining a loft angle 5745 (*a*) of the golf club head 5400. The loft plane 5740 may be a plane that is tangent to the face portion 5462. The loft angle 5745 may be defined by an angle between the loft plane 5740 and a vertical plane 5750 normal to the ground plane 5710.

The body portion 5410 may be a hollow body including an interior cavity 5510 having inner walls 5512. The interior cavity 5510 may extend between the front portion 5460, the back portion 5470, the top portion 5480, and the sole portion 5490. In the example of FIGS. 54-65, the interior cavity 5510 of the body portion 5410 may be enclosed with and partially defined with the face portion 5462. The configuration of the interior cavity 5510 (e.g., height, width, volume, shape, etc.), the configuration of the interior cavity 5510 relative to the body portion 5410 (e.g., volume of the interior cavity 5510 relative to the volume of body portion 5410), the width and height variation of the interior cavity 5510, and access to the interior cavity 5510 from one or more ports on the body portion 5410 may be similar to any of the golf club heads described herein and/or described in any of the incorporated by reference applications. The apparatus, methods, and articles of manufacture described herein are not limited in this regard.

The back wall portion 5472 of the back portion 5470 may include an upper back wall portion 5812 and a lower back wall portion 5814. The back wall portion 5472 may include a ledge portion 5816 that may extend between the toe portion edge 5442 and the heel portion edge 5452 in a continuous or discontinuous manner. The lower back wall portion 5814 may be located farther back on the body portion 5410 than the upper back wall portion 5812, with the ledge portion 5816 defining a transition portion between the upper back wall portion 5812 and the lower back wall portion 5814. Accordingly, the ledge portion 5816 may extend transverse to the upper back wall portion 5812 and the lower back wall portion 5814. In one example, as shown in FIG. 54-65, the ledge portion 5816 may include a first ledge portion 5826 and a second ledge portion 5836. The first ledge portion 5826 may extend on the back wall portion from the toe portion edge 5442 to a back wall center portion 5840 of the back wall portion 5472. The second ledge portion 5836 may extend from the center portion 5840 of the back wall portion 5472 to the heel portion edge 5452. As shown in FIGS. 54-65, the ledge portion 5816 may provide for a relatively greater mass of the body portion 5410 below the horizontal midplane 5720, and the mass of the body portion 5410 below the horizontal midplane 5720 to be moved farther back on the body portion 5410. The width of the ledge portion 5816 may be greater than, equal to, or less than the width of the interior cavity at certain locations of the body portion 5410. The configuration of the ledge portion 5816 (e.g., width, segments, tapering, shape, etc.) and the properties of the ledge portion 5816 relative to the width of the interior cavity may be similar to any ledge portion or similar structure of any of the golf club heads described herein and/or described in any of the incorporated by reference applications. The apparatus, methods, and articles of manufacture described herein are not limited in this regard.

The body portion 5410 may include one or more ports, which may be exterior ports and/or interior ports (e.g., located inside the body portion 5410). The inner walls 5512 of the interior cavity 5510 may include one or more ports (not shown). In one example, as shown in FIGS. 54-65, the back portion 5470 may include one or more ports along or proximate to the periphery of the body portion 5410. For example, the body portion 5410 may include a first set of ports 5520 (e.g., shown as ports 5521 and 5522), a second set of ports 5530 (e.g., shown as ports 5531 and 5532), a third set of ports 5540 (e.g., shown as ports 5541, 5542, and 5543), and a fourth set of ports 5550 (e.g., shown as ports 5551 and 5552). The locations, spacing relative to other ports, and any other configuration of each port of the first set of ports 5520, the second set of ports 5530, the third set of ports 5540, and/or the fourth set of ports 5550 may be similar in many respects to any of the ports described herein or described in any of the incorporated by reference applications. Further, any one or more of the ports of the first set of ports 5520, the second set of ports 5530, the third set of ports 5540, and/or the fourth set of ports 5550 may be connected to interior cavity 5510 through which one or more filler materials may be injected into the interior cavity 5510. In the example of FIGS. 54-65, the ports 5521, 5531, and 5551 may be connected to the interior cavity 5510 via openings 5561, 5571, and 5581, respectively. The apparatus, methods, and articles of manufacture described herein are not limited in this regard.

Each port of the first set of ports 5520 may be separated by a distance less than the port diameter of any of the ports of the first set of ports 5520. Each port of the second set of ports 5530 may be separated by a distance less than the port diameter of any of the ports of the second set of ports 5530. Each port of the third set of ports third set of ports 5540 may be separated by a distance less than the port diameter of any of the ports of the third set of ports 5540. Each port of the fourth set of ports 5550 may be separated by a distance less than the port diameter of any of the ports of the third set of ports 5550. In one example, the first set of ports 5520 and the second set of ports 5530 may be spaced apart by a distance greater than the port diameter of any of the ports of the first set of ports 5520 and the second set of ports 5530. In another example, the second set of ports 5530 and the third set of ports 5540 may be spaced apart by a distance greater than the port diameter of any of the ports of the second set of ports 5530 and the third set of ports 5540. In yet another example, the third set of ports 5540 and the fourth set of ports 5545 may be spaced apart by a distance greater than the port diameter of any of the ports of the third set of ports 5540 and the fourth set of ports 5550. The apparatus, methods, and articles of manufacture described herein are not limited in this regard.

Although the figures may depict the ports as separate and individual parts, each set or a combination of adjacent sets of ports of the first, second, third, and fourth sets of ports 5520, 5530, 5540, and 5550, respectively, may be a single port. In one example, all ports of the first set of ports 5520 may be combined into a single port (e.g., a first port). In another example, all ports of the second set of ports 5530 may be combined into a single port (e.g., a second port). In another example, all ports of the third set of ports 5540 may be combined into a single port (e.g., a third port). In yet another example, all ports of the fourth set of ports 5550 may be combined into a single port (e.g., a fourth port). While the figures may depict a particular number of ports, the apparatus, methods, and articles of manufacture described herein may include more or a smaller number of ports.

The body portion 5410 may include one or more mass portions (e.g., weight portion(s)), which may be integral mass portion(s) or separate mass portion(s) that may be coupled to the body portion 5410. In the illustrated example as shown in FIGS. 54-65, the body portion 5410 may include a first set of mass portions 5620 (e.g., shown as mass portions 5621 and 5622), a second set of mass portions 5630 (e.g., shown as mass portions 5631 and 5632), a third set of mass portions 5640 (e.g., shown as mass portions 5641, 5642, and 5643), and a fourth set of mass portions 5650 (e.g., shown as mass portions 5651 and 5652). While the above example may describe a particular number or portions of mass portions, a set of mass portions may include a single mass portion, or a plurality of mass portions as described in any of the incorporated by reference applications. For example, any one or a combination of adjacent sets of mass portions of the first set of mass portions 5620 may be a single mass portion, the second set of mass portions 5630 may be a single mass portion, the third set of mass portions 5640 may be a single mass portion, and/or the fourth set of mass portions 5650 may be a single mass portion. Further, the first set of mass portions 5620, the second set of mass portions 5630, the third set of mass portions 5640, and/or the fourth set of mass portions 5650 may be a portion of the physical structure of the body portion 5410. The mass portions of the first set of mass portions 5620, the second set of mass portions 5630, the third set of mass portions 5640, and/or the fourth set of mass portions 5650 may be similar to any of the mass portions described in any of the incorporated by reference applications. The apparatus, methods, and articles of manufacture described herein are not limited in this regard.

The interior cavity 5510 may be partially or entirely filled with one or more filler materials (i.e., a cavity filling material), which may include one or more similar or different types of materials. In one example, as shown in FIGS. 54-65, the interior cavity 5510 may be filled with a first filler material 5712 and a second filler material 5714. In one example, the first filler material 5712 may be similar to the first filler material 5112, and the second filler material 5714 may be similar to the second filler material 5114 as described herein. Accordingly, the first filler material 5712 may be a rubber or rubber compound, and the second filler material 5714 may be an epoxy-type of material. In another example, the first filler material 5712 and/or the second filler material 5714 may be similar to any of the filler materials described herein or described in any of the incorporated by reference applications. The apparatus, methods, and articles of manufacture described herein are not limited in this regard.

The first filler material 5712 may be coupled to all or portions of the inner walls 5512 of the interior cavity 5510. In one example, the first filler material 5712 may have inherent adhesive or bonding properties to attach to all or portions of the inner walls 5512. In another example, the first filler material 5712 may be attached to all or portions of the inner walls 5512 with one or more bonding agents or adhesives that may be mixed with the first filler material 5712. In another example, the first filler material 5712 may be attached to all or portions of the inner walls 5512 with one or more bonding agents or adhesives that may be separate from the first filler material 5712. The apparatus, methods, and articles of manufacture described herein are not limited in this regard.

Figure 56:
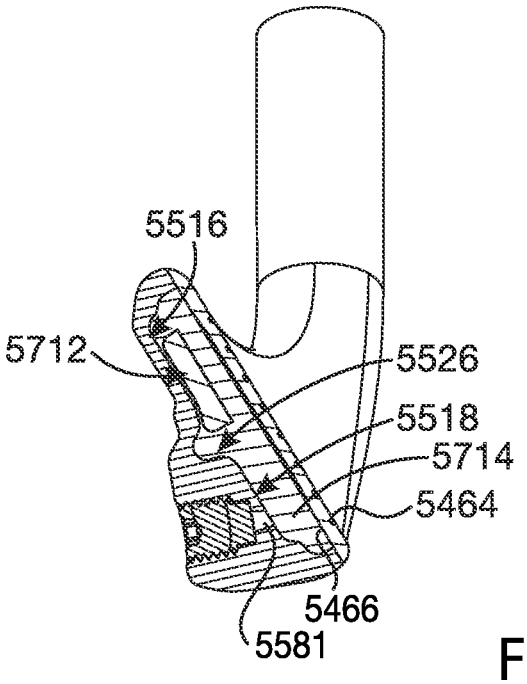
Figure 57:
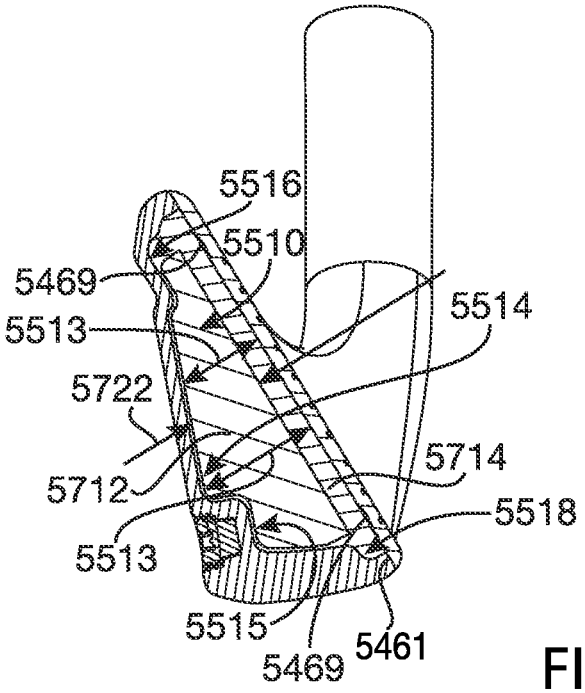

In one example, as shown in FIGS. 56 and 57, the first filler material 5712 may be coupled to at least a portion of the inner walls 5512 that may generally correspond to the ball strike region 5468 of the face portion 5462 (i.e., the first filler material 5712 may be generally located behind the ball strike region 5468) or regions proximate to and/or surrounding the ball strike region 5468 of the face portion 5462. In another example, the first filler material 5712 may be coupled to at least 10% of the inner walls 5512. In another example, the first filler material 5712 may be coupled to at least 25% of the inner walls 5512. In yet another example, the first filler material 5712 may be coupled to between 25% and 50% of the inner walls 5512. In another example, the first filler material 5712 may be coupled to between 41% and 75% of the inner walls 5512. In yet another example, the first filler material 5712 may be coupled to between 50% and 90% of the inner walls 5512. In yet another example, the first filler material 5712 may be coupled to more than 75% of the inner walls 5512. In yet another example, the first filler material 5712 may be coupled to all of inner walls 5512. The apparatus, methods, and articles of manufacture described herein are not limited in this regard.

In one example, as shown in Table 4, a range of volumes of the first filler material 5712 ($V_r$) may be expressed relative to the volume of the body portion 5410 ($V_b$) and relative to the volume of the interior cavity 5510 ($V_c$). Further, as shown in Table 4, the mass of the first filler material 5712 ($m_r$) and the mass of the second filler material 5714 ($m_f$) may be expressed relative to the mass of the body portion 5410 ($m_b$).

| Golf Club Head 5400 | $V_r/V_b$ | $V_r/V_C$ | $m_r/m_b$ | $m_f/m_b$ |
|---|---|---|---|---|
| 3-iron | 9% to 17% | 22% to 40% | 1.7% to 3.1% | 4.3% to 8.0% |
| 4-iron | 10% to 18% | 24% to 44% | 1.8% to 3.3% | 4.1% to 7.5% |
| 5-iron | 9% to 17% | 24% to 44% | 1.7% to 3.1% | 3.8% to 7.1% |
| 6-iron | 8% to 16% | 23% to 42% | 1.5% to 2.8% | 3.7% to 6.9% |
| 7-iron | 8% to 15% | 23% to 43% | 1.5% to 2.7% | 3.5% to 6.5% |
| 8-iron | 8% to 16% | 23% to 42% | 1.5% to 2.8% | 3.7% to 6.8% |
| 9-iron | 8% to 15% | 23% to 42% | 1.4% to 2.6% | 3.4% to 6.4% |
| Pitching Wedge | 8% to 14% | 22% to 41% | 1.3% to 2.5% | 3.4% to 6.3% |
| Gap Wedge | 7% to 13% | 21% to 40% | 1.2% to 2.2% | 3.1% to 5.7% |

As shown in the example of Table 4, the amount of the first filler material 5712 that may be in the interior cavity 5510 and/or coupled to the inner walls 5512 may depend on the loft angle of the golf club head (e.g., 4-iron, 7-iron, PW, etc.). In another example, the ratio of the volume of the first filler material 5712 to the volume of the body portion 5410 may be greater than or equal to 2.5% and less than or equal to 30%. In another example, the ratio of the volume of the first filler material 5712 to the volume of the interior cavity 5510 may be greater than or equal to 15% and less than or equal to 50%. In another example, the ratio of the mass of the first filler material 5712 to the mass of the body portion 5410 may be greater than or equal to 0.75% and less than or equal to 7.5%. In another example, the ratio of the volume of the first filler material 5712 to the volume of the interior cavity 5510 may be greater than 50%. In another example, the ratio of the volume of the first filler material 5712 to the volume of interior cavity 5510 may be 100% or near 100% (i.e., the interior cavity 5510 is entirely filled with the first filler material 5712). In yet another example, a ratio of the mass of second filler material 5712 to the mass of the body portion 5410 may be greater than or equal to 2.0% and less than or equal to 10%. Although Table 4 lists golf club heads that are labeled as having a certain loft angles or loft angle ranges, each of the golf club heads of Table 4 may include a certain loft angle range that may be partially similar or overlap with the loft angle range of an adjacent golf club head of Table 4. The apparatus, methods, and articles of manufacture described herein are not limited in this regard.

The amount of first filler material 5712 that may be in the interior cavity may also depend on the overall thickness of the face portion 5462, the thickness profile of the face portion 5462, the shape of the interior cavity 5510, the locations and configurations of any ports or mass portions, the material properties of the first filler material 5712, and/or the material properties of the second filler material 5714. In one example, a golf club head with a relatively high loft angle may limit the portions of the inner walls 5512 to which the first filler material 5712 may be coupled. In another example, a golf club head with a relatively small loft angle may allow the first filler material 5712 to be coupled to all or substantial portions of the inner walls 5512. In yet another example, the acoustic properties of a golf club head may be a factor in determining the amount of filler material 5712 that may be coupled to the inner walls 5512 to provide a pleasing sound and feel to an individual. The amount (i.e., volume and/or mass) of the first filler material 5712 coupled to the inner walls 5512 may be determined for each golf club head (i.e., having a certain loft angle) to (i) provide vibration dampening or sound dampening (e.g., consistent and/or pleasing sound and feel when the golf club head 5400 strikes a golf ball as perceived by an individual using the golf club head 5400), (ii) provide structural support for the face portion 5462, and/or (iii) optimize ball travel distance, ball speed, ball launch angle, ball spin rate, ball peak height, ball landing angle and/or ball dispersion. The apparatus, methods, and articles of manufacture described herein are not limited in this regard.

In the example of FIGS. 54-65, a portion of the interior cavity 5510 including a central portion 5511 of the interior cavity 5510, which may be a portion of the interior cavity 5510 that may generally correspond to the ball strike region 5468, may be include the first filler material 5712 and the second filler material 5714. The width 5513 of the interior cavity 5510 at the central portion 5511 of the interior cavity 5510 may be generally greater than the width 5513 of the interior cavity 5510 at other portions of the interior cavity 5510. Accordingly, the region of the interior cavity 5510 behind the ball strike region 5468, i.e., the central portion 5511, may include a relatively large volume of the first filler material 5712 and/or the second filler material 5714. Further, the configuration of the central portion 5511 (i.e., size, shape, contour, volume, etc.) may depend on the loft angle 5745. For example, a golf club head 5400 with a relatively small loft angle 5745 may have a larger central portion 5511 (i.e., larger volume, depth, height, etc.) than a golf club head 5400 with a relatively large loft angle 5745. Accordingly, as described herein, the amount of first filler material 5712 and/or the second filler material 5714 inside the interior cavity 5510, and more specifically, in the central portion 5511 may be determined based on the loft angle 5745 to provide (i) provide vibration dampening or sound dampening (e.g., consistent and/or pleasing sound and feel when the golf club head 5400 strikes a golf ball as perceived by an individual using the golf club head 5400), (ii) provide structural support for the face portion 5462, and/or (iii) optimize ball travel distance, ball speed, ball launch angle, ball spin rate, ball peak height, ball landing angle and/or ball dispersion. The apparatus, methods, and articles of manufacture described herein are not limited in this regard.

The contour of the interior cavity 5510 or the shape of the inner walls 5512 may be defined by a plurality of recessed portions that may be recessed relative to the perimeter edge portion 5461. In the example of FIGS. 54-65, the interior cavity 5510 may include a first recessed portion 5514, a second recessed portion 5515 that may have a generally smaller depth (i.e., defined by the interior cavity width 5513 as viewed in cross section in FIGS. 57-40) relative to the first recessed portion 5514, a third recessed portion 5516 that may have a generally smaller depth than the second recessed portion 5515, a fourth recessed portion 5517 that may have a generally smaller depth than the third recessed portion 5516, and a fifth recessed portion 5518 that may have a generally smaller depth than the fourth recessed portion 5517. The interior cavity 5510 may have more or less recessed portions. The apparatus, methods, and articles of manufacture described herein are not limited in this regard.

The first recessed portion 5514 may generally include a largest width 5513 of the interior cavity 5510 and may be located at the central portion 5511 and/or may include portions that are adjacent to and/or surround the central portion 5511. The second recessed portion 5515 may be adjacent to and/or surround all or portions of the first recessed portion 5514 and may include portions that may be in the central portion 5511. In the example of FIGS. 54-65, the second recessed portion 5515 is located below the first recessed portion 5514. A portion of the structure of the body portion 5410 that includes the third set of ports 5540 may be between the second recessed portion 5515 and the lower back wall portion 5814. Accordingly, the depth of the second recessed portion 5515 may be less than the depth of the first recessed portion 5514 so that the body portion 5410 can accommodate the third set of ports 5540 between the second recessed portion 5515 and the lower back wall portion 5814. The apparatus, methods, and articles of manufacture described herein are not limited in this regard.

The third recessed portion 5516 may be adjacent to and/or surround all or portions of the second recessed portion 5515 and/or the first recessed portion 5514 and may include portions that may be in the central portion 5511. In the example of FIGS. 54-65, the third recessed portion 5516 surrounds the first recessed portion 5514 above the horizontal midplane 5720. The fourth recessed portion 5517 may be at or proximate to the perimeter edge portion 5461, and/or may be adjacent to and/or surround all or portions of the third recessed portion 5516, the second recessed portion 5515, and/or the first recessed portion 5514. In the example of FIGS. 54-65, the fourth recessed portion 5517 is adjacent to portions of the first recessed portion 5514 and the second recessed portion 5515 below the horizontal midplane 5720. A portion of the structure of the body portion 5410 that includes the second set of ports 5530 and the fourth set of ports 5550 may be between the fourth recessed portion 5517 and the lower back wall portion 5814. Accordingly, the depth of the fourth recessed portion 5517 may be less than the depths of the first recessed portion 5514 and the second recessed portion 5515 so that the body portion 5410 can accommodate the second set of ports 5530 and the fourth set of ports 5550 between the fourth recessed portion 5517 and the lower back wall portion 5814. The apparatus, methods, and articles of manufacture described herein are not limited in this regard.

The fifth recessed portion 5518 may be adjacent to the perimeter edge portion 5461. Accordingly, at any location in the interior cavity 5510 that includes the fifth recessed portion 5518, the fifth recessed portion 5518 may be between the perimeter edge portion 5461 and any one or more of the first recessed portion 5514, the second recessed portion 5515, the third recessed portion 5516, and the fourth recessed portion 5517. A portion of the structure of the body portion 5410 that includes the first set of ports 5520 may be between the fifth recessed portion 5518 and the upper back wall portion 5812. Accordingly, the depth of the fifth recessed portion 5518 may be less than the depth of the adjacent portions of the third recessed portion 5516 so that the body portion 5410 can accommodate the first set of ports 5520 between the fifth recessed portion 5518 and the upper back wall portion 5812. The apparatus, methods, and articles of manufacture described herein are not limited in this regard.

The interior cavity 5510 may include one or more internal channels that may extend between the toe portion 5440 and the heel portion 5450. In one example, as shown in FIGS. 54-65, the interior cavity 5510 may include a first internal channel 5525 that may extend from a location at the toe portion 5440 to the central portion 5511, and a second internal channel 5526 that may extend from a location at the heel portion 5450 to the central portion 5511. The first internal channel 5525 and the second internal channel 5526 connect to the first recessed portion 5514 and may have the same depth as the first recessed portion 5514 at or proximate to the central portion 5511. The depths of the first internal channel 5525 and the second internal channel 5526 may diminish from the first recessed portion 5514 toward the toe portion 5440 and heel portion 5450, respectively. As shown in the example of FIGS. 54-65, portions of the first internal channel 5525 and/or the second internal channel 5526 that connect to the first recessed portion 5514 and/or are proximate to the first recessed portion 5514 may maintain a constant depth that may be similar to the depth of the first recessed portion 5514. Alternatively, all or portions of the first internal channel 5525 and/or the second internal channel 5526 may have diminishing depths in a direction toward the toe portion 5440 and the heel portion 5450, respectively. In one example, as shown in FIGS. 54-65, the height of first internal channel 5525 increases in a direction from the toe portion 5440 to the central portion 5511 to include a relatively large and expanding triangular first channel portion 5535. Similarly, the height of the second internal channel 5526 increases in a direction from the heel portion 5450 to the central portion 5511 to include a relatively large and expanding triangular second channel portion 5536. The first channel portion 5535 and the second channel portion 5536 may effectively expand the central portion 5511 further toward the toe portion 5440 and the heel portion 5450, respectively. Accordingly, the first internal channel 5525 and the second internal channel 5526 may provide a greater volume of the first filler material 5712 and/or the second filler material 5714 between the central portion 5511 and the toe portion 5440 and the heel portion. For off-center hits of a golf ball with the face portion 5462, the increased volume of the first filler material 5712 and/or the second filler material 5714 in the internal channels 5525 and 5526 may (i) provide vibration dampening or sound dampening, (ii) provide structural support for the face portion 5462, and/or (iii) optimize ball travel distance, ball speed, ball launch angle, ball spin rate, ball peak height, ball landing angle and/or ball dispersion. Further, the mass that is removed from the body portion 5410 to provide the internal channels 5525 and 5526, and more specifically, the first channel portion 5535 and the second channel portion 5536, may be shifted to other locations on the body portion 5410 to increase and/or optimize the moment of inertia and the location of the center of gravity of the golf club head 5400. The apparatus, methods, and articles of manufacture described herein are not limited in this regard.

Figure 58:
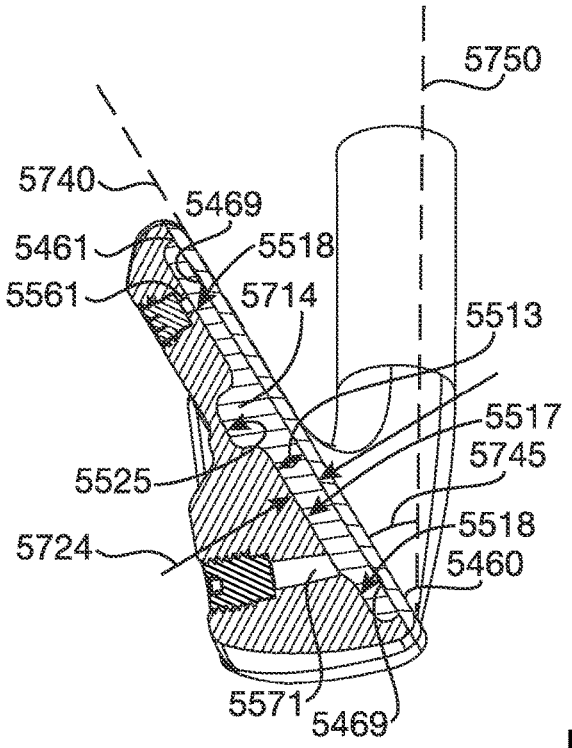
Figure 59:
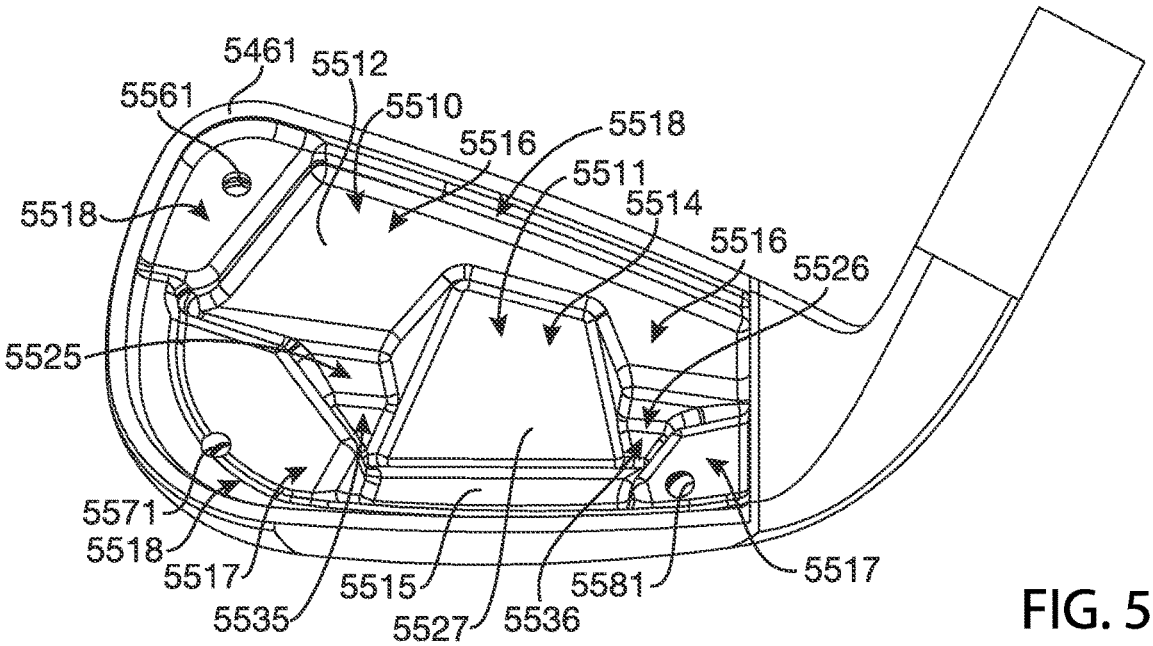
Figure 60:
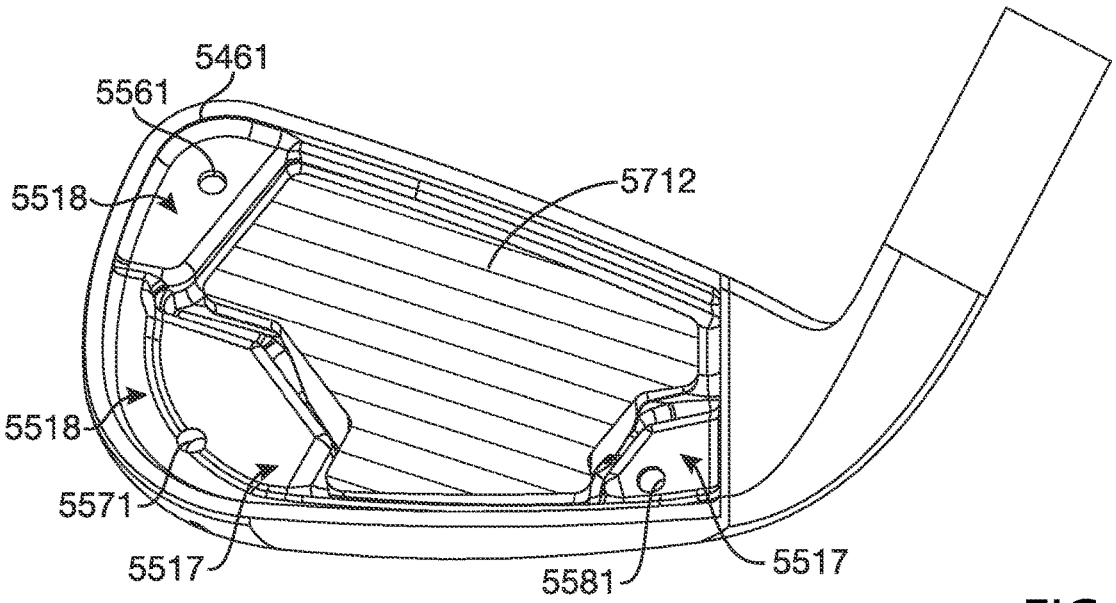
Figure 61:
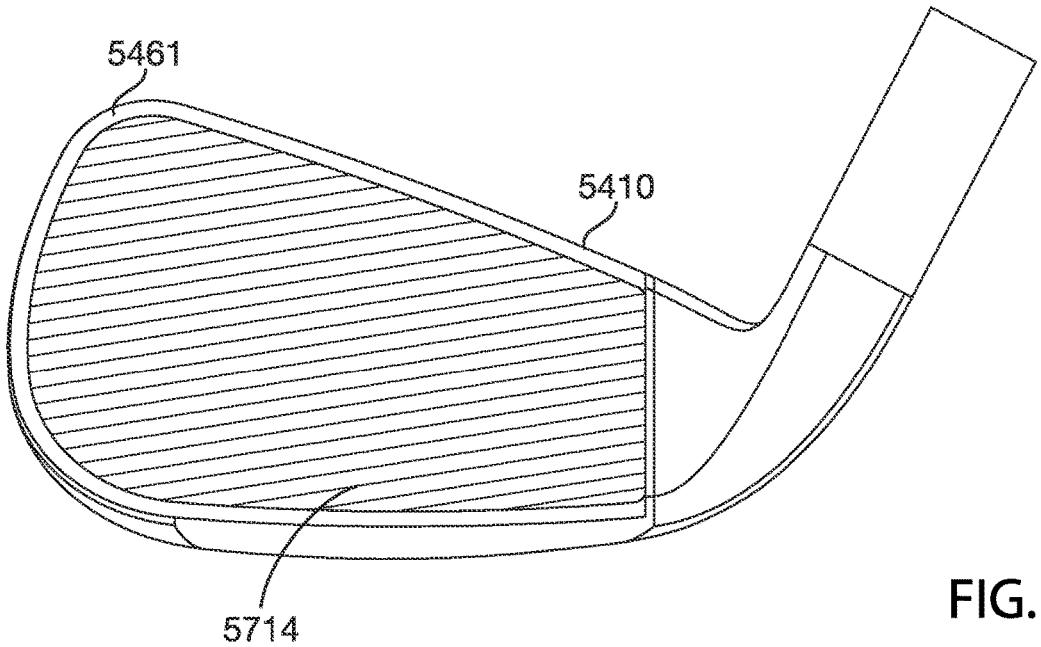
Figure 62:
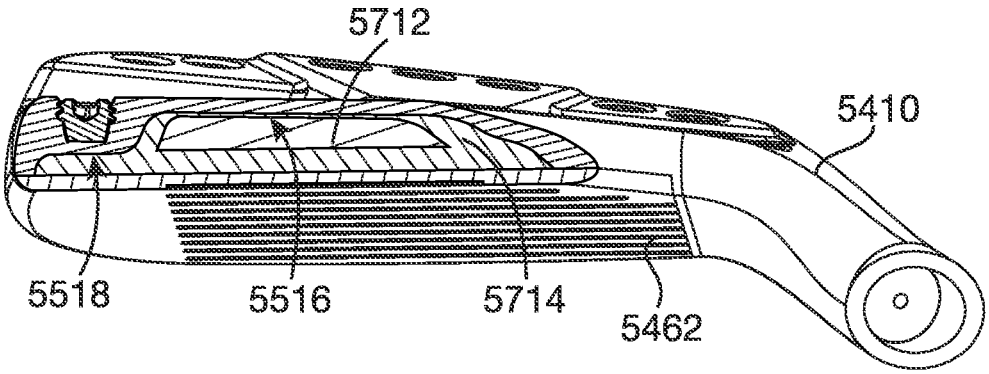
Figure 63:
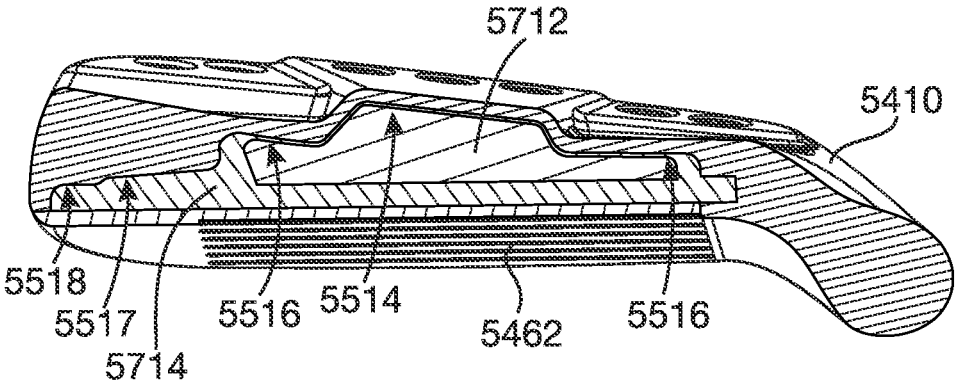
Figure 64:
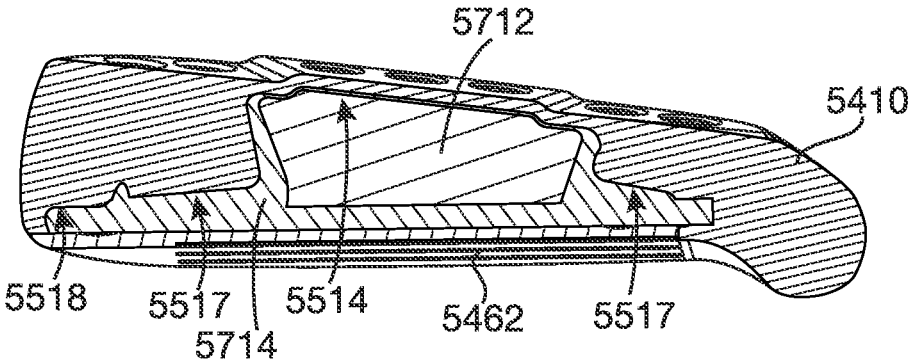

The interior cavity 5510 may include additional recessed portions that may define transition regions between the first to fifth recessed portions 5514-5518 and the internal channels 5525 and 5526. Each of the recessed portions may be adjacent to and transition into any one or several of the other recessed portions. For example, as shown in FIGS. 57-59, the first recessed portion 5514 may include an inclined surface 5527 that may transition and connect to the third recessed portion 5516 above the first recessed portion 5514. Further, any of the recessed portions may directly transition to the perimeter edge portion 5461. The recessed portions and the transition regions may collectively define the overall shape and/or contour of the interior cavity 5510. The transition regions may include walls that are perpendicular, transverse, or include relative to adjacent recessed portions. Further, the transition regions may include rounded corners when joining an adjacent recessed portion to reduce stress concentrations at the joined corner. The recessed portions may define a contoured, continuous, and/or stepped reduction of the width of the interior cavity 5510 form the central portion 5511 to the perimeter edge portion 5461. The apparatus, methods, and articles of manufacture described herein are not limited in this regard.

The shape, size, width, height, and other characteristics of the recessed portions 5514-5518 and the internal channels 5525 and 5526 may be associated with the loft angle 5745 of the golf club head 5400. In one example, as shown in FIGS. 54-65, the first recessed portion 5514, the second recessed portion 5515, the third recessed portion 5516, and the internal channels 5525 and 5526 may be filled with the first filler material 5712. The first filler material 5712 may be injection molded in the first recessed portion 5514, the second recessed portion 5515, the third recessed portion 5516, and the internal channels 5525 and 5526. The filler material 5712 may be bonded to the inner walls 5512 of the first recessed portion 5514, the second recessed portion 5515, the third recessed portion 5516, and the internal channels 5525 and 5526 by having inherent adhesive or bonding properties, with a bonding agent that is mixed with the first filler material 5712, and/or a separate bonding agent. In another example, the first filler material 5712 may be separately molded in the shape of the first recessed portion 5514, the second recessed portion 5515, the third recessed portion 5516, and the internal channels 5525 and 5526, and coupled to the first recessed portion 5514, the second recessed portion 5515, the third recessed portion 5516, and the internal channels 5525 and 5526 with a bonding agent. In one example, the remaining portions of the interior cavity 5510, which include the fourth recessed portion 5517 and the fifth recessed portion 5518 may be filled with the second filler material 5714. Accordingly, the second filler material 5714 may be coupled to the back surface 5466 of the face portion 5462, coupled to portions of the inner walls 5512 outside the first recessed portion 5514, the second recessed portion 5515, and the third recessed portion 5516, and/or disposed between the face portion 5462 and the first filler material 5712. In another example, the first recessed portion 5514 and the second recessed portion 5515 may be filled with the first filler material 5712, whereas the remaining portions of the interior cavity 5510 may be filled with the second filler material 5714. In another example, the first recessed portion 5514, the second recessed portion 5515, and the internal channels 5525 and 5526 may be filled with the first filler material 5712, whereas the remaining portions of the interior cavity 5510 may be filled with the second filler material 5714. In another example, the first recessed portion 5514, the second recessed portion 5515, the internal channels 5525 and 5526, the third recessed portion 5516 and the fifth recessed portions 5518 may be filled with the first filler material 5712, whereas the remaining portions of the interior cavity 5510 may be filled with the second filler material 5714. In yet another example, the entire interior cavity 5510 may be filled with the first filler material 5712. The apparatus, methods, and articles of manufacture described herein are not limited in this regard.

A width 5722 ($W_{F1}$) of the first filler material 5712 and the width 5724 ($W_{F2}$) of the second filler material 5714 may vary from the toe portion 5440 to the heel portion 5450 and/or from the top portion 5480 to the sole portion 5490 and/or according to the shapes of the first recessed portion 5514, the second recessed portion 5515, the third recessed portion 5516, the fourth recessed portion 5517, and/or the fifth recessed portion 5518 depending on the location inside the interior cavity 5510. The width 5722 of the first filler material 5712 may vary according to the shapes of the first recessed portion 5514, the second recessed portion 5515, and the third recessed portion 5516. The width 5722 of the first filler material 5712 and/or the width 5724 of the second filler material 5714 may be constant or substantially constant at one or more locations in the interior cavity 5510 and vary at certain other locations in the interior cavity 5510. In one example, the width 5722 of the first filler material 5712 and/or the width 5724 of the second filler material 5714 may vary at one or more locations in the interior cavity 5510 similar or substantially similar to the contour of all or portions of the inner walls 5512 of the interior cavity 5510 (i.e., the contours of the recessed portions) and/or the contours of the boundaries between the first filler material 5712 and the second filler material 5714. In one example, the second filler material 5714 may (i) provide vibration dampening or sound dampening (e.g., consistent and/or pleasing sound and feel when the golf club head 5400 strikes a golf ball as perceived by an individual using the golf club head 5400), (ii) provide structural support for the face portion 5462, and/or (iii) optimize ball travel distance, ball speed, ball launch angle, ball spin rate, ball peak height, ball landing angle and/or ball dispersion. The width 5722 of the first filler material 5712 and width 5724 of the second filler material 5714 may be determined at the ball strike region 5468 and/or other regions of the interior cavity 5510 so that a relatively high or optimum coefficient of restitution (COR) is provided for the golf club head 5400. The apparatus, methods, and articles of manufacture described herein are not limited in this regard.

In one example (not shown), the interior cavity 5510 may be entirely filled with the first filler material 5712. In another example, as shown in FIGS. 54-65, the interior cavity 5510 may be partially filled with the first filler material 5712. Accordingly, the remaining portions of the first interior cavity 5510 may be filled with a second filler material 5714. As described herein, the second filler material 5714 may provide or assist (e.g., alone or in conjunction with one or more adhesives) in the coupling of the first filler material 5712 with the back wall portion 5472. In other words, the second filler material 5714 may assist in maintaining or maintain the first filler material 5712 coupled to the back wall portion 5472. The apparatus, methods, and articles of manufacture described herein are not limited in this regard.

Figure 65:
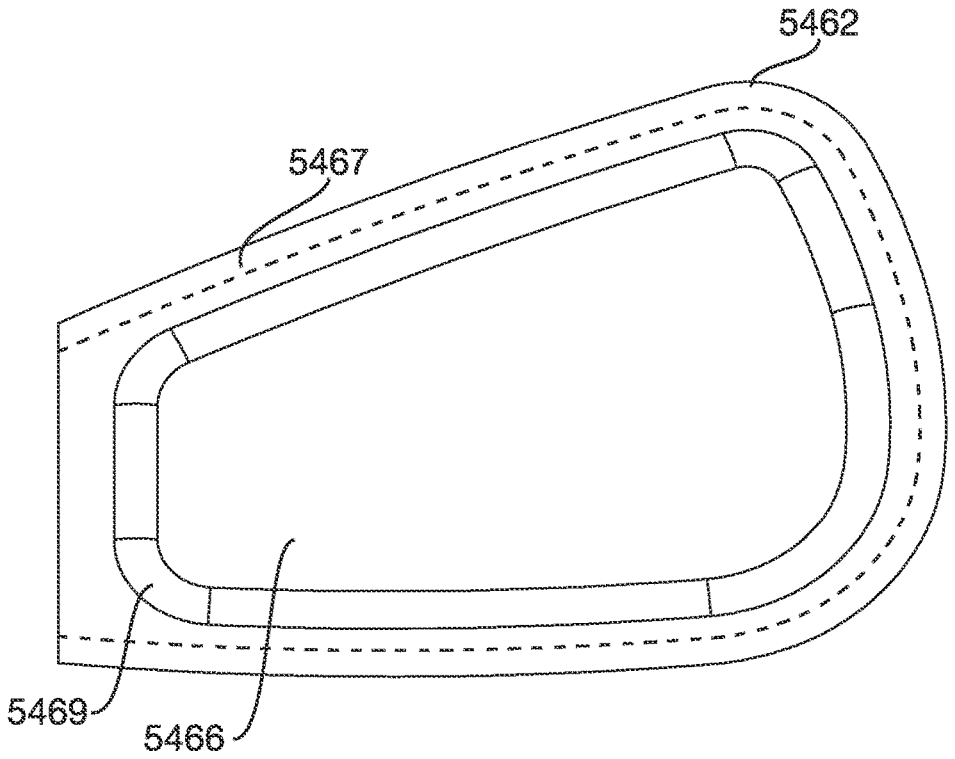

In one example, as shown in FIG. 65, the back surface 5466 of the face portion 5462 may include one or more grooves proximate to the perimeter portion 5467 of the face portion 5462. In one example, as shown in FIG. 65, a groove 5469 may be a continuous groove (i.e., defining a loop) extending in a path similar to the path of the perimeter portion 5467 proximate to the perimeter portion 5467. The groove 5469 may include a relatively thinner portion of the face portion 5462. Accordingly, the groove 5469 may increase the flexibility of the face portion 5462 so that when a golf ball strikes the face portion 5462, the face portion 5462 provides a greater rebound (i.e., a greater trampoline effect), and hence may provide a greater velocity for the golf ball. All or portions of the groove 5469 may be filled with the first filler material 5712 and/or second filler material 5714. In the example of the golf club head 5400, all of the groove 5469 may be filled with the second filler material 5714. Accordingly, the second filler material 5714 may structurally support the relatively thinner portions of the face portion 5462 defined by the groove 5469. In another example, a plurality of separate grooves (not shown) may be provided on the back surface 5466 of the face portion 5462 at certain locations proximate to the perimeter portion 5467 to provide a certain rebound effect for the face portion 5462. In yet another example, a continuous groove similar to the groove 5469 and/or a plurality of separate grooves (not shown) may be provided at certain locations between the perimeter portion 5467 and the geometric center 5463 on the back surface 5466 of the face portion 5462 to provide a certain rebound effect for the face portion 5462. The face portion of any of the golf club heads described herein may include the groove 5469. For example, the face portion 3562 of the golf club head 3500 of FIG. 35 may include a similar groove that may be filled with the second filler material 3814 and/or the first filler material 3812. The apparatus, methods, and articles of manufacture described herein are not limited in this regard.

As described herein, the face portion 5462 may be relatively thin to provide increased bending and deflection of the face portion 5462 during a golf ball strike. Further, the face portion 4862 may include one or more grooves such as the groove 5469 on the back surface 5466 of the face portion 5462 as described herein to further increase the flexibility of the face portion 5462. The second filler material 5714 may be a polymer material with a relatively high strength and stiffness to provide structural support and stability for the face portion 5462 to prevent failure of the face portion 5462 during a golf ball strike or repeated golf ball strikes (i.e., face portion fatigue). As described herein, the second filler material 5714 may be an epoxy-type of material. The second filler material 5714 may also have a relatively high COR as described herein to provide a rebound effect for the face portion 5462 after a golf ball strike. As further described herein, the first filler material 5712 may be a rubber-type of compound with a lower strength and stiffness (i.e., softer or less rigid) than the second filler material 5714 and a higher COR than the second filler material 5714. Accordingly, the first filler material 5712 may provide additional structural support for the face portion 5462. Further, the relatively higher COR of the first filler material 5712 may allow the first filler material 5712 to store the energy from a golf ball strike and to release a substantial amount of the energy back to the golf ball (i.e., without losing much impact energy) by providing a relatively large rebound effect for the face portion 5462. Additionally, the different material properties of the first filler material 5712 and the second filler material 5714 as described herein may provide sound and vibration dampening at different frequency ranges to provide a pleasant sound and feel for an individual. The apparatus, methods, and articles of manufacture described herein are not limited in this regard.

Figure 66:
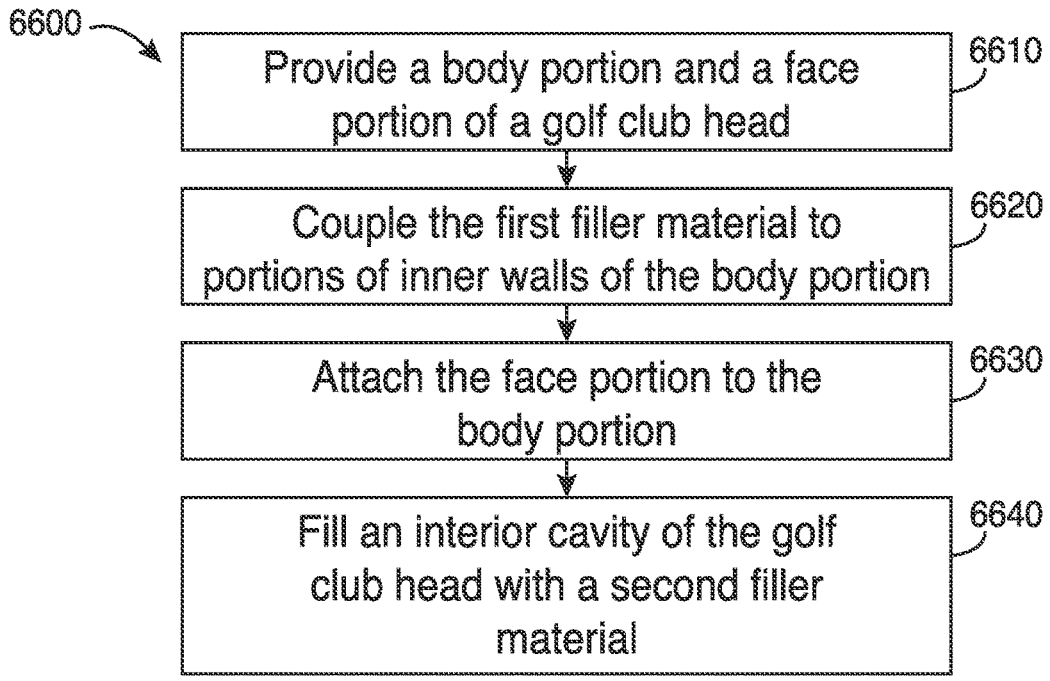
FIG. 66 depicts a manner in which an example golf club head described herein may be manufactured.
Figure 67:
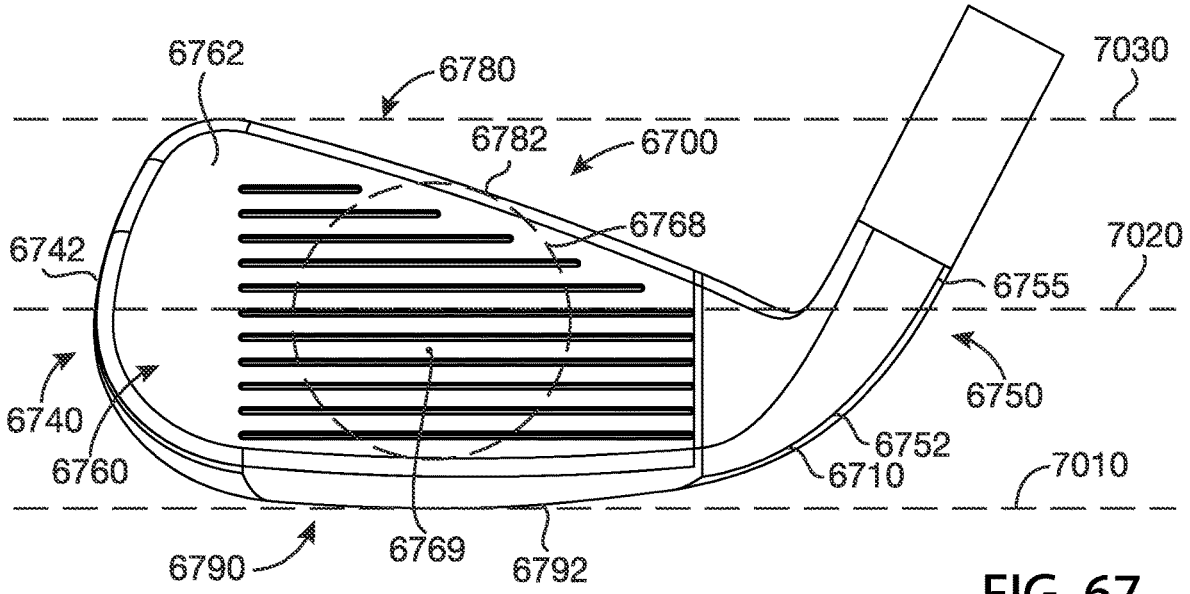
FIGS. 67, 68, 69, 70, 71, and 72 depict a perspective front view, a perspective back view, a perspective front view shown without a face portion, a perspective cross-sectional view (along line 70-70 of FIG. 68), a perspective cross-sectional view (along line 71-72 of FIG. 68), and a perspective cross-sectional view (along line 72-72 of FIG. 68), respectively, of a golf club head according to an embodiment of the apparatus, methods, and articles of manufacture described herein.
Figure 68:
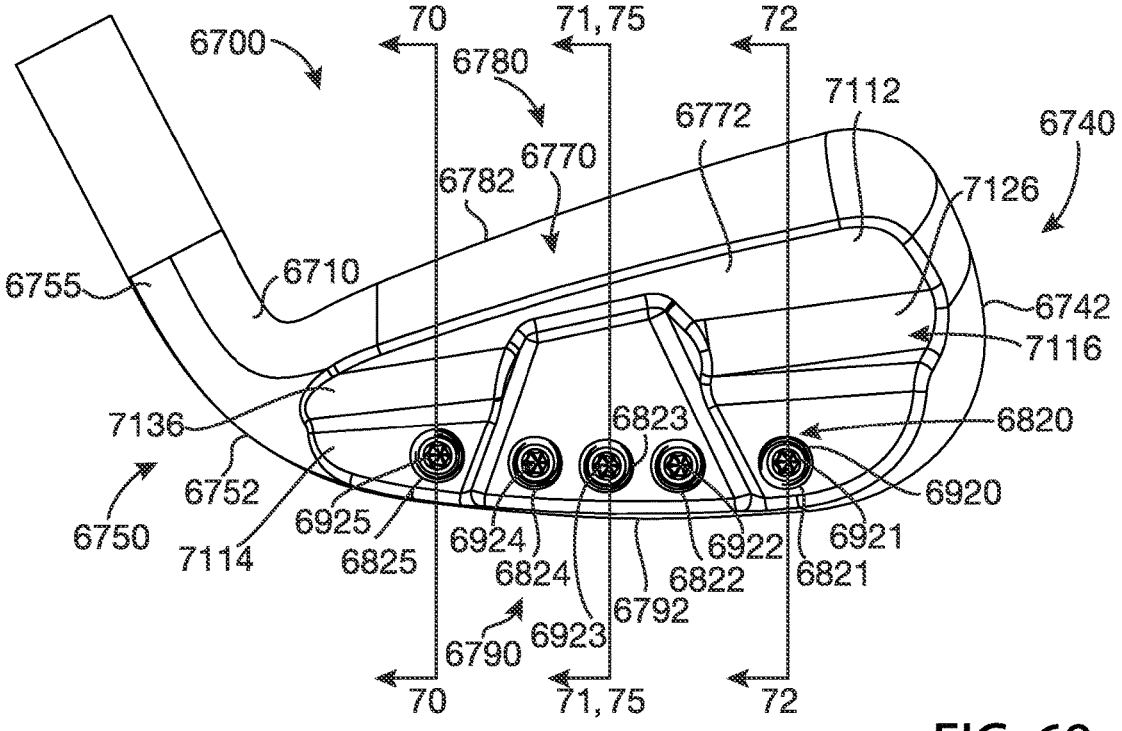
Figure 69:
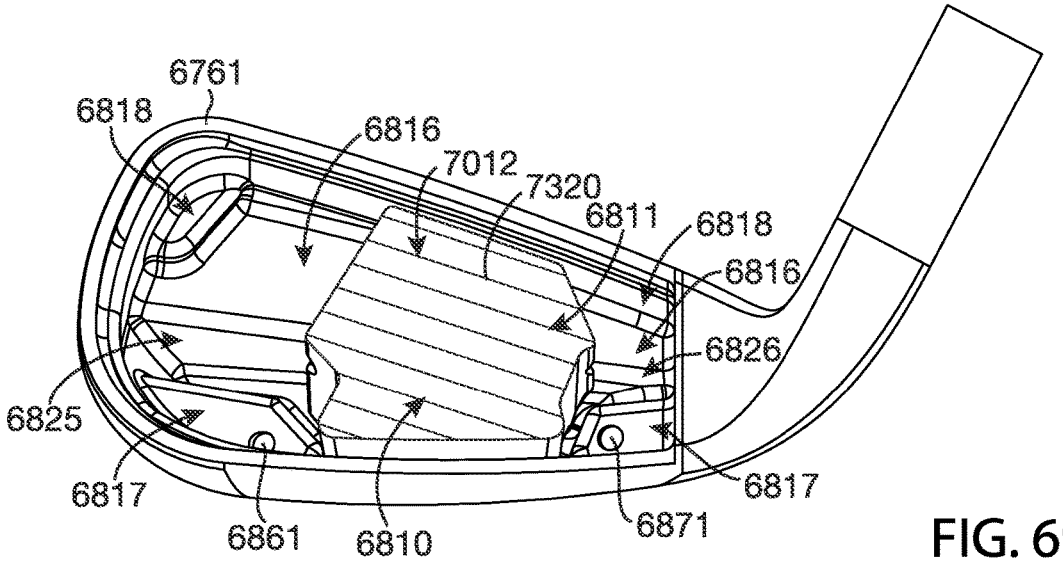
Figure 70:
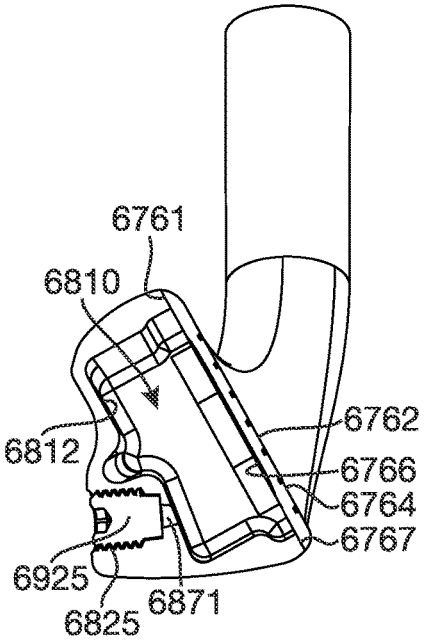
Figure 71:
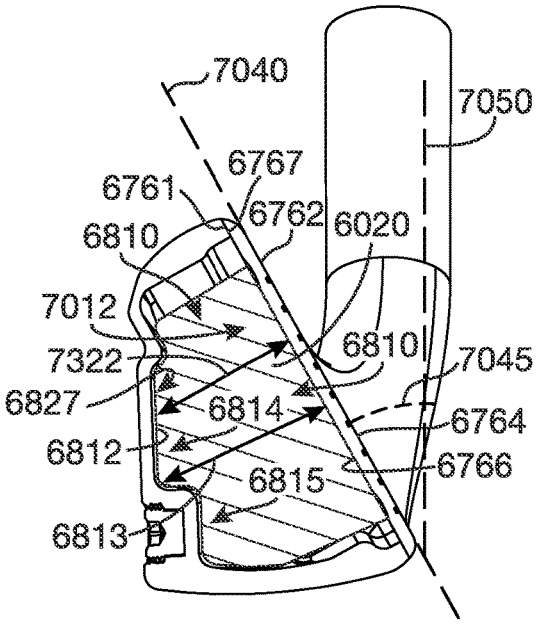
Figure 72:
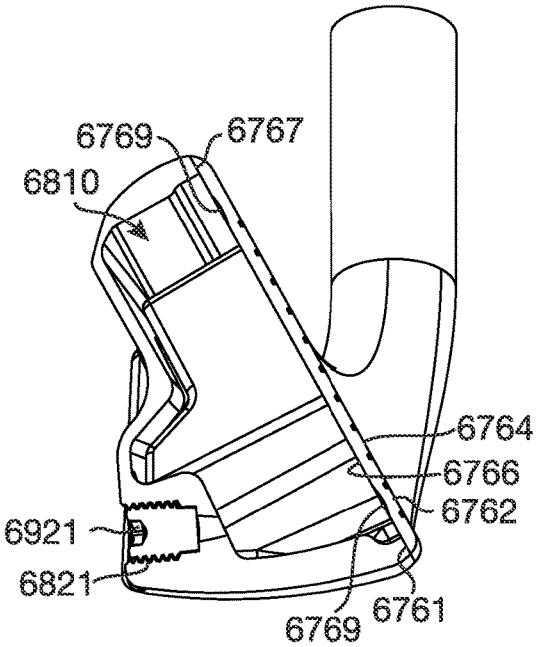

FIG. 66 depicts one manner by which the golf club head 5400 or any of the golf club heads described herein may be manufactured. In the example of FIG. 66, the process 6600 may begin with providing a body portion 5410 and a face portion 5462 of a golf club head 5400 (block 6610). The first filler material 5712 may be coupled to the interior cavity 5510 (block 6620). In one example, the first filler material 5712 may be formed in one or more recessed portions as described herein (i.e., any of the recessed portions described herein) of the interior cavity 5510 by injection molding. The first filler material 5712 may then cure at ambient temperature or by one or more heating/cooling cycles depending on the material used for the first filler material 5712. In another example, the first filler material 5712 may be molded into the shape of one or more recessed portions as described herein and then coupled to the one or more recessed portions with a bonding agent as described herein. The face portion 5462 may then be attached to the body portion 5410 as described herein to enclose the interior cavity 5510 (block 6630). The second filler material 5714 may then be injected into the interior cavity 5510 through one or more of the ports of the first set of ports 5520, the second set of ports 5530, the third set of ports 5540, and/or the fourth set of ports 5550 that may be connected to the interior cavity 5510 as described herein (block 6640). The second filler material 5714 may then cure at ambient temperature or by one or more heating/cooling cycles depending on the material used for the second filler material 5714. The apparatus, methods, and articles of manufacture described herein are not limited in this regard.

In the example of FIGS. 67-86, a golf club head 6700 may include a body portion 6710 having a toe portion 6740 with a toe portion edge 6742, a heel portion 6750 with a heel portion edge 6752 that may include a hosel portion 6755 configured to receive a shaft (not shown) with a grip (not shown) on one end and the golf club head 6700 on the opposite end of the shaft to form a golf club, a front portion 6760 with a perimeter edge portion 6761, a back portion 6770 with a back wall portion 6772, a top portion 6780 with a top portion edge 6782, and a sole portion 6790 with a sole portion edge 6792. The toe portion 6740, the heel portion 6750, the front portion 6760, the back portion 6770, the top portion 6780, and/or the sole portion 6790 may partially overlap each other. The toe portion edge 6742, the heel portion edge 6752, the top portion edge 6782, and the sole portion edge 6792 may define a periphery of the body portion 6710. The apparatus, methods, and articles of manufacture described herein are not limited in this regard.

The golf club head 6700 may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees)(°, 48°, 52°, 56°, 60°, etc.). Although FIGS. 67-86 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The volume of the golf club head 6700, the materials of construction of the golf club head 6700, and/or any components thereof may be similar to any of the golf club heads described herein and/or described in any of the incorporated by reference applications. The apparatus, methods, and articles of manufacture described herein are not limited in this regard.

The golf club head 6700 may include a face portion 6762 (i.e., the strike face), which may be integrally formed with the body portion 6710 (e.g., a single unitary piece). In one example, as shown in FIGS. 67-86, the face portion 6762 may be a separate piece coupled (e.g., adhesively, mechanically, by welding, and/or by soldering) to the front portion 6760. The face portion 6762 may include a front surface 6764 and a back surface 6766. In one example (not shown), the front portion 6760 may include one or a plurality of recessed shoulders configured to receive the face portion 6762 for attachment of the face portion 6762 to the body portion 6710. In another example, as shown in FIGS. 67-86, the back surface 6766 may include a perimeter portion 6767 that may be attached to a perimeter edge portion 6761 of the body portion 6710. The perimeter portion 6767 of the face portion 6762 may be attached to the perimeter edge portion 6761 of the body portion 6710 by one or more fasteners, one or more adhesive or bonding agents, and/or welding or soldering. In one example, as shown in FIGS. 67-86, the perimeter portion 6767 of the face portion 6762 may be welded to the perimeter edge portion 6761 of the body portion 6710 at one or more locations. Alternatively, the entire perimeter portion 6767 of the face portion 6762 may be welded to the entire perimeter edge portion 6761 of the body portion 6710 (i.e., a continuous weld). The face portion 6762 may include a ball strike region 6768 to strike a golf ball. In one example, the center of the ball strike region 6768 may be a geometric center 6763 of the face portion 6762. In another example, the geometric center 6763 of the face portion 6762 may be offset from a center of the ball strike region 6768. In one example, the geometric center 6743 and one or more regions near and/or surrounding the geometric center within the ball strike region 6768 may provide a generally optimum location (i.e., optimum ball distance, ball speed, ball spin characteristics, etc.) on the face portion 6762 for striking a golf ball. In yet another example, any location at or near the geometric center 6763 and within the ball strike region 6768 may provide a generally optimum location on the face portion 6762 for striking a golf ball. However, a ball may be struck with any portion of the face portion 4862 within the ball strike region 6768 or outside the ball strike region 6768 for any of the golf club heads described herein resulting in certain ball flight characteristics different from an on-center hit that may be preferred by an individual. The configuration of the face portion 6762 and the attachment of the face portion 6762 (e.g., welding) to the body portion 6710 may be similar in many respects to any of the golf club heads described herein and/or described in any of the incorporated by reference applications. The face portion 6762 may include a groove 6769 (shown in FIG. 72) that may be similar in many respects to the groove 5469 of the golf club head 5400. The apparatus, methods, and articles of manufacture described herein are not limited in this regard.

The golf club head 6700 may be associated with a ground plane 7010, a horizontal midplane 7020, and a top plane 7030. In particular, the ground plane 7010 may be a plane that is parallel or substantially parallel to the ground and is tangent to the lowest portion of the sole portion edge 6792 when the golf club head 6700 is at an address position (e.g., the golf club head 6700 aligned to strike a golf ball). A top plane 7030 may be a plane that is tangent to the upper most portion of top portion edge 6782 when the golf club head 6700 is at the address position. The ground and top planes 7010 and 7030, respectively, may be parallel or substantially parallel to each other. The horizontal midplane 7020 may be vertically halfway between the ground and top planes 7010 and 7030, respectively. Further, the golf club head 6700 may be associated with a loft plane 7040 defining a loft angle 7045 (*a*) of the golf club head 6700. The loft plane 7040 may be a plane that is tangent to the face portion 6762. The loft angle 7045 may be defined by an angle between the loft plane 7040 and a vertical plane 7050 normal to the ground plane 7010.

The body portion 6710 may be a hollow body including an interior cavity 6810 having inner walls 6812. The interior cavity 6810 may extend between the front portion 6760, the back portion 6770, the top portion 6780, and the sole portion 6790. In the example of FIGS. 67-86, the interior cavity 6810 of the body portion 6710 may be enclosed with and partially defined with the face portion 6762. The configuration of the interior cavity 6810 (e.g., height, width, volume, shape, etc.), the configuration of the interior cavity 6810 relative to the body portion 6710 (e.g., volume of the interior cavity 6810 relative to the volume of body portion 6710), the width and height variation of the interior cavity 6810, and access to the interior cavity 6810 from one or more ports on the body portion 6710 may be similar to any of the golf club heads described herein and/or described in any of the incorporated by reference applications. The apparatus, methods, and articles of manufacture described herein are not limited in this regard.

The back wall portion 6772 of the back portion 6770 may include an upper back wall portion 7112 and a lower back wall portion 7114. The back wall portion 6772 may include a ledge portion 7116 that may extend between the toe portion edge 6742 and the heel portion edge 6752 in a continuous or discontinuous manner. The lower back wall portion 7114 may be located farther back on the body portion 6710 than the upper back wall portion 7112, with the ledge portion 7116 defining a transition portion between the upper back wall portion 7112 and the lower back wall portion 7114. Accordingly, the ledge portion 7116 may extend transverse to the upper back wall portion 7112 and the lower back wall portion 7114. In one example, as shown in FIG. 67-86, the ledge portion 7116 may include a first ledge portion 7126 and a second ledge portion 7136. The first ledge portion 7126 may extend on the back wall portion from the toe portion edge 6742 to a back wall center portion 7140 of the back wall portion 6772. The second ledge portion 7136 may extend from the center portion 7140 of the back wall portion 6772 to the heel portion edge 6752. As shown in FIGS. 67-86, the ledge portion 7116 may provide for a relatively greater mass of the body portion 6710 below the horizontal midplane 7020, and the mass of the body portion 6710 below the horizontal midplane 7020 to be moved farther back on the body portion 6710. The width of the ledge portion 7116 may be greater than, equal to, or less than the width of the interior cavity at certain locations of the body portion 6710. The configuration of the ledge portion 7116 (e.g., width, segments, tapering, shape, etc.) and the properties of the ledge portion 7116 relative to the width of the interior cavity may be similar to any ledge portion or similar structure of any of the golf club heads described herein and/or described in any of the incorporated by reference applications. The apparatus, methods, and articles of manufacture described herein are not limited in this regard.

The body portion 6710 may include one or more ports, which may be exterior ports and/or interior ports (e.g., located inside the body portion 6710). The inner walls 6812 of the interior cavity 6810 may include one or more ports (not shown). In one example, as shown in FIGS. 67-86, the back portion 6770 may include one or more ports along or proximate to the periphery of the body portion 6710. For example, the body portion 6710 may include a set of ports 6820 (e.g., shown as port 6821, 6822, 6823, 6824, and 6825. Each port of the set of ports 6820 may be separated by a distance less than, equal to, or greater than the port diameter of any of the ports of the set of ports 6820. In one example, the ports 6821 and 6822 may be separated by a distance greater than the port diameter of any of the ports 6821 or 6822. Similarly, the ports 6824 and 6825 may be separated by a distance greater than the port diameter of any of the ports 6824 or 6825. The ports 6822, 6823, and 6824 may be separated by a distance less than the port diameter of any of the ports 6822, 6823, or 6824. Any one or more of the ports of the set of ports 6820 may be combined into a single port. The locations, spacing relative to other ports, and any other configuration of each port of the set of ports 6820 may be similar in many respects to any of the ports described herein or described in any of the incorporated by reference applications. Further, any one or more of the ports of the set of ports 6820 may be connected to interior cavity 6810 through which one or more filler materials may be injected into the interior cavity 6810. In the example of FIGS. 67-86, the ports 6821 and 6825 may be connected to the interior cavity 6810 via openings 6861 and 6871, respectively. The apparatus, methods, and articles of manufacture described herein are not limited in this regard.

The body portion 6710 may include one or more mass portions (e.g., weight portion(s)), which may be integral mass portion(s) or separate mass portion(s) that may be coupled to the body portion 6710. In the illustrated example as shown in FIGS. 67-86, the body portion 6710 may include a set of mass portions 6920 (e.g., shown as mass portions 6921, 6922, 6923, 6924, and 6925). While the above example may describe a particular number or portions of mass portions, a set of mass portions may include a single mass portion, or a plurality of mass portions as described in any of the incorporated by reference applications. For example, any one or a combination of adjacent mass portions of the set of mass portions 6920 may be a single mass portion. Further, the set of mass portions 6920 may be a portion of the physical structure of the body portion 6710. The mass portions of the set of mass portions 6920 may be similar to any of the mass portions described in any of the incorporated by reference applications. The apparatus, methods, and articles of manufacture described herein are not limited in this regard.

The interior cavity 6810 may be partially or entirely filled with one or more filler materials (i.e., a cavity filling material) as described herein, which may include one or more similar or different types of materials. In one example, as shown in FIGS. 67-86, the interior cavity 6810 may be filled with a filler material 7012, which may be similar to the filler material 5112 or the filler material 5712, or similar to any of the filler materials described herein or described in any of the incorporated by reference applications. The apparatus, methods, and articles of manufacture described herein are not limited in this regard.

The filler material 7012 may be coupled to all or portions of the inner walls 6812 of the interior cavity 6810. In one example, the filler material 7012 may have inherent adhesive or bonding properties to attach to all or portions of the inner walls 6812. In another example, the filler material 7012 may be attached to all or portions of the inner walls 6812 with one or more bonding agents or adhesives that may be mixed with the filler material 7012. In another example, the filler material 7012 may be attached to all or portions of the inner walls 6812 with one or more bonding agents or adhesives that may be separate from the filler material 7012. The apparatus, methods, and articles of manufacture described herein are not limited in this regard.

In one example, the filler material 7012 may be coupled to at least a portion of the inner walls 6812 that may generally correspond to the ball strike region 6768 of the face portion 6762 (i.e., the filler material 7012 may be generally located behind the ball strike region 6768) or regions proximate to and/or surrounding the ball strike region 6768 of the face portion 6762. In another example, the filler material 7012 may be coupled to at least 10% of the inner walls 6812. In another example, the filler material 7012 may be coupled to at least 25% of the inner walls 6812. In yet another example, the filler material 7012 may be coupled to between 25% and 50% of the inner walls 6812. In another example, the filler material 7012 may be coupled to between 54% and 75% of the inner walls 6812. In yet another example, the filler material 7012 may be coupled to between 50% and 90% of the inner walls 6812. In yet another example, the filler material 7012 may be coupled to more than 75% of the inner walls 6812. In yet another example, the filler material 7012 may be coupled to all of inner walls 6812. The apparatus, methods, and articles of manufacture described herein are not limited in this regard.

The amount of the filler material 7012 that may be coupled to the inner walls 6812 may depend on the loft angle of the golf club head, the overall thickness of the face portion 6762, the thickness profile of the face portion 6762, the shape of the interior cavity 6810, the locations and configurations of any ports or mass portions, and/or the material properties of the filler material 7012. In one example, a golf club head with a relatively high loft angle may limit the portions of the inner walls 6812 to which the filler material 7012 may be coupled. In another example, a golf club head with a relatively small loft angle may allow the filler material 7012 to be coupled to all or substantial portions of the inner walls 6812. In yet another example, the acoustic properties of a golf club head may be a factor in determining the amount of filler material 7012 that may be coupled to the inner walls 6812 to provide a pleasing sound and feel to an individual. The amount (i.e., volume and/or mass) of the filler material 7012 coupled to the inner walls 6812 may be determined for each golf club head (i.e., having a certain loft angle) to (i) provide vibration dampening or sound dampening (e.g., consistent and/or pleasing sound and feel when the golf club head 6700 strikes a golf ball as perceived by an individual using the golf club head 6700), (ii) provide structural support for the face portion 6762, and/or (iii) optimize ball travel distance, ball speed, ball launch angle, ball spin rate, ball peak height, ball landing angle and/or ball dispersion. The apparatus, methods, and articles of manufacture described herein are not limited in this regard.

In the example of FIGS. 67-86, a portion of the interior cavity 6810 including a central portion 6811 of the interior cavity 6810, which may be a portion of the interior cavity 6810 that may generally correspond to the ball strike region 6768, may be include the filler material 7012. The width 6813 of the interior cavity 6810 at the central portion 6811 of the interior cavity 6810 may be generally greater than the width 6813 of the interior cavity 6810 at other portions of the interior cavity 6810. Accordingly, the region of the interior cavity 6810 behind the ball strike region 6768, i.e., the central portion 6811, may include a relatively large volume of the filler material 7012. Further, the configuration of the central portion 6811 (i.e., size, shape, contour, volume, etc.) may depend on the loft angle 7045. For example, a golf club head 6700 with a relatively small loft angle 7045 may have a larger central portion 6811 (i.e., larger volume, depth, height, etc.) than a golf club head 6700 with a relatively large loft angle 7045. Accordingly, as described herein, the amount of filler material 7012 inside the interior cavity 6810, and more specifically, in the central portion 6811 may be determined based on the loft angle 7045 to provide (i) provide vibration dampening or sound dampening (e.g., consistent and/or pleasing sound and feel when the golf club head 6700 strikes a golf ball as perceived by an individual using the golf club head 6700), (ii) provide structural support for the face portion 6762, and/or (iii) optimize ball travel distance, ball speed, ball launch angle, ball spin rate, ball peak height, ball landing angle and/or ball dispersion. The apparatus, methods, and articles of manufacture described herein are not limited in this regard.

The contour of the interior cavity 6810 or the shape of the inner walls 6812 may be defined by a plurality of recessed portions that are recessed relative to the perimeter edge portion 6761. In the example of FIGS. 67-86, the interior cavity 6810 may include a first recessed portion 6814, a second recessed portion 6815 that may have a generally smaller depth relative to the first recessed portion 6814, a third recessed portion 6816 that may have a generally smaller depth than the second recessed portion 6815, a fourth recessed portion 6817 that may have a generally smaller depth than the third recessed portion 6816, and a fifth recessed portion 6818 that may have a generally smaller depth than the fourth recessed portion 6817. The interior cavity 6810 may have more or less recessed portions. The apparatus, methods, and articles of manufacture described herein are not limited in this regard.

The first recessed portion 6814 may generally include a largest width 6813 of the interior cavity 6810 and may be located at the central portion 6811 and/or may include portions that are adjacent to and/or surround the central portion 6811. The second recessed portion 6815 may be adjacent to and/or surround all or portions of the first recessed portion 6814 and may include portions that may be in the central portion 6811. In the example of FIGS. 67-86, the second recessed portion 6815 is located below the first recessed portion 6814. A portion of the structure of the body portion 6710 that includes the ports 6822, 6823, and 6824 may be between the second recessed portion 6815 and the lower back wall portion 7114. Accordingly, the depth of the second recessed portion 6815 may be less than the depth of the first recessed portion 6814 so that the body portion 6710 can accommodate the ports 6822, 6823, and 6824 between the second recessed portion 6815 and the lower back wall portion 7114. The apparatus, methods, and articles of manufacture described herein are not limited in this regard.

The third recessed portion 6816 may be adjacent to and/or surround all or portions of the second recessed portion 6815 and/or the first recessed portion 6814 and may include portions that may be in the central portion 6811. In the example of FIGS. 67-86, the third recessed portion 6816 surrounds the first recessed portion 6814 above the horizontal midplane 7020. The fourth recessed portion 6817 may be at or proximate to the perimeter edge portion 6761, and/or may be adjacent to and/or surround all or portions of the third recessed portion 6816, the second recessed portion 6815, and/or the first recessed portion 6814. In the example of FIGS. 67-86, the fourth recessed portion 6817 is adjacent to portions of the first recessed portion 6814 and the second recessed portion 6815 below the horizontal midplane 7020. The fifth recessed portion 6818 may be adjacent to the perimeter edge portion 6761. Accordingly, at any location in the interior cavity 6810 that includes the fifth recessed portion 6818, the fifth recessed portion 6818 may be between the perimeter edge portion 6761 and any one or more of the first recessed portion 6814, the second recessed portion 6815, the third recessed portion 6816, and the fourth recessed portion 6817. The apparatus, methods, and articles of manufacture described herein are not limited in this regard.

The interior cavity 6810 may include one or more internal channels that may extend between the toe portion 6740 and the heel portion 6750. In one example, as shown in FIGS. 67-86, the interior cavity 6810 may include a first internal channel 6825 that may extend from a location at the toe portion 6740 to the central portion 6811, and a second internal channel 6826 that may extend from a location at the heel portion 6750 to the central portion 6811. The first internal channel 6825 and the second internal channel 6826 connect to the first recessed portion 6814 and may have the same depth as the first recessed portion 6814 at or proximate to the central portion 6811. The depths of the first internal channel 6825 and the second internal channel 6826 may diminish from the first recessed portion 6814 toward the toe portion 6740 and heel portion 6750, respectively. As shown in the example of FIGS. 67-86, portions of the first internal channel 6825 and/or the second internal channel 6826 that connect to the first recessed portion 6814 and/or are proximate to the first recessed portion 6814 may maintain a constant depth that may be similar to the depth of the first recessed portion 6814. Alternatively, all or portions of the first internal channel 6825 and/or the second internal channel 6826 may have diminishing depths in a direction toward the toe portion 6740 and the heel portion 6750, respectively. For off-center hits of a golf ball with the face portion 6762, the increased volume of the filler material 7012 in the internal channels 6825 and 6826 may (i) provide vibration dampening or sound dampening, (ii) provide structural support for the face portion 6762, and/or (iii) optimize ball travel distance, ball speed, ball launch angle, ball spin rate, ball peak height, ball landing angle and/or ball dispersion. Further, the mass that is removed from the body portion 6710 to provide the internal channels 6825 and 6826 may be shifted to other locations on the body portion 6710 to increase and/or optimize the moment of inertia and the location of the center of gravity of the golf club head 6700. The apparatus, methods, and articles of manufacture described herein are not limited in this regard.

The interior cavity 6810 may include additional recessed portions that may define transition regions between the first to fifth recessed portions 6814-6818 and the internal channels 6825 and 6826. Each of the recessed portions may be adjacent to and transition into any one or several of the other recessed portions. For example, the first recessed portion 6814 may include an inclined surface 6827 (shown in FIG. 71) that may transition and connect to the third recessed portion 6816 above the first recessed portion 6814. Further, any of the recessed portions may directly transition to the perimeter edge portion 6761. The recessed portions and the transition regions may collectively define the overall shape and/or contour of the interior cavity 6810. The transition regions may include walls that are perpendicular, transverse, or include relative to adjacent recessed portions. Further, the transition regions may include rounded corners when joining an adjacent recessed portion to reduce stress concentrations at the joined corner. The recessed portions may define a contoured, continuous, and/or stepped reduction of the width of the interior cavity 6810 form the central portion 6811 to the perimeter edge portion 6761. The apparatus, methods, and articles of manufacture described herein are not limited in this regard.

The shape, size, width, height, and other characteristics of the recessed portions 6814-6818 and the internal channels 6825 and 6826 may be associated with the loft angle 7045 of the golf club head 6700. In one example, as shown in FIGS. 67-86, the first recessed portion 6814, the second recessed portion 6815, and the third recessed portion 6816 may be filled with the filler material 7012. The filler material 7012 may be injection molded in the first recessed portion 6814, the second recessed portion 6815, and the third recessed portion 6816. The filler material 7012 may be bonded to the inner walls 6812 of the first recessed portion 6814, the second recessed portion 6815, and the third recessed portion 6816 by having inherent adhesive or bonding properties, with a bonding agent that is mixed with the filler material 7012, and/or a separate bonding agent. In another example, the filler material 7012 may be separately molded in the shape of the first recessed portion 6814, the second recessed portion 6815, and the third recessed portion 6816, and coupled to the first recessed portion 6814, the second recessed portion 6815, and the third recessed portion 6816 with a bonding agent. In one example, the remaining portions of the interior cavity 6810, which include the fourth recessed portion 6817 and the fifth recessed portion 6818 may be unfilled. The apparatus, methods, and articles of manufacture described herein are not limited in this regard.

Figure 73:
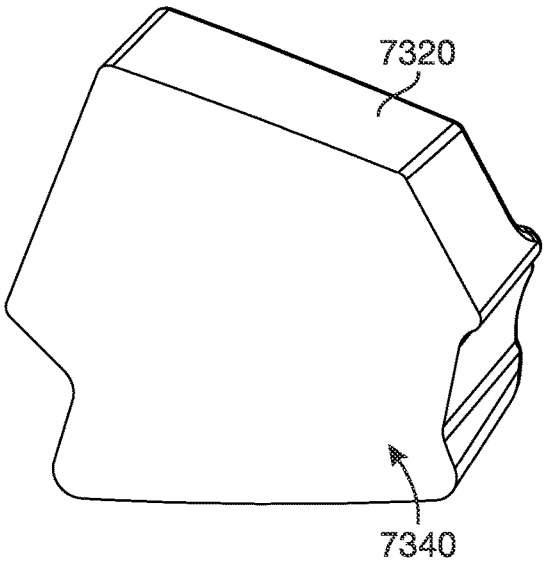
FIGS. 73 and 74 depict a front perspective view and a rear perspective view, respectively, of a filler insert according to an embodiment of the apparatus, methods, and articles of manufacture described herein.
Figure 74:
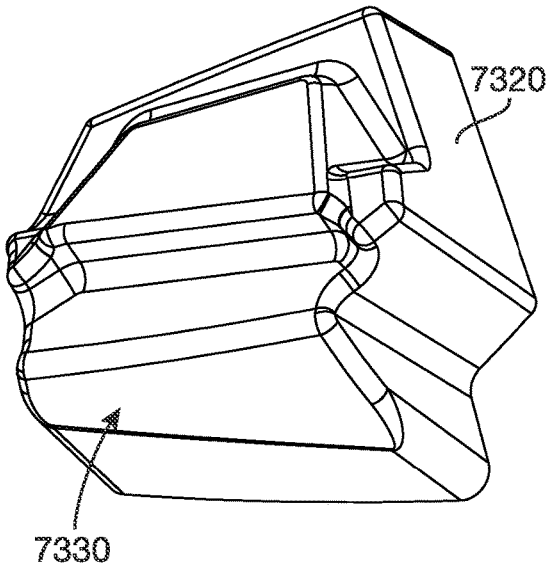
Figure 75:
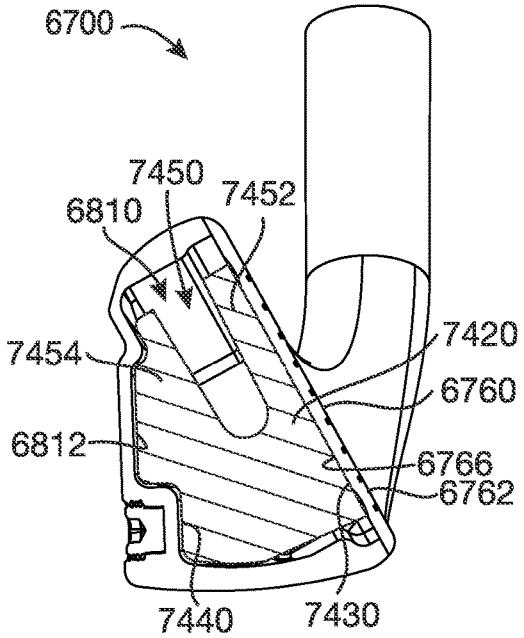
FIG. 75 depicts a perspective cross-sectional view of the golf club head of FIG. 67 taken at line 71-71 of FIG. 68 with a filler insert according to another embodiment of the apparatus, methods, and articles of manufacture described herein.
Figure 76:
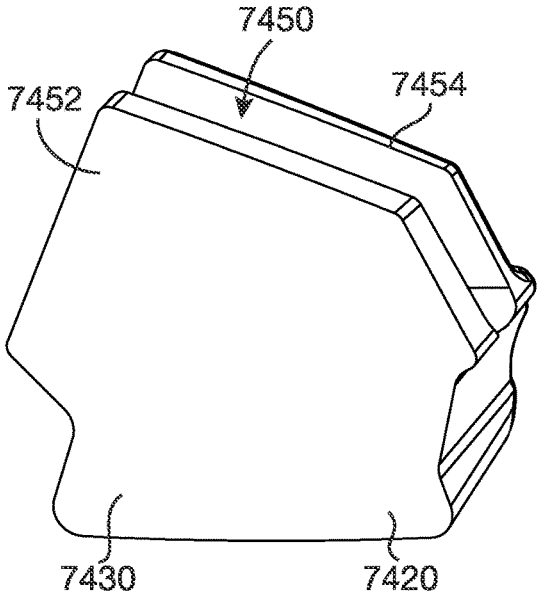
FIGS. 76, 77, and 78 depict a front perspective view, a rear perspective view, and a side perspective view of the filler insert of FIG. 75.
Figure 77:
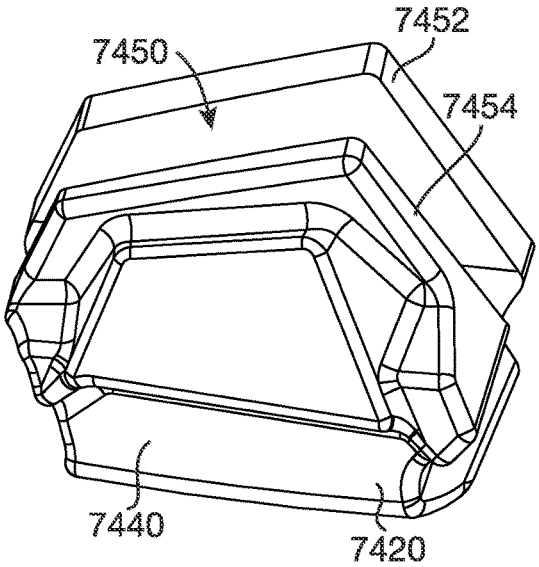
Figure 78:
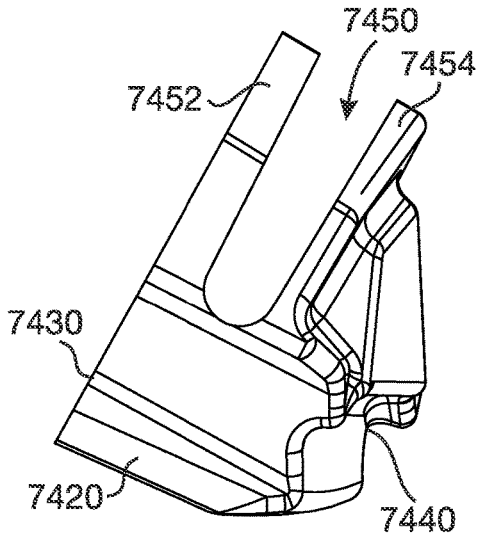

A width of the filler material 7012 may vary from the toe portion 6740 to the heel portion 6750 and/or from the top portion 6780 to the sole portion 6790 and/or according to the shapes of the first recessed portion 6814, the second recessed portion 6815, the third recessed portion 6816, the fourth recessed portion 6817, the fifth recessed portion 6818 depending on the location inside the interior cavity 6810, and/or similar to widths of any of the filler materials described herein. In one example, as shown in FIGS. 67-86, the filler material 7012 may be a filler insert 7320 having a width 7322 ($W_{F1}$) that may be similar or slightly greater than the width 6813 of the interior cavity 6810. Accordingly, the filler insert 7320 may extend from the inner wall 6812 of the interior cavity 6810 to the back surface 6766 of the face portion 6762. The filler insert 7320 may include a front surface 7330 and a back surface 7340. The distance between the front surface 7330 and the back surface 7340 may define the width 7322 of the filler insert 7320. The back surface 7340 may be coupled (i.e., contact, engage, attached, or bonded) to the inner walls 6812 of the interior cavity 6810. To provide a continuous coupling or substantially continuous coupling between the filler insert 7320 and the inner walls 6812 of the interior cavity 6810, the back surface 7340 may have a shape that corresponds or substantially corresponds to the shapes of portions of the inner walls 6812 of the interior cavity 6810 to which the filler insert 7320 may be coupled. Accordingly, as shown in the example of FIG. 74, the back surface 7340 may have a shape that may correspond to portions of the first recessed portion 6814, the second recessed portion 6815, the third recessed portion 6816, the first internal channel 6825, the second internal channel 6826, and any inner wall transition portions (i.e., transition portions between recessed portions and/or channels) that the filler insert 7320 may be coupled. To provide a continuous coupling or substantially continuous coupling between the first filler insert 7320 and the back surface 6766 of the face portion 6762, the front surface 7330 of the filler insert 7320 may have a shape that corresponds or substantially corresponds to the shape of the back surface 6766 of the face portion 6762. In one example, as shown in FIG. 73, the front surface 7330 of the filler insert 7320 may be planar. In another example (not shown), the front surface 7330 may have groove, ridges, channels, slots, dimples, inverted cones, and/or various other shapes and contours that may resemble corresponding shapes of the back surface of the face portion 6762 and/or account for various thickness profiles of the face portion 6762 to provide continuous or substantially continuous coupling between the first filler insert 7320 and the face portion 6762. The apparatus, methods, and articles of manufacture described herein are not limited in this regard.

The adhesive for bonding the filler insert 7320 to the inner walls 6812 of the interior cavity 6810 and to the back surface 6766 of the face portion 6762 may be similar to any of the adhesive or bonding agents described herein. In one example, the adhesives for bonding the filler insert 7320 to the inner walls 6812 of the interior cavity 6810 and to the back surface 6766 of the face portion 6762 may be similar. In another example, the adhesive for bonding the filler insert 7320 to the inner walls 6812 of the interior cavity 6810 and to the back surface 6766 of the face portion 6762 may be different to account for the different materials of the body portion 6710 and the face portion 6762. In yet another example, the adhesive for bonding the filler insert 7320 to the inner walls 6812 of the interior cavity 6810 and the back surface 6766 of the face portion 6762 may be similar to the second filler material 4213. The apparatus, methods, and articles of manufacture described herein are not limited in this regard.

In one example, as shown in FIGS. 75-78, another filler insert 7420 having a front surface 7430 and a back surface 7440 may be similar in many respects to the filler insert 7320 as described herein. The filler insert 7420 may include and upper slot 7450, which may be U-shaped. Accordingly, the upper slot 7450 may include a first arm 7452 and a second arm 7454. The first arm 7452 may be coupled to the back surface 6766 of the face portion 6762. The second arm 7454 may be coupled to the inner walls 6812 of the interior cavity 6810. When the face portion 6762 strikes a golf ball, the first arm 7452 may both compress and deflect toward the second arm 7454 to allow for the corresponding upper portion of the face portion 6762 to have a larger deflection than the lower portion of the face portion 6762. Accordingly, the upper portion of the face portion 6762 may exhibit different ball spin, launch angle, launch speed, and/or trajectory characteristics than the lower portion of the face portion 6762. Further, the filler insert 7420 may absorb shock, isolate vibration, and/or dampen noise when the face portion 6762 strikes a golf ball. The apparatus, methods, and articles of manufacture described herein are not limited in this regard.

Figure 79:
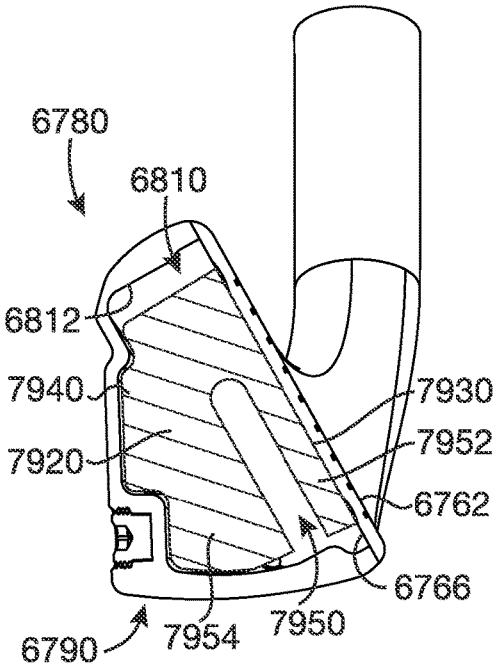
FIGS. 79, 80, 81, 82, 83, 84, 85, and 86 depict perspective cross-sectional views of the golf club head of FIG. 67 taken at line 71-71 of FIG. 68 with filler inserts according to several embodiments of the apparatus, methods, and articles of manufacture described herein.

In one example, as shown in FIG. 79, another filler insert 7920 having a front surface 7930 and a back surface 7940 may be similar in many respects to the filler insert 7320 as described herein. The filler insert 7920 may include a lower slot 7950, which may be U-shaped. Accordingly, the lower slot 7950 may include a first arm 7952 and a second arm 7954. The first arm 7952 may be coupled or bonded to the back surface 6766 of the face portion 6762 as described herein. The second arm 7954 may be coupled to the inner walls 6812 of the interior cavity 6810 as described herein. When the face portion 6762 strikes a golf ball, the first arm 7952 may both compress and deflect toward the second arm 7954 to allow for the corresponding lower portion of the face portion 6762 to have a larger deflection than the upper portion of the face portion 6762. Accordingly, the lower portion of the face portion 6762 may exhibit different ball spin, launch angle, launch speed, and/or trajectory characteristics than the upper portion of the face portion 6762. Further, the filler insert 7920 may absorb shock, isolate vibration, and/or dampen noise when the face portion 6762 strikes a golf ball. The apparatus, methods, and articles of manufacture described herein are not limited in this regard.

Figure 80:
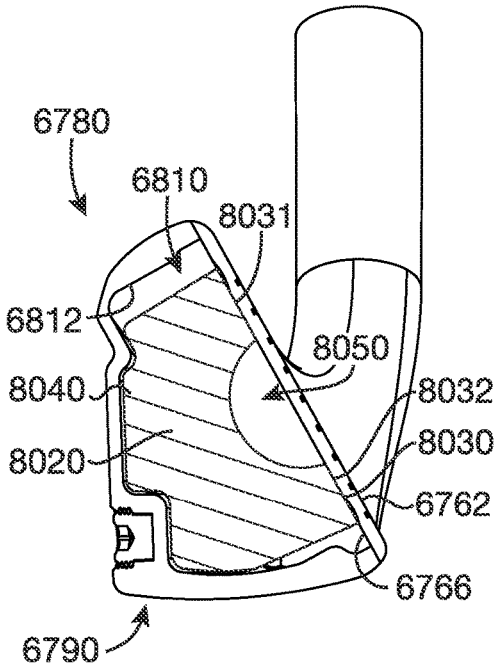

In one example, as shown in FIG. 80, another filler insert 8020 having a front surface 8030 and a back surface 8040 may be similar in many respects to the filler insert 7320 as described herein. The filler insert 8020 may include a front cavity 8050 at the front surface 8030. Accordingly, the front surface 8030 may include an upper front surface 8031 coupled or bonded to the back surface 6766 of the face portion 6762 and a lower front surface 8032 coupled or bonded to the back surface 6766 of the face portion 6762. As shown in the example of FIG. 80, the front cavity 8050 may have a circular shape. In another example (not shown), the front cavity 8050 may have a non-circular shape. In one example, as shown in FIG. 80, the front cavity 8050 may be behind a central portion of the face portion 6762, which may correspond to a general ball strike region of the face portion 6762. When the face portion 6762 strikes a golf ball, the central portion of the face portion 6762 may have a larger deflection than the surrounding portions of the face portion 6762. Accordingly, the central portion of the face portion 6762 may exhibit different ball spin, launch angle, launch speed, and/or trajectory characteristics than the surrounding portions the face portion 6762. Further, the filler insert 8020 may absorb shock, isolate vibration, and/or dampen noise when the face portion 6762 strikes a golf ball. The apparatus, methods, and articles of manufacture described herein are not limited in this regard.

Figure 81:
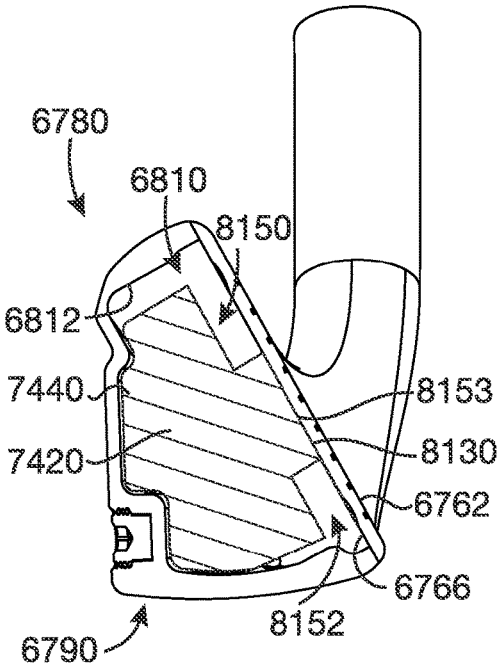

In one example, as shown in FIG. 81, another filler insert 8120 having a front surface 8130 and a back surface 8140 may be similar in many respects to the filler insert 7320 as described herein. The filler insert 8120 may include an upper slot 8150 and a lower slot 8152 to define a center portion 8153. The center portion 8153 defines a portion of the front surface 8130 that may be coupled or bonded to the back surface 6766 of the face portion 6762. The area of the center portion 8153 that is coupled or bonded to the face portion 6762 may have any shape such as circular, rectangular, or square. The center portion 8153 may be behind a central portion of the face portion 6762, which may correspond to a general ball strike region of the face portion 6762. When the face portion 6762 strikes a golf ball, the center portion 8153 of the filler insert 8120 may deflect along with the central portion of the face portion 6762. Accordingly, the central portion of the face portion 6762 may exhibit different ball spin, launch angle, launch speed, and/or trajectory characteristics than the surrounding portions the face portion 6762. Further, the filler insert 8120 may absorb shock, isolate vibration, and/or dampen noise when the face portion 6762 strikes a golf ball. The apparatus, methods, and articles of manufacture described herein are not limited in this regard.

Figure 82:
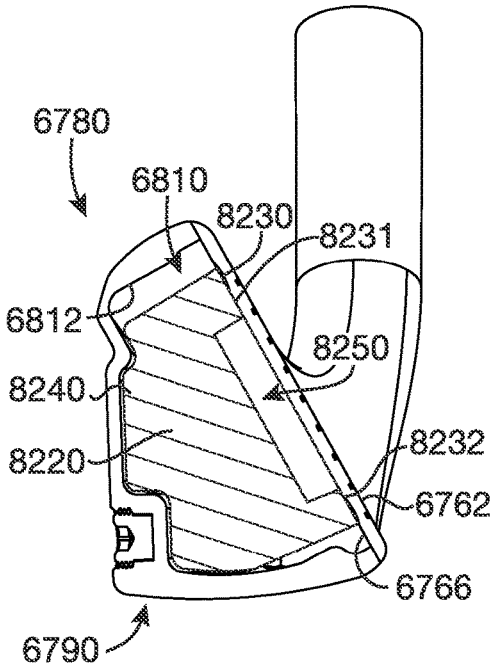

In one example, as shown in FIG. 82, another filler insert 8220 having a front surface 8230 and a back surface 8240 may be similar in many respects to the filler insert 7320 as described herein. The filler insert 8220 may include a front cavity 8250 at the front surface 8230. Accordingly, the front surface 8230 may include an upper front surface 8231 coupled or bonded to the back surface 6766 of the face portion 6762 and a lower front surface 8232 coupled or bonded to the back surface 6766 of the face portion 6762. As shown in the example of FIG. 82, the front cavity 8250 may have a rectangular shape. In another example (not shown), the front cavity 8250 may have a non-rectangular shape. In one example, as shown in FIG. 82, the front cavity 8250 may be behind a central portion of the face portion 6762, which may correspond to a ball strike region of the face portion 6762. When the face portion 6762 strikes a golf ball, the central portion of the face portion 6762 may have a larger deflection than the surrounding portions of the face portion 6762. Accordingly, the central portion of the face portion 6762 may exhibit different ball spin, launch angle, launch speed, and/or trajectory characteristics than the surrounding portions the face portion 6762. Further, the filler insert 8220 may absorb shock, isolate vibration, and/or dampen noise when the face portion 6762 strikes a golf ball. The apparatus, methods, and articles of manufacture described herein are not limited in this regard.

Figure 83:
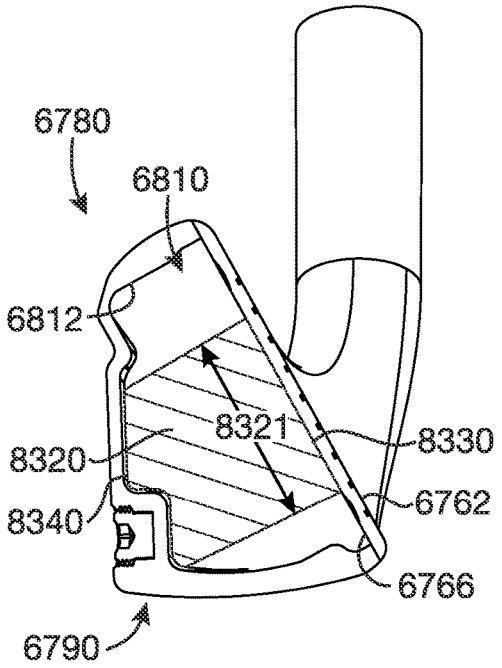

In one example, as shown in FIG. 83, another filler insert 8320 having a front surface 8330 and a back surface 8340 may be similar in many respects to the filler insert 7320 as described herein. The filler insert 8320 may have a height 8321 that may be smaller than the height of the filler insert 7320. Accordingly, the front surface 8330 may be coupled or bonded to a smaller area of the face portion 6762. As a result, the face portion 6762 may exhibit different ball spin, launch angle, launch speed, and/or trajectory characteristics than the surrounding portions the face portion 6762 as compared to a golf club head having the filler insert 7320. Further, the filler insert 8320 may absorb shock, isolate vibration, and/or dampen noise when the face portion 6762 strikes a golf ball. The apparatus, methods, and articles of manufacture described herein are not limited in this regard.

Figure 84:
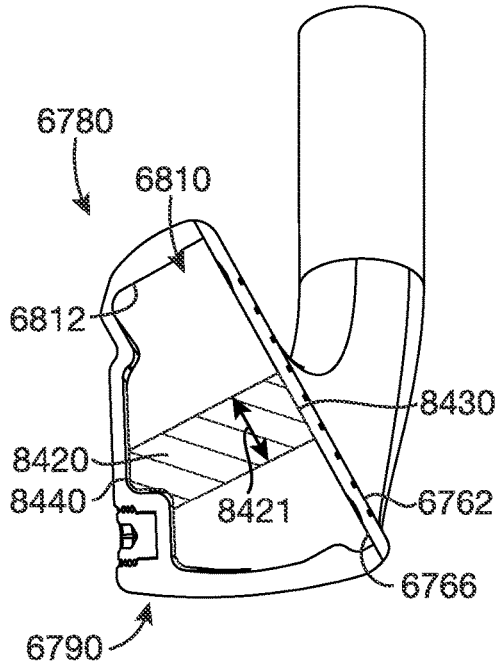

In one example, as shown in FIG. 84, another filler insert 8420 having a front surface 8430 and a back surface 8440 may be similar in many respects to the filler insert 7320 as described herein. The filler insert 8420 may have a height 8421 that may be smaller than the height of the filler insert 7320 and smaller than the height 8321 of the filler insert 8320. Accordingly, the front surface 8430 may be coupled or bonded to a smaller area of the face portion 6762. As a result, the face portion 6762 may exhibit different ball spin, launch angle, launch speed, and/or trajectory characteristics than the surrounding portions the face portion 6762 as compared to a golf club head having the filler insert 7320 or a golf club head having the filler insert 8320. The apparatus, methods, and articles of manufacture described herein are not limited in this regard.

Figure 85:
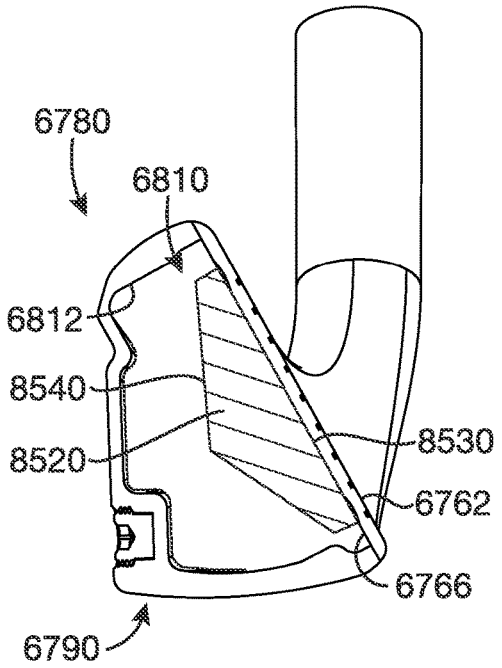

In one example, as shown in FIG. 85, another filler insert 8520 having a front surface 8530 and a back surface 8540 may be similar in many respects to the filler insert 7320 as described herein. The front surface 8530 of the filler insert 8520 may be bonded or coupled to the face portion 6762. The back surface 8540 of the filler insert 8520 may not be coupled to the inner walls 6812 of the interior cavity 6810. The filler insert 8520 may have any cross-sectional shape. In the example of FIG. 85, the filler insert 8520 may have a width 8523 that increases linearly or substantially linearly in a direction from the top portion 6780 to a location behind a central portion of the face portion 6762 and decreases linearly from the location behind the central portion of the face portion 6762 in a direction toward the sole portion 6790. The face portion 6762 may exhibit different ball spin, launch angle, launch speed, and/or trajectory characteristics at different locations on the face portion 6762 that may correspond with the cross-sectional shape of the filler insert 8520. Further, the filler insert 8520 may absorb shock, isolate vibration, and/or dampen noise when the face portion 6762 strikes a golf ball. The apparatus, methods, and articles of manufacture described herein are not limited in this regard.

Figure 86:
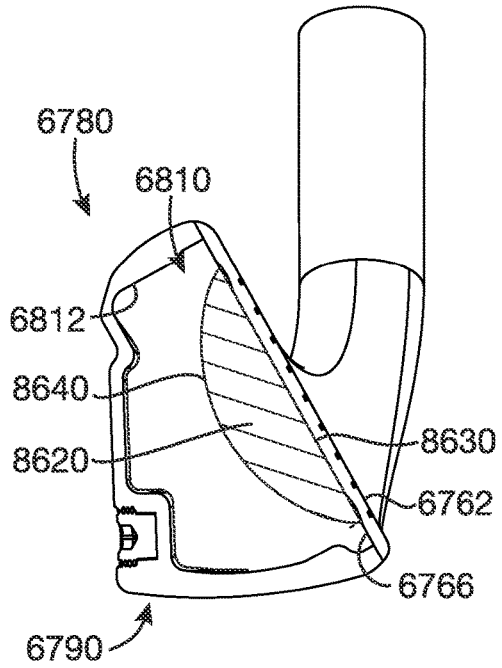

In one example, as shown in FIG. 86, another filler insert 8620 having a front surface 8630 and a back surface 8640 may be similar in many respects to the filler insert 7320 as described herein. The front surface 8630 of the filler insert 8620 may be bonded or coupled to the face portion 6762. The back surface 8640 of the filler insert 8520 may not be coupled to the inner walls 6812 of the interior cavity 6810. The filler insert 8620 may have any cross-sectional shape. In the example of FIG. 86, the filler insert 8620 may have a width 8623 that increases in a curved manner or path in a direction from the top portion 6780 to a location behind a central portion of the face portion 6762 and decreases in a curved manner or path from the location behind the central portion of the face portion 6762 in a direction toward the sole portion 6790. The face portion 6762 may exhibit different ball spin, launch angle, launch speed, and/or trajectory characteristics that may correspond to cross-sectional shape of the filler insert 8620. Further, the filler insert 8620 may absorb shock, isolate vibration, and/or dampen noise when the face portion 6762 strikes a golf ball. The apparatus, methods, and articles of manufacture described herein are not limited in this regard.

In one example (not shown), the interior cavity 6810 may be entirely filled with the filler material 7012. In another example, as shown in FIGS. 67-86, the interior cavity 6810 may be partially filled with the filler material 7012, and the remaining portions of the interior cavity 6810 may be unfilled. In another example (not shown), the remaining portions of the interior cavity 6810 may be filled with another filler material that may be similar to any of the filler materials described herein. The apparatus, methods, and articles of manufacture described herein are not limited in this regard.

In one example, the cross-sectional shape of any of the filler inserts shown in FIGS. 67-86 may extend the entire distance inside the interior cavity 6810 between the toe portion 6740 and the heel portion 6750. In another example, the cross-sectional shape of a filler insert may extend along one or more portions of the distance inside the interior cavity 6810 between the toe portion 6740 and the heel portion 6750. In another example, the cross-sectional shape of a filler insert may extend along a portion of the interior cavity 6810 behind a central portion or the strike region of the face portion 6762. In yet another example, the cross-sectional shape of a filler insert may extend a certain portion of the interior cavity 6810 according to one of the configurations described herein, and the cross-sectional shape of the filler insert at other portions of the interior cavity 6810 may be configured according to one or more of the other cross-sectional configurations of the filler insert described herein. The apparatus, methods, and articles of manufacture described herein are not limited in this regard.

Any of the filler inserts described herein may be attached or bonded to the inner walls 6812 of the interior cavity 6810 by any of adhesive or bonding agents described herein. In another example, one or more portions of the interior cavity 6810 that may not be occupied by the filler material 8020 may be filled with any of the filler materials described herein. In another example, the interior cavity 6810 may only include a filler insert as described herein. In yet another example, interior cavity 6810 may be partially or fully filled with any of the filler materials described herein. The apparatus, methods, and articles of manufacture described herein are not limited in this regard.

Figure 87:
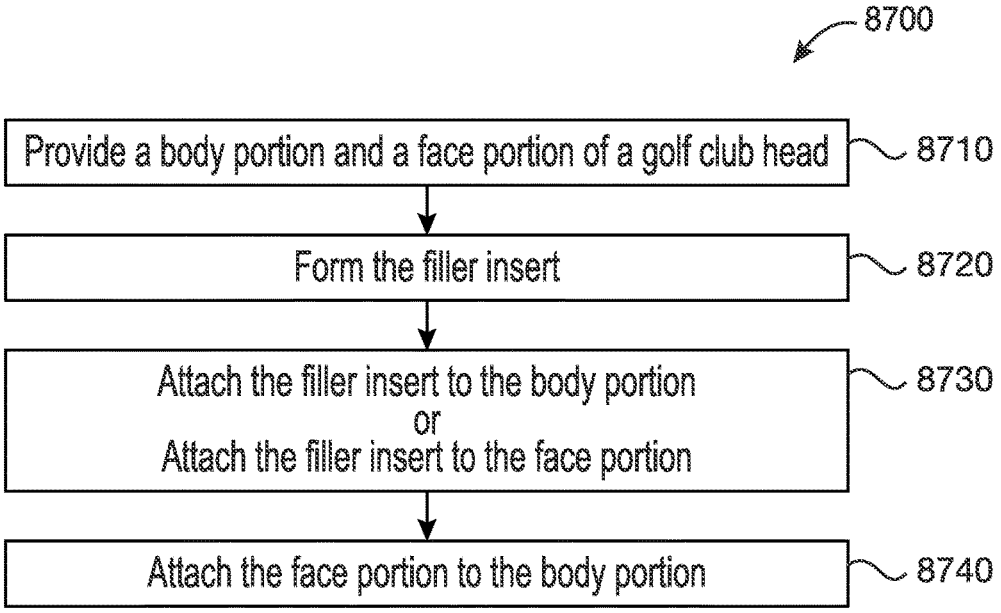
FIG. 87 depicts an example of manufacturing a golf club head according to any embodiment of the apparatus, methods, and articles of manufacture described herein.

FIG. 87 depicts one manner by which the golf club head 6700 or any of the golf club heads described herein may be manufactured. In the example of FIG. 87, the process 8700 may begin with providing a body portion 6710 and a face portion 6762 of a golf club head 6700 (block 8710). The filler insert 7320 may be formed by injection molding the filler material 7012 in a mold that is configured to produce a filler insert 7320 as described herein (block 8720). For example, the interior of the mold may include portions that correspond in shape to portions of the interior cavity 6810 to which the filler insert 7320 may be coupled as described herein. The filler insert 7320 may then be attached to the inner walls 6812 of the interior cavity 6810 as described herein (block 8730). The face portion 6762 may then be attached to the body portion 6710 as described herein to enclose the interior cavity 6810 (block 8740). In one example, prior to attaching the face portion 6762 to the body portion 6710, an adhesive or a bonding agent may be applied to portions of the back surface 6766 of the face portion 6762 that couples to the filler insert 7320. In another example, the filler insert 7320 may engage the back surface 6766 of the face portion 6762 without the use of any adhesives or bonding agents. Alternatively, the filler insert 7320 may be attached to the back surface 6766 of the face portion 6762 (block 8730). In one example, prior to attaching the face portion 6762 to the body portion 6710, an adhesive or a bonding agent may be applied to portions of the inner walls 6812 of the interior cavity 6810 that couples to the filler insert 7320. In another example, the filler insert 7320 may engage the inner walls 6812 of the interior cavity 6810 without the use of any adhesives or bonding agents. The filler insert 7320 may be slightly compressed between the inner walls 6812 of the interior cavity 6810 and the back surface 6766 of the face portion 6762 after the face portion 6762 is attached to the body portion 6710. The slight compression of the filler insert 7320 may assist in maintaining the filler insert 7320 engaged to the inner walls 6812 of the interior cavity 6810 and/or the back surface 6766 of the face portion 6762 with or without the use of adhesives or bonding agents. The apparatus, methods, and articles of manufacture described herein are not limited in this regard.

Figure 88:
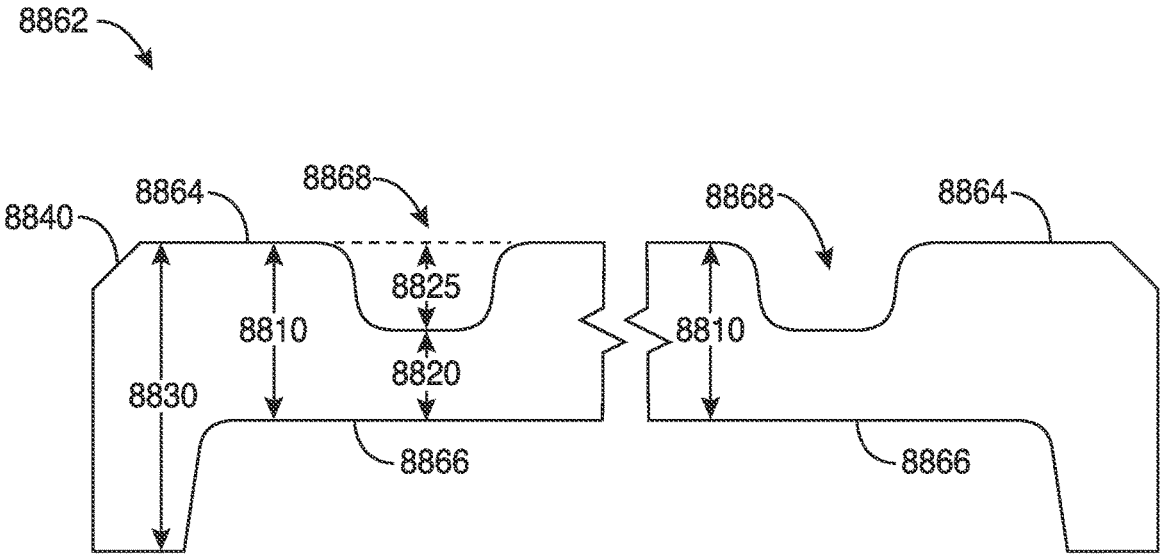
FIGS. 88 and 89 depict cross-sectional views of two examples of face portions according to any embodiment of the apparatus, methods, and articles of manufacture described herein.

In one example, as shown in FIG. 88, a face portion 8862 may have a first thickness 8810 (T1) or a second thickness 8820 (T2). The first thickness 8810 may be a thickness of a section of the face portion 8862 adjacent to a groove 8868 whereas the second thickness 8820 may be a thickness of a section of the face portion 8862 below the groove 8868. For example, the first thickness 8810 may be a maximum distance between the front surface 8864 and the back surface 8866. The second thickness 8820 may be based on the groove 8868. In particular, the groove 8868 may have a groove depth 8825 (Dgroove). The second thickness 8820 may be a maximum distance between the bottom of the groove 8868 and the back surface 8866. The sum of the second thickness 8820 and the groove depth 8825 may be substantially equal to the first thickness 8810 (e.g., T2+Dgroove=T1). Accordingly, the second thickness 8820 may be less than the first thickness 8810 (e.g., T2<T1).

To lower and/or move the CG of a golf club head further back, such as the CG of any of the golf club heads described herein, mass from the front portion of a golf club head may be removed by using a relatively thinner face portion 8862. For example, the first thickness 8810 or the second thickness 8820 may be less than or equal to 0.1 inch (2.54 millimeters). In another example, the first thickness 8810 or the second thickness 8820 may be about 0.075 inch (1.875 millimeters) (e.g., T1=0.075 inch). With the support of the back wall portion of a golf club head to form an interior cavity and filling at least a portion of the interior cavity with one or more filler materials as described herein, the face portion 8862 may be relatively thinner (e.g., T1<0.075 inch) without degrading the structural integrity, sound, and/or feel of a golf club head. In one example, the first thickness 8810 may be less than or equal to 0.060 inch (1.524 millimeters) (e.g., T1≤0.060 inch). In another example, the first thickness 8810 may be less than or equal to 0.040 inch (1.016 millimeters) (e.g., T1≤0.040 inch). Based on the type of material(s) used to form the face portion 8862 and/or the body portion 110, the face portion 8862 may be even thinner with the first thickness 8810 being less than or equal to 0.030 inch (0.762 millimeters) (e.g., T1≤0.030 inch). The groove depth 8825 may be greater than or equal to the second thickness 8820 (e.g., Dgroove≥T2). In one example, the groove depth 8825 may be about 0.020 inch (0.508 millimeters) (e.g., Dgroove=0.020 inch). Accordingly, the second thickness 8820 may be about 0.010 inch (0.254 millimeters) (e.g., T2=0.010 inch). In another example, the groove depth 8825 may be about 0.015 inch (0.381 millimeters), and the second thickness 8820 may be about 0.015 inch (e.g., Dgroove=T2=0.015 inch). Alternatively, the groove depth 8825 may be less than the second thickness 8820 (e.g., Dgroove<T2). Without the support of the back wall portion of a golf club head and one or more filler materials used to fill in the interior cavity, the golf club head may not be able to withstand multiple impacts by a golf ball on a face portion. In contrast, a golf club head with a relatively thin face portion but without the support of the back wall portion and the one or more filler materials as described herein (e.g., a cavity-back golf club head) may produce unpleasant sound (e.g., a tinny sound) and/or feel during impact with a golf ball. The apparatus, methods, and articles of manufacture described herein are not limited in this regard.

Based on manufacturing processes and methods used to form a golf club head such as any of the golf club heads described herein, the face portion 8862 may include additional material at or proximate to a periphery of the face portion 8862. Accordingly, the face portion 8862 may also include a third thickness 8830, and a chamfer portion 8840. The third thickness 8830 may be greater than either the first thickness 8810 or the second thickness 8820 (e.g., T3>T1>T2). In particular, the face portion 8862 may be coupled to the body portion of a golf club head by a welding process. For example, the first thickness 8810 may be about 0.030 inch (0.762 millimeters), the second thickness 8820 may be about 0.015 inch (0.381 millimeters), and the third thickness 8830 may be about 0.050 inch (1.27 millimeters). Accordingly, the chamfer portion 8840 may accommodate some of the additional material when the face portion 8862 is welded to the body portion of the golf club head.

Figure 89:
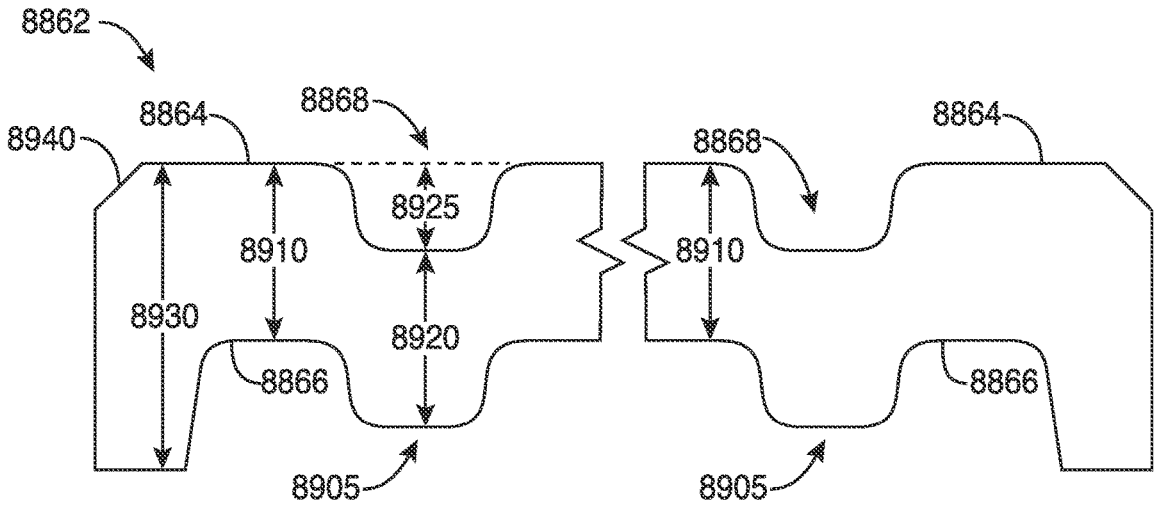

As illustrated in FIG. 89, for example, the face portion 8862 may include a reinforcement section, generally shown as 8905, below one or more grooves 8868. In one example, the face portion 8862 may include a reinforcement section 8905 below each groove. Alternatively, face portion 8862 may include the reinforcement section 8905 below some grooves (e.g., every other groove) or below only one groove. The face portion 8862 may include a first thickness 8910, a second thickness 8920, a third thickness 8930, and a chamfer portion 8940. The groove 8868 may have a groove depth 8925. The reinforcement section 8905 may define the second thickness 8920. The first and second thicknesses 8910 and 8920, respectively, may be substantially equal to each other (e.g., T1=T2). In one example, the first and second thicknesses 8910 and 8920, respectively, may be about 0.030 inch (0.762 millimeters) (e.g., T1=T2=0.030 inch). The groove depth 8925 may be about 0.015 inch (0.381 millimeters), and the third thickness 8930 may be about 0.050 inch (1.27 millimeters). The groove 8868 may also have a groove width. The width of the reinforcement section 8905 may be greater than or equal to the groove width. The apparatus, methods, and articles of manufacture described herein are not limited in this regard.

Alternatively, the face portion 8862 may vary in thickness at and/or between the top portion and the sole portion of a golf club head. In one example, the face portion 8862 may be relatively thicker at or proximate to the top portion than at or proximate to the sole portion (e.g., thickness of the face portion 8862 may taper from the top portion towards the sole portion). In another example, the face portion 8862 may be relatively thicker at or proximate to the sole portion than at or proximate to the top portion (e.g., thickness of the face portion 8862 may taper from the sole portion towards the top portion). In yet another example, the face portion 8862 may be relatively thicker between the top portion and the sole portion than at or proximate to the top portion and the sole portion (e.g., thickness of the face portion 8862 may have a bell-shaped contour). The face portion 8862 may be similar to any of the face portions described in any of the incorporated by reference applications. The apparatus, methods, and articles of manufacture described herein are not limited in this regard.

Figure 90:
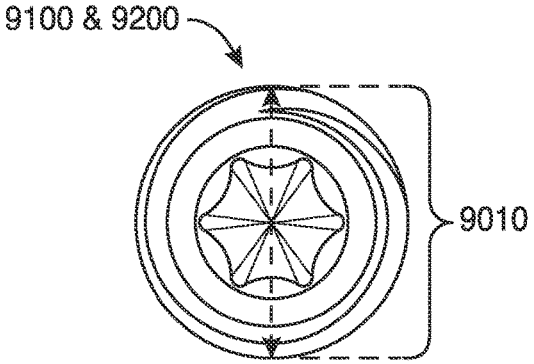
FIG. 90 depicts a top view of a mass portion according to any embodiment of the apparatus, methods, and articles of manufacture described herein.

One or more mass portions of any of the sets of mass portions described herein may have similar or different physical properties (e.g., color, marking, shape, size, density, mass, volume, external surface texture, materials of construction, etc.). Accordingly, any of the sets of mass portions described herein may contribute to the ornamental design of a golf club head. In the illustrated example as shown in FIG. 90, one or more mass portions of any of the sets of mass portions described herein may have a cylindrical shape (e.g., a circular cross section). Alternatively, one or more mass portions of any of the sets of mass portions described herein may have a first shape (e.g., a cylindrical shape) whereas one or more mass portions of another one of the sets of mass portions as described herein may have a second shape (e.g., a cubical shape). In another example, one or more mass portions of any of the sets of mass portions described herein may include two or more mass portions with different shapes. In another example, one or more mass portions of any of the sets of mass portions described herein may have a different color(s), marking(s), shape(s), density or densities, mass(es), volume(s), material(s) of construction, external surface texture(s), and/or any other physical property as compared to one or more mass portions of another one of the sets of mass portions as described herein. The properties of any of the mass portions and sets of mass portions described herein may be similar to any of the mass portions and sets of mass portions described in any of the incorporated by reference applications. The apparatus, methods, and articles of manufacture described herein are not limited in this regard.

Figure 91:
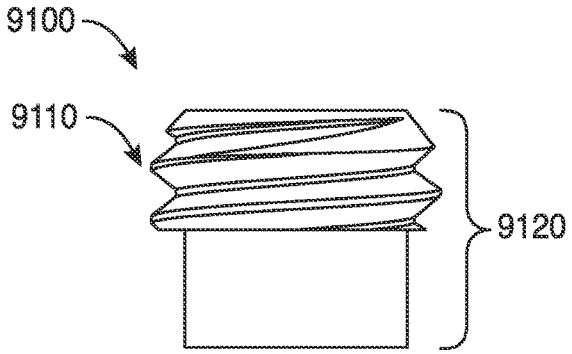
FIGS. 91 and 92 depict side views of example mass portions according to any embodiment of the apparatus, methods, and articles of manufacture described herein.
Figure 92:
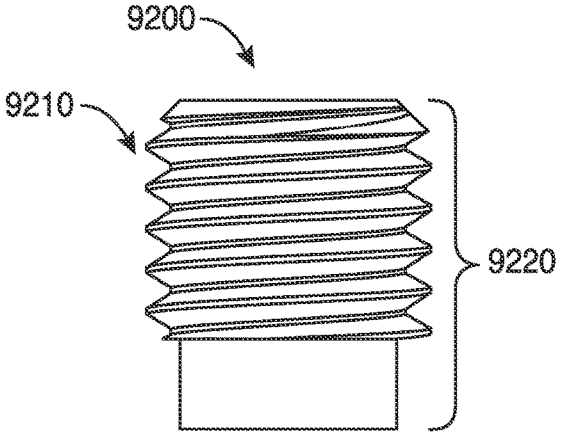

Referring to FIGS. 91 and 92, for example, a first mass portion 9100 and a second mass portion 9200 may include threads, generally shown as 9110 and 9210, respectively, to engage with correspondingly configured threads in ports on the to secure in the ports as described herein. Accordingly, one or more mass portions as described herein may be shaped similar to and function as a screw or threaded fastener for engaging threads in a port. For example, one or more mass portions of any of the sets of mass portions described herein may be a screw. One or more mass portions of any of the mass portions described herein may not be readily removable from the body portion of a golf club head with or without a tool. Alternatively, one or more mass portions of any of the sets of mass portions described herein may be readily removable (e.g., with a tool) so that a relatively heavier or lighter mass portion may replace one or more mass portions of any of the sets of mass portions described herein. In another example, one or more mass portions of any of the sets of mass portions described herein may be secured in the ports with epoxy or adhesive so that the mass portions may not be readily removable. In yet another example, one or more mass portions of any of the sets of mass portions described herein may be secured in the ports with both threads and thread sealant (e.g., acrylic adhesive, cyanoacrylate adhesive, epoxy, thermoplastic adhesive, silicone sealant, or urethane adhesive) so that the mass portions may not be readily removable. In yet another example, one or more mass portions of any of the sets of mass portions described herein may be press fit in a port. In yet another example, one or more mass portions of any of the sets of mass portions described herein may be formed inside a port by injection molding. For example, a liquid metallic material (i.e., molten metal) or a plastic material (e.g., rubber, foam, or any polymer material) may be injected or otherwise introduced into a port. After the liquid material is cooled and/or cured inside the port, the resulting solid material (e.g., a metal material, a plastic material, or a combination thereof) may form a mass portion. The apparatus, methods, and articles of manufacture described herein are not limited in this regard.

As mentioned above, one or more mass portions of any of the sets of mass portions described herein may be similar in some physical properties but different in other physical properties. For example, a mass portion may be made from an aluminum-based material or an aluminum alloy whereas another mass portion may be made from a tungsten-based material or a tungsten alloy. In another example, a mass portion may be made from a polymer material whereas another mass portion may be made from a steel-based material. In yet another example, as illustrated in FIGS. 90-92, one or more mass portions of any of the sets of mass portions described herein may have a diameter 9010 of about 0.25 inch (6.35 millimeters) but one or more mass portions of another one or more sets of mass portions described herein may be different in height. In particular, one or more mass portions of any of the sets of mass portions described herein may be associated with a first height 9120, and one or more mass portions of another one or more sets of mass portions described herein may be associated with a second height 9220. The first height 9120 may be relatively shorter than the second height 9220. In one example, the first height 9120 may be about 0.125 inch (3.175 millimeters) whereas the second height 9220 may be about 0.3 inch (7.62 millimeters). In another example, the first height 9120 may be about 0.16 inch (4.064 millimeters) whereas the second height 9220 may be about 0.4 inch (10.16 millimeters). Alternatively, the first height 9120 may be equal to or greater than the second height 9220. Although the above examples may describe particular dimensions, one or more mass portions described herein may have different dimensions. In one example, any of the mass portions described herein may be interchangeably used in any of the ports described herein. Any property of any of the mass portions described herein may be similar to the corresponding property of any of the mass portions described in any of the incorporated by reference applications. The apparatus, methods, and articles of manufacture described herein are not limited in this regard.

The apparatus, methods, and articles of manufacture described herein may include one or more club identifiers (e.g., a serial number, a matrix barcode, a trademark, a club number, a loft angle, a character, etc.). For example, any of the golf club heads described herein may include a visual indicator such as a club number to identify the type of golf club. In particular, the club number may correspond to the loft angle of the golf club head (e.g., 3, 4, 5, 6, 7, 8, or 9). In one example, a 7-iron type golf club head may be marked with "7". In another example, a golf club head may be marked with the loft angle. For example, a 54-degree wedge type golf club head may be marked "54". In yet another example, a 10.5-degree driver type golf club head may be marked "10.5." Any marking(s) associated with a club identifier may be visually differentiated (e.g., different color, texture, pattern, etc.) from the rest of a golf club head. To distinguish from other golf club heads, a golf club head as described herein may include a trademark (e.g., a word, a name, a symbol, a design, or any combination thereof) to identify a brand name or a model of the golf club head (e.g., distinguish from other manufacturer or seller). The club identifier may be another type of visual indicator such as a product number or a serial number to identify the golf club head as authentic equipment, to track inventory, or to distinguish the golf club head from fake or counterfeit products. Alternatively, the club identifier may be a digital signature or a machine-readable optical representation of information or data about the golf club head (e.g., numeric character(s), alphanumeric character(s), byte(s), a one-dimensional barcode such as a Universal Product Code (UPC), a two-dimensional barcode such as a Quick Response (QR) code, etc.). The club identifier may be placed at various location on the golf club head (e.g., the heel portion, the hosel portion, the face portion, the top portion, the sole portion, etc.) using various methods (e.g., painted, laser etched, stamped, casted, or molded onto the golf club head). For example, the club identifier may be a serial number laser etched onto the hosel portion of the golf club head. Instead of being an integral part of the golf club head, the club identifier may be a separate component coupled to the golf club head (e.g., a label adhered via an adhesive or an epoxy). The apparatus, methods, and articles of manufacture described herein are not limited in this regard.

To determine the effect of using different filler materials on the coefficient of restitution (COR) and the performance of the golf club head 5400, several golf clubs having golf club heads that were similar to the golf club head 5400 but with different loft configurations (i.e., 4-iron, 7-iron, pitching wedge) and different filler materials were tested to obtain COR, ball speed, launch angle, back spin, peak height, and carry distance for each golf club. To measure the COR of each golf club, an air cannon device was used to launch a golf ball weighing approximately 45 grams at an initial velocity (i.e., inbound velocity) of about 125 mph toward a center location (as defined below) of the golf club head for multiple iterations. A speed monitoring device was used to measure the outbound velocity (mph) and the rebound time in milliseconds (ms) of the golf ball for each test iteration. An average COR of the golf club head was then determined from the measured data. To measure ball speed, launch angle, back spin, peak height, and carry distance for each golf club, each of the example golf clubs was tested with a swing robot manufactured by Golf Laboratories of San Diego, California to strike a golf ball at an average golf club head speed of 84 mph to 86 mph for multiple iterations at each of five locations on the face portion of the golf club head to determine average ball speed (mph), average ball launch angle (radians), average ball back spin (rpm), average ball peak height (yards), and average total carry distance (yards). The five locations of the face portion were a center location, a toe location, a heel location, a low location, and a high location. The center location was determined as the location on the face portion by which a golf ball is typically struck by an individual. In other words, the center location statistically (e.g., greater than 75%) receives the highest number of ball strikes. The center location was determined to be at 0.75 inches or approximately 0.75 inches up from the bottom portion and at the center of a corresponding groove on the face portion subject to variations and/or approximations according to measurement tolerances and/or the actual ball strike region on the face portion by the swing robot. The toe location and the heel location were determined as 0.5 inches or approximately 0.5 inches from the center location in the toe direction and in the heel direction, respectively, subject to variations and/or approximations according to measurement tolerances and the actual ball strike point on the face portion by the swing robot. The high location and the low location were determined as 0.25 inches or approximately 0.25 inches from the center location in the top direction and the bottom direction, respectively, subject to variations and/or approximations according to measurement tolerances and the actual ball strike point on the face portion by the swing robot. The apparatus, methods, and articles of manufacture described herein are not limited in this regard.

Tables 5-10 show experimental performance results for three examples of a 4-iron golf club having a golf club head constructed according to apparatus, methods, and articles of manufacture described herein for the golf club head 5400 with each example having different filler materials. The golf club head 5491 (not shown) of example 1 was similar to the golf club head 5400 in a 4-iron configuration except that the golf club head 5491 was filled with a thermoplastic elastomer (TPE) filler material with the same or similar properties as any of the TPE materials described herein or in any of the incorporated by reference applications. The golf club head 5492 (not shown) of example 2 was similar to the golf club head 5400 in a 4-iron configuration except that the golf club head 5492 was filled with an epoxy material with the same or similar properties as any of the epoxy materials described herein or in any of the incorporated by reference applications. The golf club head 5493 of example 3 was similar to the golf club head 5400 in a 4-iron configuration and was filled with the first filler material 5712 and the second filler material 5714 as described in detail herein. Accordingly, all three example golf club heads 5491, 5492, and 5493 were structurally similar except for the differences in their filler materials.

TABLE 5

4-Iron Golf Club COR at Face Center Location

| Golf Club Head | Inbound Velocity (mph) | Outbound Velocity (mph) | Rebound Time (ms) | COR |
|---|---|---|---|---|
| Golf Club Head 5491 | 125.01 | 64.75 | 23.59 | 0.803 |
| Golf Club Head 5492 | 124.96 | 65.90 | 23.32 | 0.814 |
| Golf Club Head 5493 | 124.97 | 66.92 | 23.13 | 0.824 |

TABLE 6

4-Iron Golf Club Ball Speed (mph) vs. Face Portion Location

| | Face Location | | | | |
|---|---|---|---|---|---|
| Golf Club Head | Center | Toe | Heel | High | Low |
| Golf Club Head 5491 | 126.63 | 123.45 | 124.62 | 121.32 | 126.65 |
| Golf Club Head 5492 | 127.52 | 124.18 | 124.97 | 122.93 | 125.73 |
| Golf Club Head 5493 | 127.95 | 124.33 | 125.03 | 123.42 | 126.42 |

TABLE 7

4-Iron Golf Club Launch Angle (radians) vs. Face Portion Location

| | Face Location | | | | |
|---|---|---|---|---|---|
| Golf Club Head | Center | Toe | Heel | High | Low |
| Golf Club Head 5491 | 13.93 | 14.02 | 13.60 | 14.27 | 13.58 |
| Golf Club Head 5492 | 13.90 | 13.88 | 13.47 | 14.33 | 13.37 |
| Golf Club Head 5493 | 14.05 | 14.20 | 13.92 | 14.23 | 13.63 |

TABLE 8

4-Iron Golf Club Backspin (rpm) vs. Face Portion Location

| | Face Location | | | | |
|---|---|---|---|---|---|
| Golf Club Head | Center | Toe | Heel | High | Low |
| Golf Club Head 5491 | 3695 | 3839 | 3589 | 3764 | 3942 |
| Golf Club Head 5492 | 3826 | 3931 | 3696 | 3899 | 3924 |
| Golf Club Head 5493 | 3765 | 3925 | 3689 | 3865 | 3988 |

TABLE 9

4-Iron Golf Club Peak Height (yards) vs. Face Portion Location

| | Face Location | | | | |
|---|---|---|---|---|---|
| Golf Club Head | Center | Toe | Heel | High | Low |
| Golf Club Head 5491 | 28.00 | 26.17 | 25.83 | 25.50 | 27.00 |
| Golf Club Head 5492 | 28.00 | 26.67 | 26.00 | 27.00 | 26.17 |
| Golf Club Head 5493 | 28.83 | 27.00 | 26.67 | 27.00 | 27.33 |

TABLE 10

4-Iron Golf Club Carry Distance (yards) vs. Face Portion Location

| | Face Location | | | | |
|---|---|---|---|---|---|
| Golf Club Head | Center | Toe | Heel | High | Low |
| Golf Club Head 5491 | 210.33 | 202.33 | 207.00 | 199.00 | 207.50 |
| Golf Club Head 5492 | 210.67 | 203.17 | 206.00 | 201.00 | 205.50 |
| Golf Club Head 5493 | 211.83 | 203.33 | 207.00 | 202.67 | 206.67 |

Referring to Table 5, the golf club head 5493 has a higher COR for face center strikes than the golf club heads 5491 and 5492. Accordingly, as shown in Table 6, the higher COR provides a higher ball speed than golf club heads 5491 and 5492 at the center location. In particular, at the center location, the increase in ball speed for the golf club head 5493 relative to the golf club head 5492 is close to 0.5 mph, and the increase in ball speed for the golf club head 5493 relative to the golf club head 5491 is more than one (1) mph and close to 1.5 mph. With reference to Table 10, the increase in ball speed at the center location for the golf club head 5493 relative to the golf club heads 5491 and 5492 provides a greater total ball carry distance for the golf club head 5493. In particular, at the center location, the increase in carry distance for the golf club head 5493 relative to the golf club head 5492 is over one (1) yard, and the increase in carry distance for the golf club head 5493 relative to the golf club head 5491 is 1.5 yards. As described herein, the center location of the face portion may represent the highest statistical strike region on the face portion. In other words, many individuals may strike a golf ball at or proximate to the center location. Accordingly, the golf club head 5493 as described in detail herein (e.g., filled with the first and second filler materials 5712 and 5714, respectively) provides improved performance for all face center strikes in comparison to a golf club head that is similar to the golf club head 5400 but filled with another filler material such as a TPE material (e.g., the golf club head 5491) or an epoxy material (e.g., the golf club head 5492). Further, the ball speed and carry distance for the golf club head 5493 at the heel, the toe, and the high face locations are greater than the ball speed and carry distance for the same locations, respectively, for the golf club heads 5491 and 5492. Accordingly, the golf club head 5493 as described in detail herein (e.g., filled with the first and second filler materials 5712 and 5714, respectively) provides an overall improved performance in comparison to a golf club head that is similar to the golf club head 5400 but filled with another filler material such as a TPE material (e.g., the golf club head 5491) or an epoxy material (e.g., the golf club head 5492).

Tables 11-16 show experimental performance results for three examples of a 7-iron golf club having a golf club head constructed according to apparatus, methods, and articles of manufacture described herein for the golf club head 5400 with each example having different filler materials. The golf club head 5591 (not shown) of example 4 was similar to the golf club head 5400 in a 7-iron configuration except that the golf club head 5591 was filled with a thermoplastic elastomer (TPE) filler material with the same or similar properties as any of the TPE materials described herein or in any of the incorporated by reference applications. The golf club head 5592 (not shown) of example 5 was similar to the golf club head 5400 in a 7-iron configuration except that the golf club head 5592 was filled with an epoxy material with the same or similar properties as any of the epoxy materials described herein or in any of the incorporated by reference applications. The golf club head 5593 of example 6 was similar to the golf club head 5400 in a 7-iron configuration and was filled with the first filler material 5712 and the second filler material 5714 as described in detail herein. Accordingly, all three example golf club heads 5591, 5592, and 5593 were structurally similar except for the differences in their filler materials.

TABLE 11

7-Iron Golf Club COR at Face Center Location

| Golf Club Head | Inbound Velocity (mph) | Outbound Velocity (mph) | Rebound Time (ms) | COR |
|---|---|---|---|---|
| Golf Club Head 5591 | 124.88 | 67.98 | 22.96 | 0.808 |
| Golf Club Head 5592 | 125.25 | 68.61 | 22.79 | 0.811 |
| Golf Club Head 5593 | 125.13 | 69.75 | 22.58 | 0.821 |

TABLE 12

7-Iron Golf Club Ball Speed (mph) vs. Face Portion Location

| Golf Club Head/ Face Location | Center | Toe | Heel | High | Low |
|---|---|---|---|---|---|
| Golf Club Head 5591 | 115.90 | 114.00 | 113.70 | 113.90 | 112.60 |
| Golf Club Head 5592 | 115.52 | 113.44 | 113.12 | 111.89 | 111.75 |
| Golf Club Head 5593 | 116.70 | 113.90 | 114.30 | 114.00 | 112.90 |

TABLE 13

7-Iron Golf Club Launch Angle (radians) vs Face Portion Location

| Golf Club Head/ Face Location | Center | Toe | Heel | High | Low |
|---|---|---|---|---|---|
| Golf Club Head 5591 | 18.40 | 18.30 | 18.00 | 17.90 | 17.70 |
| Golf Club Head 5592 | 18.28 | 17.97 | 18.26 | 18.82 | 17.45 |
| Golf Club Head 5593 | 17.80 | 17.30 | 17.30 | 18.00 | 17.20 |

TABLE 14

7-Iron Golf Club Backspin (rpm) vs. Face Portion Location

| Golf Club Head/ Face Location | Center | Toe | Heel | High | Low |
|---|---|---|---|---|---|
| Golf Club Head 5591 | 5354 | 5534 | 5045 | 5298 | 5761 |
| Golf Club Head 5592 | 5796 | 5927 | 5495 | 5836 | 6032 |
| Golf Club Head 5593 | 5534 | 5824 | 5469 | 5597 | 5784 |

TABLE 15

7-Iron Golf Club Peak Height (yards) vs. Face Portion Location

| Golf Club Head/ Face Location | Center | Toe | Heel | High | Low |
|---|---|---|---|---|---|
| Golf Club Head 5591 | 31.00 | 30.00 | 29.00 | 29.00 | 28.00 |
| Golf Club Head 5592 | 31.00 | 29.10 | 29.10 | 29.60 | 27.30 |
| Golf Club Head 5593 | 31.00 | 28.00 | 28.00 | 29.00 | 28.00 |

TABLE 16

7-Iron Golf Club Carry Distance (yards) vs. Face Portion Location

| Golf Club Head/ Face Location | Center | Toe | Heel | High | Low |
|---|---|---|---|---|---|
| Golf Club Head 5591 | 177.00 | 173.00 | 176.00 | 174.00 | 170.00 |
| Golf Club Head 5592 | 174.50 | 170.20 | 172.00 | 168.20 | 166.90 |
| Golf Club Head 5593 | 178.00 | 172.00 | 174.00 | 173.00 | 170.00 |

Referring to Table 11, the golf club head 5593 has a higher COR for face center strikes than the golf club heads 5591 and 5592. Accordingly, as shown in Table 12, the golf club head 5593 provides a higher ball speed than golf club heads 5591 and 5592 at the center location. In particular, at the center location, the increase in ball speed for the golf club head 5593 relative to the golf club head 5591 is close to one (1) mph, and the increase in ball speed for the golf club head 5593 relative to the golf club head 5592 is more than one (1) mph. With reference to Table 16, the increase in ball speed at the center location of the golf club head 5593 provides a greater total ball carry distance for the golf club head 5593 in comparison to the golf club head 5591 and the golf club head 5592. In particular, at the center location, the increase in carry distance for the golf club head 5593 relative to the golf club head 5591 is one (1) yard, and the increase in carry distance for the golf club head 5593 relative to the golf club head 5592 is over three (3) yards. As described herein, the center location of the face portion may represent the highest statistical strike region on the face portion. In other words, many individuals may strike a golf ball at or proximate to the center location. Accordingly, the golf club head 5593 as described in detail herein (e.g., filled with the first and second filler materials 5712 and 5714, respectively) provides improved performance for all face center strikes in comparison to a golf club head that is similar to the golf club head 5400 but filled with another filler material such as a TPE material (e.g., the golf club head 5591) or an epoxy material (e.g., the golf club head 5592).

Tables 17-22 show experimental performance results for three examples of a pitching wedge (PW) golf club having a golf club head constructed according to apparatus, methods, and articles of manufacture described herein for the golf club head 5400 with each example having different filler materials. The golf club head 5691 (not shown) of example 7 was similar to the golf club head 5400 in a PW configuration except that the golf club head 5691 was filled with a thermoplastic elastomer (TPE) filler material with the same or similar properties as any of the TPE materials described herein or in any of the incorporated by reference applications. The golf club head 5692 (not shown) of example 8 was similar to the golf club head 5400 in a PW configuration except that the golf club head 5692 was filled with an epoxy material with the same or similar properties as any of the epoxy materials described herein or in any of the incorporated by reference applications. The golf club head 5693 of example 9 was similar to the golf club head 5400 in a PW configuration and was filled with the first filler material 5712 and the second filler material 5714 as described in detail herein. Accordingly, all three example golf club heads 5691, 5692, and 5693 were structurally similar except for the differences in their filler materials.

TABLE 17

Pitching Wedge Golf Club COR at Face Center Location

| Golf Club Head | Inbound Velocity (mph) | Outbound Velocity (mph) | Rebound Time (ms) | COR |
|---|---|---|---|---|
| Golf Club Head 5691 | 124.72 | 66.65 | 23.23 | 0.776 |
| Golf Club Head 5692 | 124.92 | 68.52 | 22.83 | 0.792 |
| Golf Club Head 5693 | 124.78 | 68.53 | 22.84 | 0.793 |

TABLE 18

Pitching Wedge Golf Club Ball Speed (mph) vs. Face Portion Location

| Golf Club Head/ Face Location | Center | Toe | Heel | High | Low |
|---|---|---|---|---|---|
| Golf Club Head 5691 | 91.15 | 90.22 | 89.78 | 90.48 | 87.82 |
| Golf Club Head 5692 | 92.05 | 91.00 | 90.12 | 91.50 | 88.17 |
| Golf Club Head 5693 | 92.30 | 91.15 | 90.25 | 91.33 | 88.38 |

TABLE 19

Pitching Wedge Golf Club Launch Angle (radians) vs. Face Portion Location

| Golf Club Head/ Face Location | Center | Toe | Heel | High | Low |
|---|---|---|---|---|---|
| Golf Club Head 5691 | 25.88 | 25.40 | 26.22 | 26.58 | 24.47 |
| Golf Club Head 5692 | 26.32 | 25.57 | 26.25 | 26.48 | 24.45 |
| Golf Club Head 5693 | 26.70 | 25.55 | 26.43 | 26.88 | 24.85 |

TABLE 20

Pitching Wedge Golf Club Backspin (rpm) vs. Face Portion Location

| Golf Club Head/ Face Location | Center | Toe | Heel | High | Low |
|---|---|---|---|---|---|
| Golf Club Head 5691 | 8527 | 8757 | 8083 | 8173 | 9100 |
| Golf Club Head 5692 | 8372 | 8735 | 8011 | 8432 | 8931 |
| Golf Club Head 5693 | 8201 | 8806 | 8101 | 8301 | 8982 |

TABLE 21

Pitching Wedge Golf Club Peak Height (yards) vs. Face Portion Location

| Golf Club Head/ Face Location | Center | Toe | Heel | High | Low |
|---|---|---|---|---|---|
| Golf Club Head 5691 | 26.83 | 25.50 | 26.00 | 27.00 | 23.00 |
| Golf Club Head 5692 | 27.67 | 26.17 | 26.17 | 27.17 | 23.17 |
| Golf Club Head 5693 | 28.17 | 26.17 | 26.50 | 27.83 | 24.00 |

TABLE 22

Pitching Wedge Golf Club Carry Distance (yards) vs. Face Portion Location

| Golf Club Head/ Face Location | Center | Toe | Heel | High | Low |
|---|---|---|---|---|---|
| Golf Club Head 5691 | 122.50 | 120.50 | 120.67 | 121.67 | 116.67 |
| Golf Club Head 5692 | 123.83 | 121.83 | 121.67 | 122.67 | 117.67 |
| Golf Club Head 5693 | 124.17 | 122.00 | 121.50 | 122.50 | 117.50 |

Referring to Table 17, the golf club head 5693 has a higher COR for face center strikes than the golf club heads 5691 and 5692. Accordingly, as shown in Table 18, the golf club head 5693 provides a higher ball speed than golf club heads 5691 and 5692 at the center location. In particular, at the center location, the increase in ball speed for the golf club head 5693 relative to the golf club head 5691 is over one (1) mph, and the increase in ball speed for the golf club head 5693 relative to the golf club head 5692 is nearly 0.5 mph. With reference to Table 22, the increase in ball speed at the center location of the golf club head 5693 provides a greater total ball carry distance for the golf club head 5693 in comparison to the golf club head 5691 and the golf club head 5692. In particular, at the center location, the increase in carry distance for the golf club head 5693 relative to the golf club head 5691 is nearly (2) yards, and the increase in carry distance for the golf club head 5693 relative to the golf club head 5692 is nearly 0.5 yards. As described herein, the center location of the face portion may represent the highest statistical strike region on the face portion. In other words, many individuals may strike a golf ball at or proximate to the center location. Accordingly, the golf club head 5693 as described in detail herein (e.g., filled with the first and second filler materials 5712 and 5714, respectively) provides improved performance for all face center strikes in comparison to a golf club head that is similar to the golf club head 5400 but filled with another filler material such as a TPE material (e.g., the golf club head 5691) or an epoxy material (e.g., the golf club head 5692). Further, the ball speed and carry distance for the golf club head 5693 at the heel, the toe, the high, and the low face locations are greater than the ball speed and carry distance for the same locations, respectively, for the golf club heads 5691 and 5692. Accordingly, the golf club head 5693 as described in detail herein (e.g., filled with the first and second filler materials 5712 and 5714, respectively) provides an overall improved performance for all face locations of the golf club head 5693 in comparison to a golf club head that is similar to the golf club head 5400 but filled with another filler material such as a TPE material (e.g., the golf club head 5691) or an epoxy material (e.g., the golf club head 5692).

In one example, the deflections of the center locations of the face portions 5462 of the golf club head 5592 and 5593 in response to golf ball strikes where numerically determined using finite element analysis (FEA). The numerically modeled collision was between a two-part golf ball (USGA Bridgestone Calibration Ball) traveling at 38 m/s (85 mph) and each of the golf club heads 5592 and 5593 in a fixed position with each of the golf club heads 5592 and 5592 having a face portion thickness of approximately 0.059 inches (1.5 mm). The results of the FEA are shown in Table 23 considering nearly identical force at maximum face portion deflection (i.e., nearly identical deformed shapes for the golf ball).

TABLE 23

| Golf Club Head | Time at Maximum Face Center Displacement (s) | Time at Face Portion Rebound (s) | Maximum Face Center Displacement (mm) |
|---|---|---|---|
| Golf Club Head 5592 | 2.03E−04 | 5.82E−04 | 0.36 |
| Golf Club Head 5593 | 2.74E−04 | 5.88E−04 | 0.70 |

As shown in Table 23, the time to reach maximum face center deflection measured from the time the golf ball collides with the face portion 5462 and the rebound time for the face portion 5462 (i.e., time to reach near zero deflection from maximum deflection) are nearly the same for both golf club heads 5592 and 5593. However, as shown in Table 23, the maximum deflection of the face portion 5462 for the golf club head 5593 is nearly twice as large as the maximum deflection of the face portion 5462 for the golf club head 5593 for the nearly the same maximum deflection and rebound time interval. Accordingly, the relatively large deflection and subsequent rebound of the face portion 5462 of the golf club head 5593 in the same time interval as the golf club head 5592 (i.e., higher face rebound velocity) may provide a larger transfer of rebound energy to the golf ball to result in the increased golf ball velocities and carry distances described herein to the golf club head 5593. The apparatus, methods, and articles of manufacture described herein are not limited in this regard.

The body portion and/or the face portion of any of the golf club heads described herein may be partially or entirely made of a steel-based material (e.g., 17-4 PH stainless steel, Nitronic® 50 stainless steel, alloy steel 8620, maraging steel or other types of stainless steel), a titanium-based material, an aluminum-based material (e.g., a high-strength aluminum alloy or a composite aluminum alloy coated with a high-strength alloy), any combination thereof, non-metallic materials, composite materials, and/or other suitable types of materials. The body portion and/or the face portion may be constructed with materials that are similar to any of the body portions and/or face portions described herein or in any of the incorporated by reference applications. The apparatus, methods, and articles of manufacture described herein are not limited in this regard.

In one example, the area of the front surface of the face portion of any of the golf club heads described herein may be greater than or equal to 330 $mm^2$ and less than or equal to 5000 $mm^2$. In another example, the area of the front surface of the face portion of any of the golf club heads described herein may be greater than or equal to 1000 $mm^2$ and less than or equal to 5300 $mm^2$. In yet another example, the area of the front surface of the face portion of any of the golf club heads described herein may be greater than or equal to 1500 $mm^2$ and less than or equal to 4800 $mm^2$. While the above examples may describe particular areas, the area of the front surface may greater than or less than those numbers. The apparatus, methods, and articles of manufacture described herein are not limited in this regard.

In one example, a filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, a filler material may be one or more thermoset polymers having bonding properties (e.g., one or more adhesive or epoxy materials). A material may also absorb shock, isolate vibration, and/or dampen noise when a golf club head as described herein strikes a golf ball. Further, a filler material may be an epoxy material that may be flexible or slightly flexible when cured. In another example, a filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minnesota. In another example, a filler material may include 3M™ Scotch-Weld™ DP100 Plus Clear adhesive. In another example, a filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Michigan. In yet another example, a filler material may be LOCTITE® materials manufactured by Henkel Corporation, Rocky Hill, Connecticut. In another example, a filler material may be a polymer material such as an ethylene copolymer material that may absorb shock, isolate vibration, and/or dampen noise when a golf club head strikes a golf ball via the face portion. In another example, a filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience, i.e., relatively high coefficient of restitution (COR). The apparatus, methods, and articles of manufacture described herein are not limited in this regard. A filler material not specifically described in detail herein may include one or more similar or different types of materials described herein and in any of the incorporated by reference applications. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all of the heating and cooling processes may be performed by using heating or cooling systems that employ conveyor belts that move a golf club head described herein through a heating or cooling environment for a period of time as described herein. The processes of manufacturing a golf club head with one or more filler materials may be similar to any of the processes described in any of the incorporated by reference applications. The apparatus, methods, and articles of manufacture described herein are not limited in this regard.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters (cm3 or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may describe an iron-type or a wedge-type golf club head, the apparatus, methods, and articles of manufacture described herein may be applicable to other types of golf club heads (e.g., a driver-type golf club head, a fairway wood-type golf club head, a hybrid-type golf club head, a putter-type golf club head, etc.). Further, although the above examples may describe steel-based material, the apparatus, methods, and articles of manufacture described herein may be applicable to other types of metal materials, non-metal materials, or both.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The terms "a," "an," and/or "the" used in the context of describing various embodiments the present disclosure are to be construed to cover both the singular and the plural, unless otherwise indicated herein or clearly contradicted by context. The term "coupled", and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein. The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion comprising a toe portion with a toe portion edge, a hosel portion, a top portion with a top portion edge, a sole portion with a sole portion edge, a front portion, a back portion with a back wall portion, and an interior cavity having a lower cavity portion extending from a location proximate to the sole portion edge toward the top portion edge and an upper cavity portion extending from a location proximate to the top portion edge toward the sole portion edge;

a face portion coupled to the front portion to enclose the interior cavity, the face portion having a front surface configured to strike a ball and a back surface opposite the front surface;

a filler material in the interior cavity, the filler material comprising a lower filler portion configured to fill the lower cavity portion and an upper filler portion in the upper cavity portion, the upper filler portion comprising:

a first filler arm portion extending from the lower filler portion toward the top portion edge, the first filler arm portion coupled to the back wall portion; and a second filler arm portion extending from the lower filler portion toward the top portion edge, the second filler arm portion coupled to the back surface of the face portion, wherein a portion of the interior cavity between the first filler arm portion and the second filler arm portion defines a slot extending from the lower filler portion toward the top portion edge.

2. A golf club head as defined in claim 1, wherein the slot extends from a location at or proximate to the toe portion edge to a location at or proximate to the hosel portion.

3. A golf club head as defined in claim 1, wherein the filler material is preformed and inserted into the interior cavity before the face portion is coupled to the front portion.

4. A golf club head as defined in claim 1, wherein a distance between the slot and the face portion is less than a distance between the slot and the back wall portion.

5. A golf club head comprising:

a body portion comprising a toe portion with a toe portion edge, a hosel portion, a top portion with a top portion edge, a sole portion with a sole portion edge, a front portion, a back portion with a back wall portion, and an interior cavity having a lower cavity portion extending from a location proximate to the sole portion edge toward the top portion edge and an upper cavity portion extending from a location proximate to the top portion edge toward the sole portion edge;

a face portion coupled to the front portion to enclose the interior cavity, the face portion having a front surface configured to strike a ball and a back surface opposite the front surface;

a filler material in the interior cavity, the filler material comprising a lower filler portion configured to fill the lower cavity portion and an upper filler portion in the upper cavity portion, the upper filler portion comprising:

a first filler arm portion extending from the lower filler portion toward the top portion edge, the first filler arm portion coupled to the back wall portion; and a second filler arm portion extending from the lower filler portion toward the top portion edge, the second filler arm portion coupled to the back surface of the face portion, wherein a portion of the interior cavity between the first filler arm portion and the second filler arm portion defines a slot extending from the lower filler portion toward the top portion edge, and wherein filler material is a non-metal material.

6. A golf club head as defined in claim 5, wherein the slot extends from a location at or proximate to the toe portion edge to a location at or proximate to the hosel portion.

7. A golf club head as defined in claim 5, wherein the first filler arm portion extends from a location at or proximate to the top portion edge to a location at or proximate to the sole portion edge, and wherein the second filler arm portion extends from a location at or proximate to the top portion edge to a location at or proximate to the sole portion edge.

8. A golf club head as defined in claim 5, wherein the filler material is preformed and inserted into the interior cavity before the face portion is coupled to the front portion.

9. A golf club head as defined in claim 5, wherein a distance between the slot and the face portion is less than a distance between the slot and the back wall portion.

10. A golf club head comprising:

a body portion comprising a toe portion with a toe portion edge, a hosel portion, a top portion with a top portion edge, a sole portion with a sole portion edge, a front portion, a back portion with a back wall portion, and an interior cavity having a lower cavity portion extending from a location proximate to the sole portion edge toward the top portion edge and an upper cavity portion extending from a location proximate to the top portion edge toward the sole portion edge;

a face portion coupled to the front portion to enclose the interior cavity, the face portion having a front surface configured to strike a ball and a back surface opposite the front surface;

a filler material in the interior cavity, the filler material comprising a lower filler portion configured to fill the lower cavity portion and an upper filler portion in the upper cavity portion, the upper filler portion comprising:

a first filler arm portion extending from the lower filler portion toward the top portion edge, the first filler arm portion coupled to the back wall portion; and a second filler arm portion extending from the lower filler portion toward the top portion edge, the second filler arm portion coupled to the back surface of the face portion, wherein a portion of the interior cavity between the first filler arm portion and the second filler arm portion defines a slot extending from the lower filler portion toward the top portion edge, and wherein the first filler arm portion extends from a location at or proximate to the top portion edge to a location at or proximate to the sole portion edge, and wherein the second filler arm portion extends from a location at or proximate to the top portion edge to a location at or proximate to the sole portion edge.

11. A golf club head as defined in claim 10, wherein the slot extends from a location at or proximate to the toe portion edge to a location at or proximate to the hosel portion.

12. A golf club head as defined in claim 10, wherein the filler material is preformed and inserted into the interior cavity before the face portion is coupled to the front portion.

13. A golf club head as defined in claim 10, wherein a distance between the slot and the face portion is less than a distance between the slot and the back wall portion.

* * * * *